United States Patent [19]

Havel

[11] Patent Number: 4,934,852

[45] Date of Patent: Jun. 19, 1990

[54] VARIABLE COLOR DISPLAY TYPEWRITER

[76] Inventor: Karel Havel, 15 Kensington Road, Apt. #704, Bramalea, Ontario, Canada, L6T 3W2

[21] Appl. No.: 336,080

[22] Filed: Apr. 11, 1989

Related U.S. Application Data

[60] Division of Ser. No. 150,913, Feb. 1, 1988, Pat. No. 4,824,267, which is a continuation of Ser. No. 839,626, Mar. 14, 1986, abandoned.

[51] Int. Cl.[5] ..... B41J 29/00

[52] U.S. Cl. ..... 400/704; 400/83; 400/711; 340/709; 340/715; 340/815.1

[58] Field of Search ..... 400/63, 83, 704, 711; 362/811; 340/707, 702, 703, 704, 709, 711, 715, 815.1, 762; 434/227, 232; 368/10; 379/354

[56] References Cited

U.S. PATENT DOCUMENTS

| | | | |
|---|---|---|---|
| 2,717,688 | 9/1955 | Brooks | 400/704 |
| 3,270,438 | 9/1966 | Ephraim | 400/704 X |
| 3,448,334 | 6/1969 | Frost | 340/704 |
| 3,636,515 | 1/1972 | Smith | 340/703 X |
| 3,838,417 | 9/1974 | Charas | 340/815.1 X |
| 3,924,231 | 12/1975 | McClure | 340/815.1 X |
| 4,086,514 | 4/1978 | Havel | 340/703 X |
| 4,136,395 | 1/1979 | Kolpek et al. | 400/63 X |
| 4,140,997 | 2/1979 | Brady | 340/701 X |
| 4,323,315 | 4/1982 | Demonte et al. | 400/63 |
| 4,399,434 | 8/1983 | Bielat | 340/815.1 X |
| 4,420,711 | 12/1983 | Takahashi et al. | 340/704 |
| 4,442,424 | 4/1984 | Shirasaki et al. | 340/715 X |
| 4,488,149 | 12/1984 | Givins, Jr. | 340/715 X |
| 4,617,562 | 10/1986 | Klotz | 340/701 |
| 4,647,217 | 3/1987 | Havel | 368/10 |
| 4,673,252 | 6/1987 | Kugo et al. | 340/701 X |
| 4,687,340 | 8/1987 | Havel | 340/762 X |
| 4,702,615 | 10/1987 | Havel | 340/701 X |
| 4,707,141 | 11/1987 | Havel | 340/701 X |
| 4,726,059 | 2/1988 | Havel | 379/354 |
| 4,734,619 | 3/1988 | Havel | 340/701 X |
| 4,736,198 | 4/1988 | Tokuyama et al. | 340/702 X |
| 4,771,274 | 9/1988 | Havel | 340/762 X |
| 4,785,432 | 11/1988 | Havel | 340/701 X |
| 4,789,855 | 12/1988 | Ozeki | 340/703 |
| 4,794,383 | 12/1988 | Havel | 340/704 |
| 4,804,890 | 2/1989 | Havel | 340/762 |

FOREIGN PATENT DOCUMENTS

| | | | |
|---|---|---|---|
| 3534569 | 4/1986 | Fed. Rep. of Germany | 400/704 |
| 0048609 | 4/1980 | Japan | 340/703 |
| 0123424 | 7/1983 | Japan | 340/762 |

OTHER PUBLICATIONS

Hewlett Packard Application Note 1001, "Interfacing the HDSP-2000 to Microprocessor Systems", pp. 398-413, 1980.

1984 National Semiconductor Corporation CMOS Databook, pp. 1-319.

*Primary Examiner*—Ernest T. Wright, Jr.

[57] ABSTRACT

A typewriter with variable color display visually presents typed text in a color variable in accordance with the typing speed and accuracy.

10 Claims, 36 Drawing Sheets

ICI CHROMATICITY DIAGRAM

VARIABLE COLOR DISPLAY TYPEWRITER

CROSS-REFERENCE TO RELATED APPLICATIONS

This is a division of my copending application Ser. No. 07/150,913, filed on Feb. 1, 1988, entitled Variable Color Display Typewriter, now U.S. Pat. No. 4,824,269 issued on Apr. 25, 1989, which is a continuation of my application Ser. No. 06/839,626, filed on Mar. 14, 1986, entitled Variable Color Display Typewriter, now abandoned.

Reference is also made to my related applications Ser. No. 06/817,114, filed on Jan. 8, 1986, entitled Variable Color Digital Timepiece, now U.S. Pat. No. 4,647,217 issued on Mar. 3, 1987, Ser. No. 06/819,111, filed on Jan. 15, 1986, entitled Variable Color Digital Multimeter, now U.S. Pat. No. 4,794,383 issued on Dec. 27, 1988, Ser. No. 06/839,526, filed on Mar. 14, 1986, entitled Variable Color Display Telephone, now U.S. Pat. No. 4,726,059 issued on Feb. 16, 1988, and Ser. No. 07/000,478, filed on Jan. 5, 1987, entitled Variable Color Digital Tachometer, now abandoned, which describe instruments employing variable color display devices.

BACKGROUND OF THE INVENTION

1. Field of the Invention

This invention relates to typewriters utilizing variable color display.

2. Description of the Prior Art

A display device that can change color and selectively display characters described in my U.S. Pat. No. 4,086,514, issued on Apr. 25, 1978 and entitled Variable Color Display Device, includes display areas with three light emitting diodes for emitting variable portions of light signals of respectively different primary colors, which are blended within each display area to form a composite light signal.

Monochromatic display typewriters have flourished in recent years and are extensively used. Such display typewriters, however, are capable of visually presenting only the typed text. They are not capable of simultaneously indicating the typing speed and accuracy.

An electronic typewriter disclosed in U.S. Pat. No. 4,323,315, issued on Apr. 6, 1982 to Filippo Demonte et al. and entitled Electronic Typewriter with Display Device, includes a monochromatic display which is capable of displaying characters with different kinds of emphasis.

A microprocessor-based display controller for 5×7 matrix monochromatic display is described in Hewlett-Packard application note 1001, pages 398–413, issued in 1980 and entitled Interfacing the HDSP-2000 to Microprocessor Systems.

A device for indicating typing speed and rhythm disclosed in U.S. Pat. No. 2,717,688, issued on Sept. 13, 1955 to James A. Brooks and entitled Typing Speed and Rhythm Indicating Apparatus for Typewriters, includes a light bulb which remains continuously lit when the typist keeps depressing keys with sufficient speed and uniformity.

An electronic typewriter described in West German Patent No. 3,534,569, issued on Apr. 3, 1986 to O. Flugel et al. and entitled Electronic Typewriter with Print Speed Monitoring, includes a monochromatic display for digitally indicating typing speed.

A word processing system disclosed in U.S. Pat. No. 4,136,395, issued on Jan. 23, 1979 to Robert A. Kolpek et al. and entitled System for Automatically Proofreading a Document, includes a dictionary memory and comparator for detecting spelling errors.

SUMMARY OF THE INVENTION

In a broad sense, it is the principal object of this invention to provide a typewriter with a variable color display.

The invention endeavors to overcome problems of the prior art display typewriters by providing a new type of a display typewriter.

In the preferred embodiment is disclosed a variable color display typewriter that visually presents typed text in a color variable in accordance with the typing speed.

It is another object of the invention to provide a variable color display typewriter that visually presents typed text in a color variable in accordance with the typing accuracy.

Such typewriter is ideally suited for professional typists and for those who strive to improve and polish their typing skills.

BRIEF DESCRIPTION OF THE DRAWINGS

In the drawings in which are shown several possible embodiments of the invention.

Throughout the drawings, like characters indicate like parts.

BRIEF DESCRIPTION OF THE TABLES

In the tables which show examples of a relationship between an input voltage, memory contents, and resulting color in the color converter of the present invention, TABLE 1 shows the characteristic of a step variable 2-primary color converter.

TABLE 2 shows a rainbow-like characteristic of a continuously variable 3-primary color converter.

Throughout the tables, memory addresses and data are expressed in a well known hexadecimal notation.

BRIEF DESCRIPTION OF THE CHARTS

Figure 36:
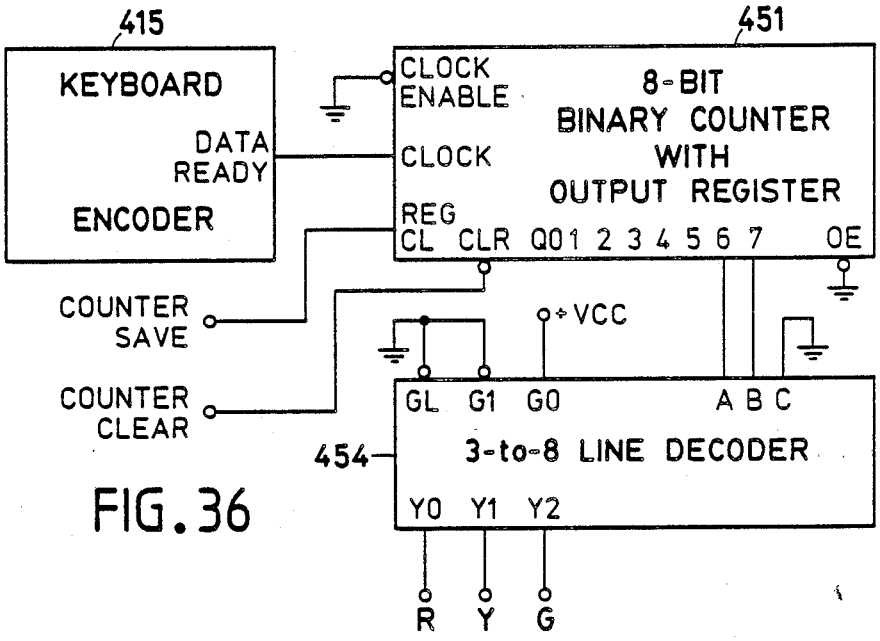
FIG. 36 is a detail of the counter and decoder combination shown generally in FIG. 29 for controlling the color of the typewriter display in three steps.

In the charts which show examples of the relationship between the measured typing speed and resulting color of the typewriter display, CHART 1 shows the relationship between count retained in the counter of FIG. 36, typing speed limits, and resulting color of the typewriter display.

Figure 37:
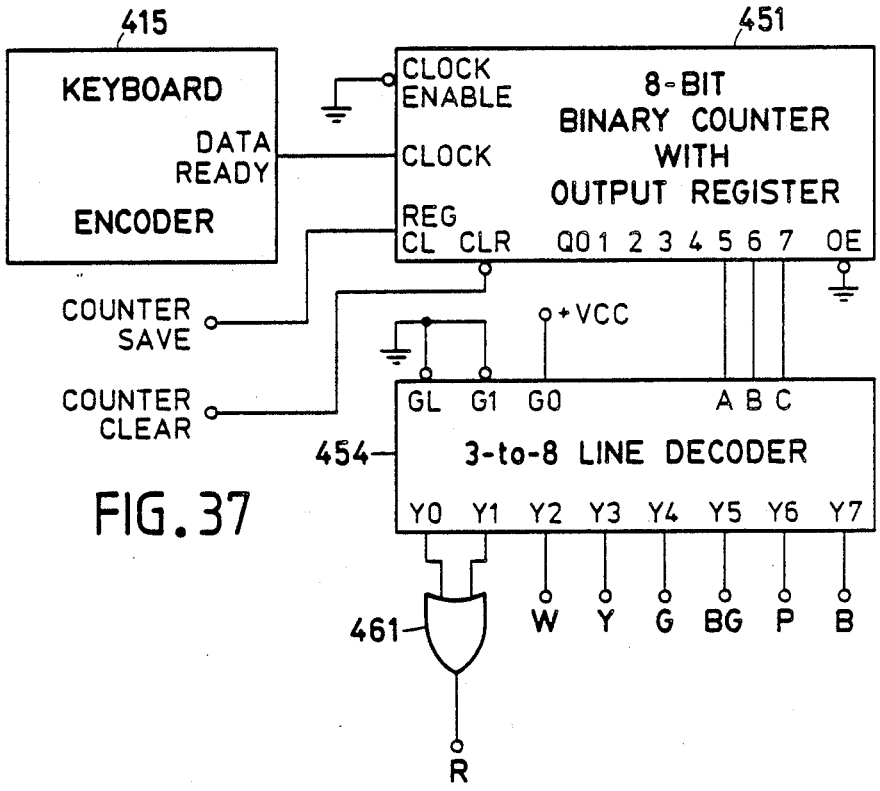
FIG. 37 is a detail of the counter and decoder combination shown generally in FIG. 29 for controlling the color of the typewriter display in seven steps.

CHART 2 shows the relationship between count retained in the counter of FIG. 37, typing speed limits, and resulting color of the typewriter display.

Figure 39:
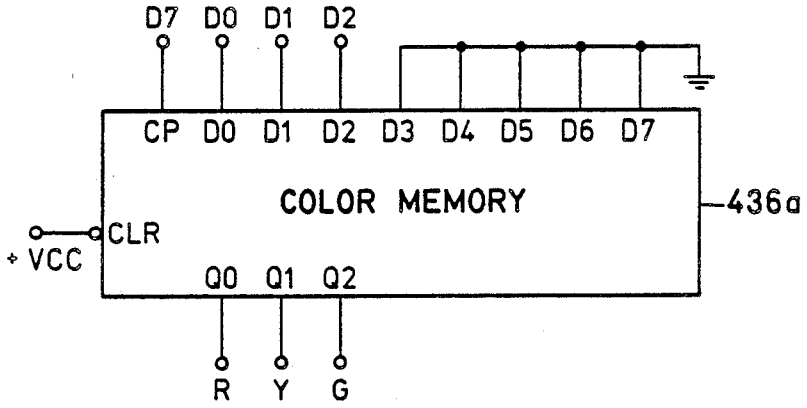
FIG. 39 is a detail of the color memory of FIG. 38 for controlling the color of the typewriter display in three steps.

CHART 3 shows the relationship between time limits for typing 10 characters, binary code stored in the color memory of FIG. 39, typing speed limits, and resulting color of the typewriter display.

Figure 40:
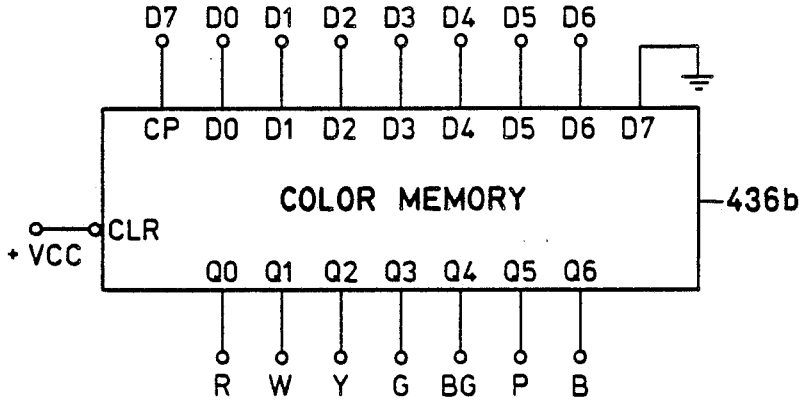
FIG. 40 is a like detail of the color memory of FIG. 38 for controlling the color of the typewriter display in seven steps.

CHART 4 shows the relationship between time limits for typing 10 characters, binary code stored in the color memory of FIG. 40, typing speed limits, and resulting color of the typewriter display.

DESCRIPTION OF THE PREFERRED EMBODIMENTS

Figure 1:
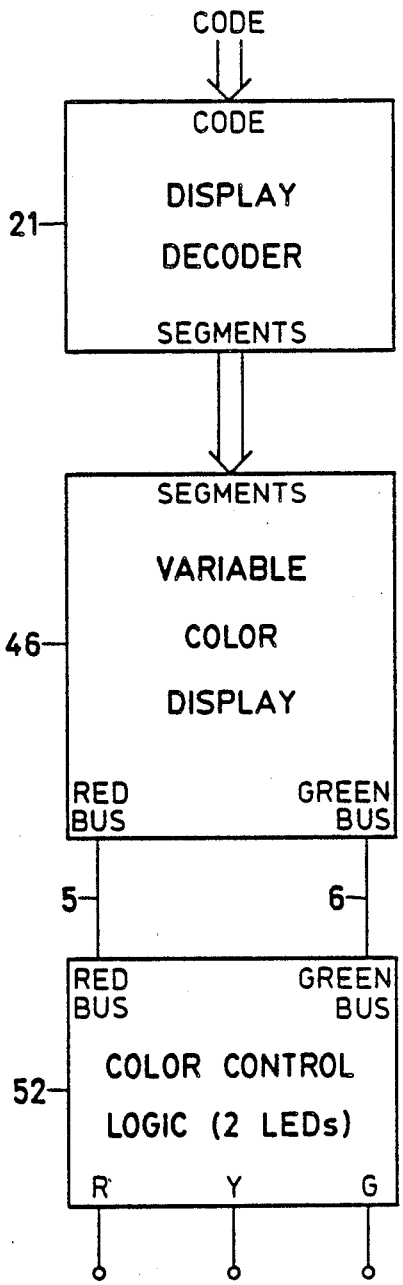
FIG. 1 is a block diagram of 2-primary color display system.

Referring now, more particularly, to the drawings, in FIG. 1 is shown a block diagram of a 2-primary color display system including a display decoder 21, a variable color 2-LED display element 46, and a 2-primary color control 52. The display decoder 21 accepts at its inputs a code representing the character to be displayed and accordingly develops output drive signals to drive respective segments of display element 46. The color control 52 accepts color control signals at its inputs R (red), Y (yellow), and G (green) and develops at its outputs drive signals for red bus 5 and green bus 6, respectively, to illuminate display element 46 in a selected color.

Figure 2:
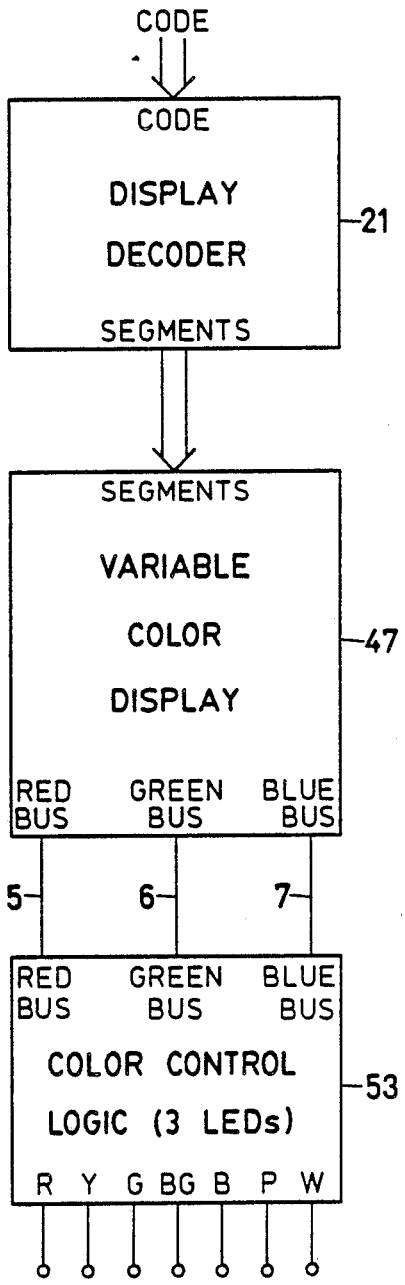
FIG. 2 is a block diagram of 3-primary color display system.

In FIG. 2 is shown a block diagram of a 3-primary color display system including a display decoder 21, a variable color 3-LED display element 47, and a 3-primary color control 53. The color control 53 accepts color control signals at its inputs R (red), Y (yellow), G (green), BG (blue-green), B (blue), P (purple), and W (white) and develops at its outputs drive signals for red bus 5, green bus 6, and blue bus 7, respectively, to illuminate display element 47 in a selected color.

Figure 3:
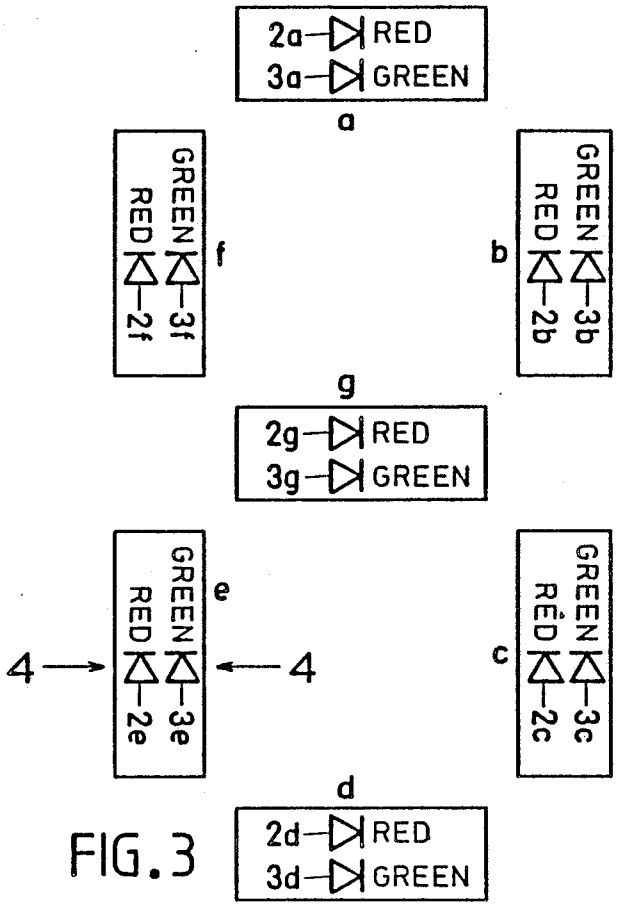
FIG. 3 is an enlarged detail of one digit of 2-primary color digital display.

In FIG. 3, the 2-primary color display element 46 includes seven elongated display segments a, b, c, d, e, f, and g, arranged in a conventional pattern, which may be selectively energized in different combinations to display the desired digits. Each display segment includes a pair of LEDs (light emitting diodes): red LED 2 and green LED 3, which are closely adjacent such that the light signals emitted therefrom are substantially superimposed upon each other to mix the colors. To facilitate the illustration, the LEDs are designated by segment symbols, e.g., the red LED in the segment a is designated as 2*a*, etc.

Figure 4:
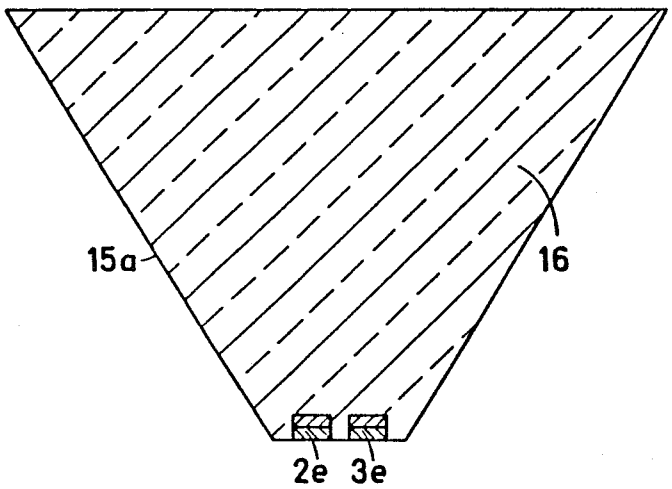
FIG. 4 is an enlarged cross-sectional view of one display segment in FIG. 3, taken along the line 4—4.

In FIG. 4, red LED 2*e* and green LED 3*e* are placed on the base of a segment body 15*a* which is filled with a transparent light scattering material 16. When forwardly biased, LEDs 2*e* and 3*e* emit light signals of red and green colors, respectively, which are scattered within transparent material 16, thereby blending the red and green light signals into a composite light signal that emerges at the upper surface of segment body 15*a*. The color of the composite light signal may be controlled by varying the portions of the red and green light signals.

Figure 5:
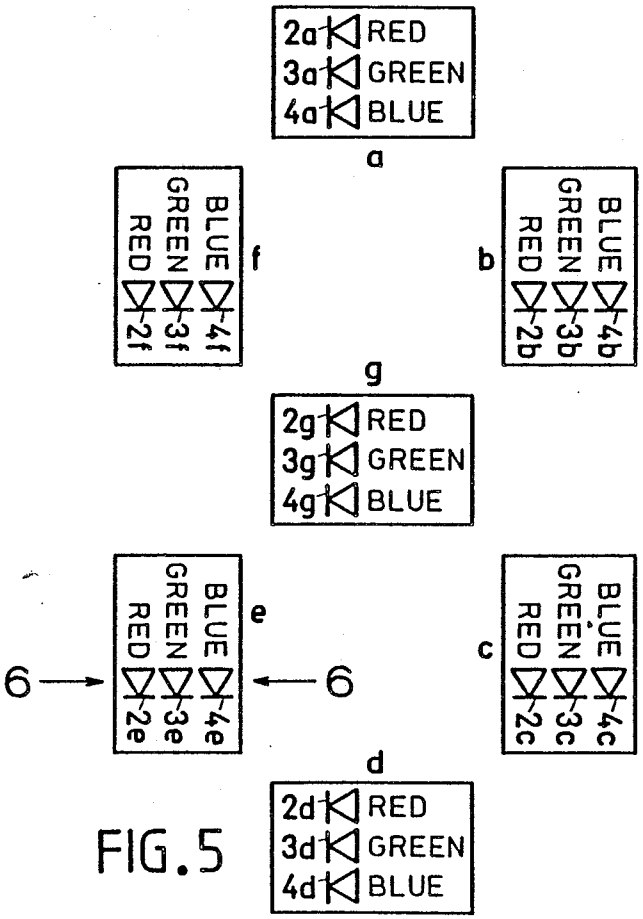
FIG. 5 is an enlarged detail of one digit of 3-primary color digital display.

In FIG. 5, each display segment of the 3-primary color display element 47 includes a triad of LEDs: red LED 2, green LED 3, and blue LED 4, which are closely adjacent such that the light signals emitted therefrom are substantially superimposed upon one another to mix the colors.

Figure 6:
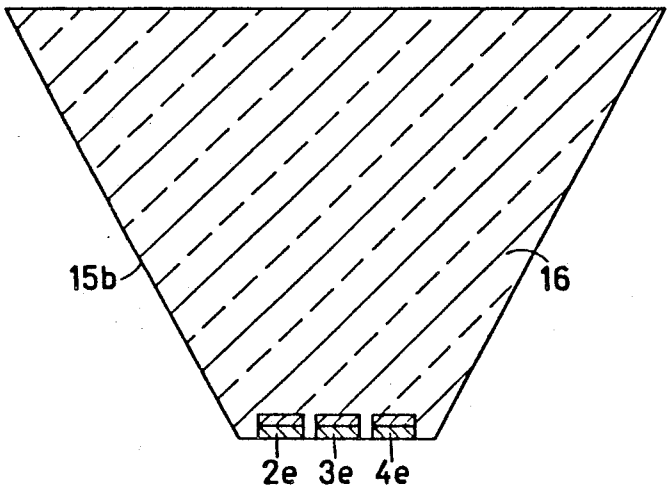
FIG. 6 is an enlarged cross-sectional view of one display segment in FIG. 5, taken along the line 6—6.

In FIG. 6, red LED 2*e*, green LED 3*e*, and blue LED 4*e* are placed on the base of a segment body 15*b* which is filled with a transparent light scattering material 16. Red LEDs are typically manufactured by diffusing a p-n junction into a GaAsP epitaxial layer on a GaAs substrate; green LEDs typically use a GaP epitaxial layer on a GaP substrate; blue LEDs are typically made from SiC material.

When forwardly biased, LEDs 2*e*, 3*e*, and 4*e* emit light signals of red, green, and blue colors, respectively, which are scattered within transparent material 16, thereby blending the red, green, and blue light signals into a composite light signal that emerges at the upper surface of segment body 15*b*. The color of the composite light signal may be controlled by varying the portions of the red, green, and blue light signals.

Figure 7:
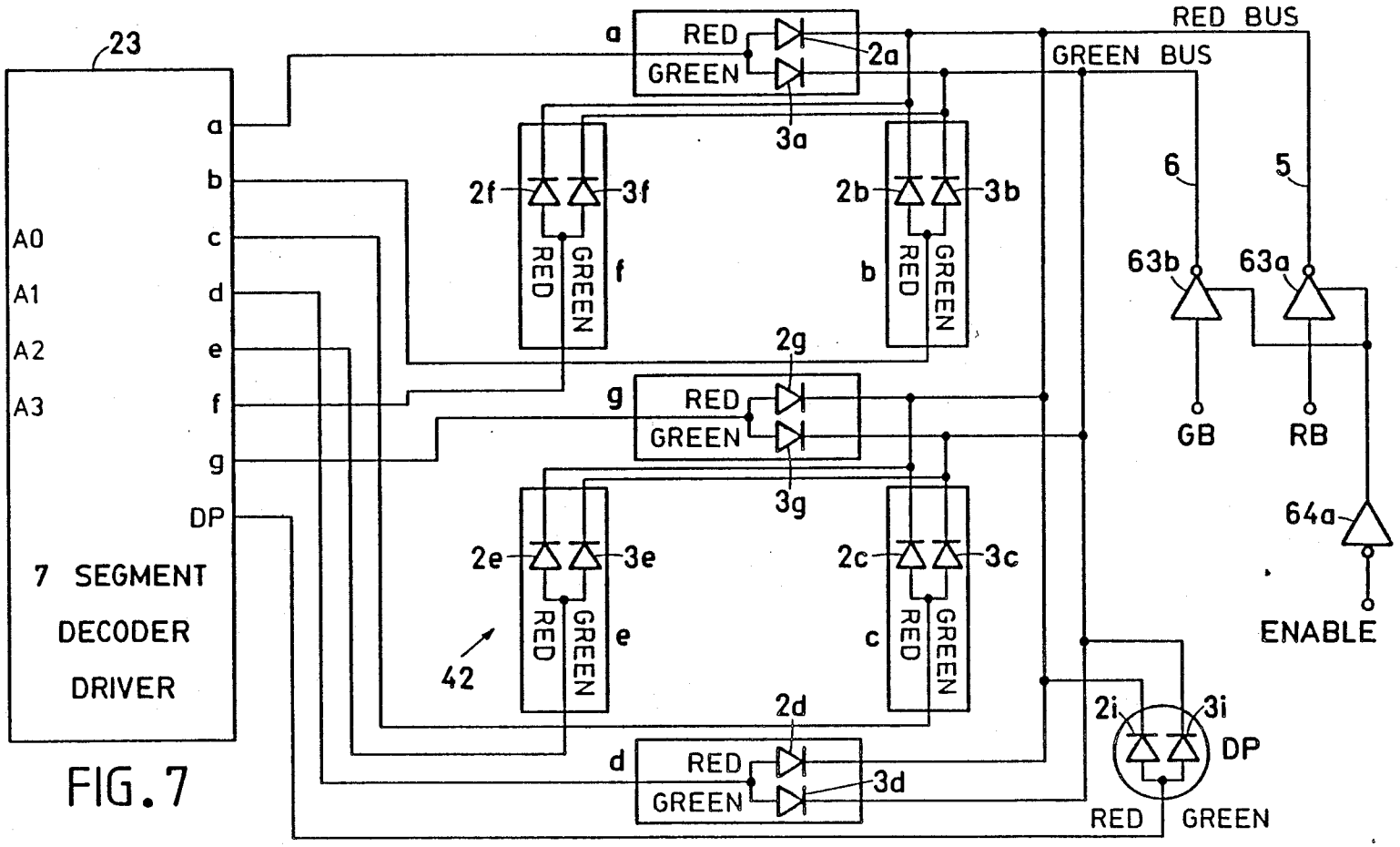
FIG. 7 is a schematic diagram of one 2-primary color display element.

In FIG. 7 is shown a schematic diagram of a 2-primary color common cathodes 7-segment display element 42 which can selectively display various digital fonts in different colors on display segments a, b, c, d, e, f, g, and DP (Decimal Point). The anodes of all red and green LED pairs are interconnected in each display segment and are electrically connected to respective outputs of a commercially well known common-cathode 7-segment decoder driver 23. The cathodes of all red LEDs 2*a*, 2*b*, 2*c*, 2*d*, 2*e*, 2*f*, 2*g*, and 2*i* are interconnected to a common electric path referred to as a red bus 5. The cathodes of all green LEDs 3*a*, 3*b*, 3*c*, 3*d*, 3*e*, 3*f*, 3*g*, and 3*i* are interconnected to a like common electric path referred to as a green bus 6.

The red bus 5 is connected to the output of a tri-state inverting buffer 63*a*, capable of sinking sufficient current to forwardly bias all red LEDs 2*a* to 2*i* in display element 42. The green bus 6 is connected to the output of a like buffer 63*b*. The two buffers 63*a* and 63*b* can be simultaneously enabled by applying a low logic level signal to the input of inverter 64*a*, and disabled by applying a high logic level signal thereto. When buffers 63*a* and 63*b* are enabled, the conditions of red bus 5 and green bus 6 can be selectively controlled by applying suitable logic control signals to the bus control inputs RB (red bus) and GB (green bus), to illuminate display element 42 in a selected color. When buffers 63*a* and 63*b* are disabled, both red bus 5 and green bus 6 are effectively disconnected to cause display element 42 to be completely extinguished.

Figure 8:
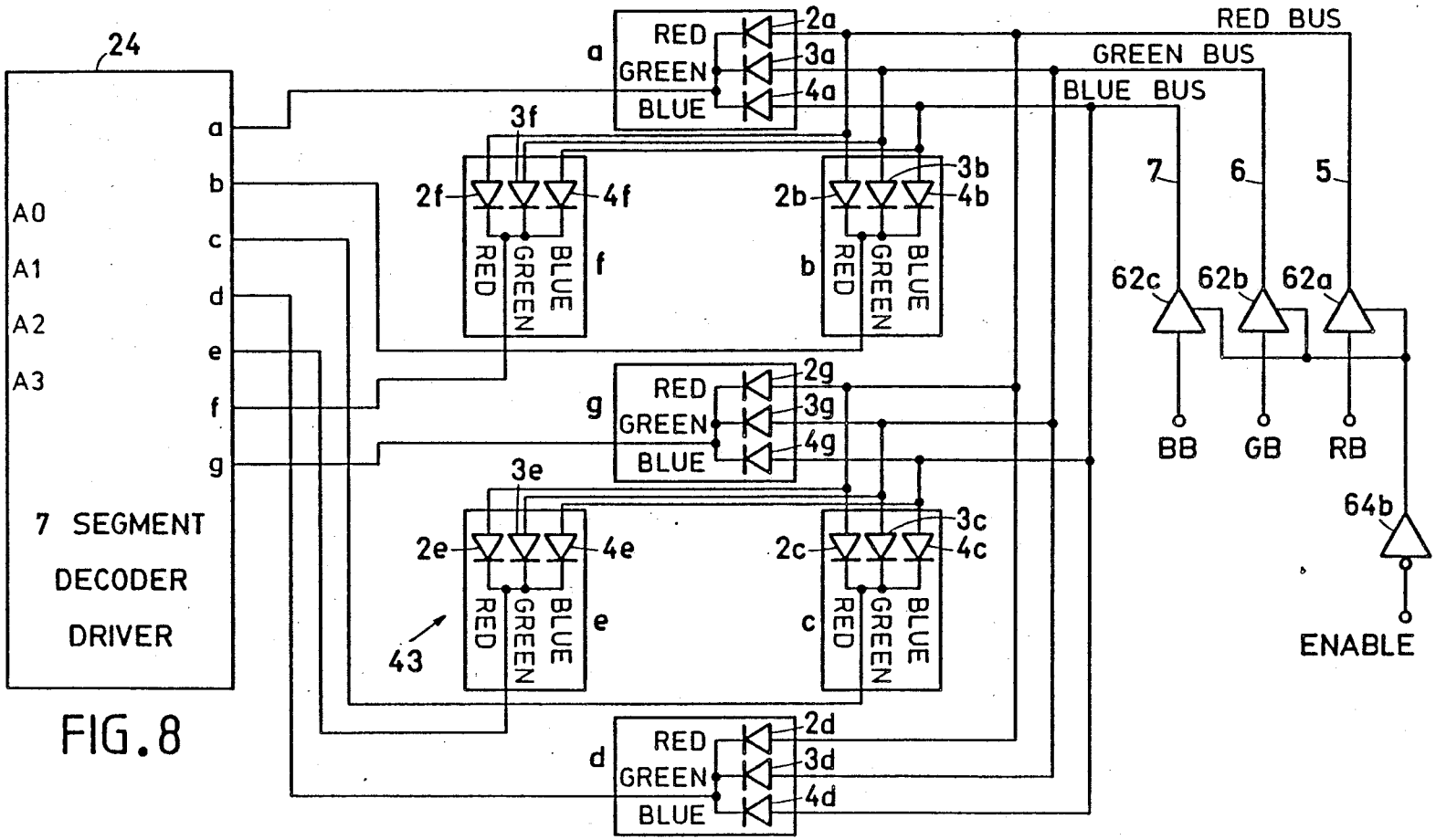
FIG. 8 is a schematic diagram of one 3-primary color display element.

In FIG. 8 is shown a schematic diagram of a 3-primary color common anodes 7-segment display element 43 which can selectively display digital fonts in different colors. The cathodes of all red, green, and blue LED triads in each display segment are interconnected and electrically connected to respective outputs of a commercially well know common anode 7-segment decoder driver 24. The anodes of all red LEDs 2*a*, 2*b*, 2*c*, 2*d*, 2*e*, 2*f*, and 2*g* are interconnected to form a common electric path referred to as a red bus 5. The anodes of all green LEDs 3*a*, 3*b*, 3*c*, 3*d*, 3*e*, 3*f*, and 3*g* are interconnected to form a like common electric path referred to as a green bus 6. The anodes of all blue LEDs 4*a*, 4*b*, 4*c*, 4*d*, 4*e*, 4*f*, and 4*g* are interconnected to form a like common electric path referred to as a blue bus 7.

The red bus 5 is connected to the output of a non-inverting tri-state buffer 62*a*, capable of sourcing sufficient current to illuminate all red LEDs 2*a* to 2*g* in display element 43. The green bus 6 is connected to the output of a like buffer 62*b*. The blue bus 7 is connected to the output of a like buffer 62*c*. The three buffers 62*a*, 62*b*, and 62*c* can be simultaneously enabled, by applying a low logic level signal to the input of inverter 64*b*, and disabled by applying a high logic level signal thereto. When buffers 62*a*, 62*b*, and 62*c* are enabled, the conditions of red bus 5, green bus 6, and blue bus 7 can be selectively controlled by applying valid combinations of logic level signals to the bus control inputs RB (red bus), GB (green bus), and BB (blue bus), to illuminate display element 43 in a selected color. When buffers 62*a*, 62*b*, and 62*c* are disabled, red bus 5, green bus 6, and blue bus 7 are effectively disconnected to cause display element 43 to be completely extinguished.

STEP VARIABLE COLOR CONTROL

Figure 9:
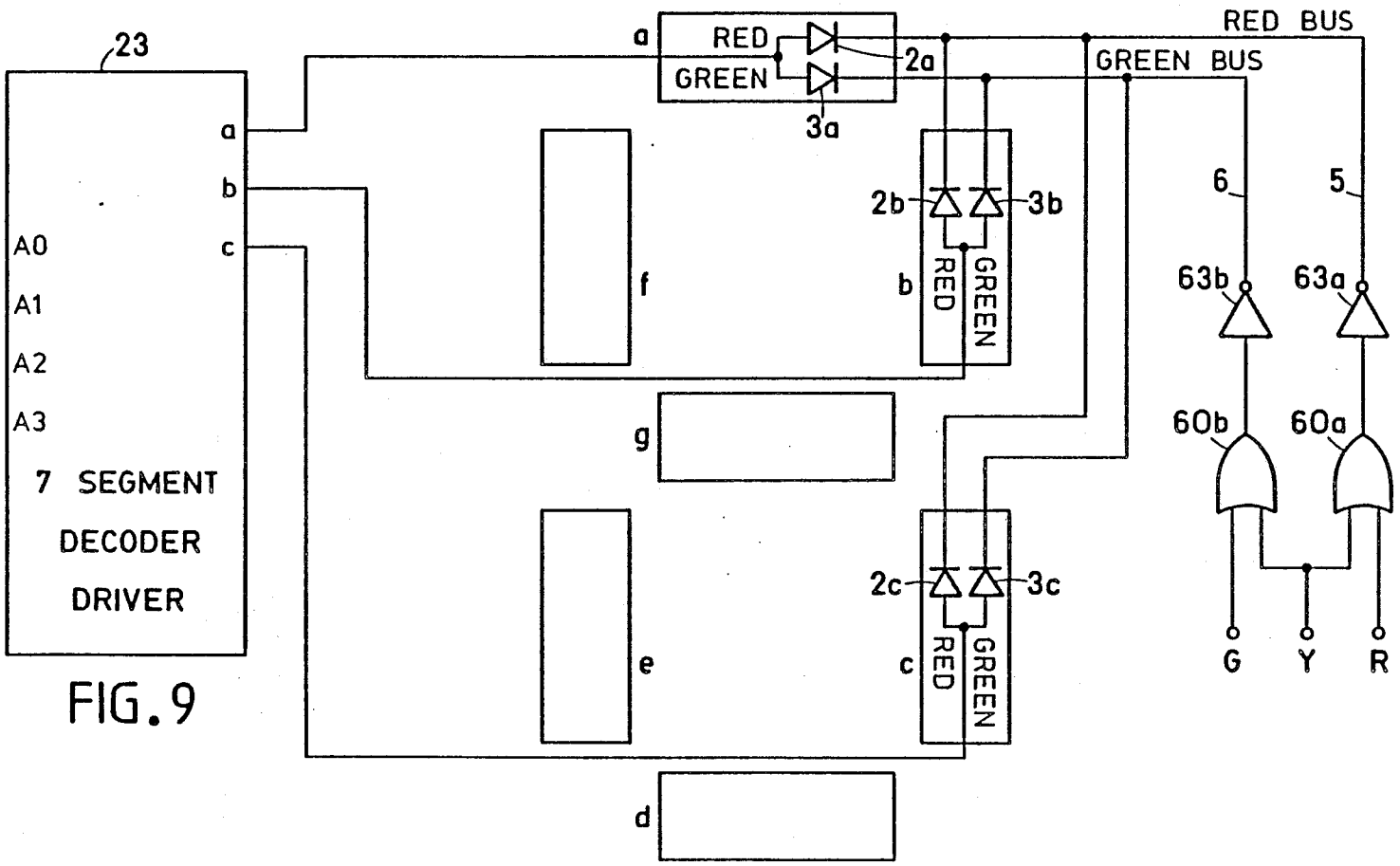
FIG. 9 is a simplified schematic diagram, similar to FIG. 7, showing how number '7' can be displayed in three different colors.

The operation of display element 42 shown in FIG. 7 will be now explained by the example of illuminating a digit '7' in three different colors. A simplified schematic diagram to facilitate the explanation is shown in FIG. 9. Any digit between 0 and 9 can be selectively displayed by applying the appropriate BCD code to the inputs A0, A1, A2, and A3 of common-cathode 7-segment decoder driver 23. The decoder driver 23 develops at its outputs a, b, c, d, e, f, g, and DP drive signals for energizing selected groups of the segments to thereby visually display the selected number, in a manner well known to those having ordinary skill in the art. To display decimal number '7', a BCD code 0111 is applied to the inputs A0, A1, A2, and A3. The decoder driver 23 develops high voltage levels at its outputs a, b, and c, to illuminate equally designated segments a, b, and c, and low voltage levels at all remaining outputs (not shown), to extinguish all remaining segments d, e, f, and g.

To illuminate display element 42 in red color, the color control input R is raised to a high logic level, and the color control inputs Y and G are maintained at a low logic level. As a result, the output of OR gate 60*a* rises to a high logic level, thereby causing the output of buffer 63*a* to drop to a low logic level. The current flows from the output a of decoder driver 23, via red LED 2*a* and red bus 5, to current sinking output of buffer 63*a*. Similarly, the current flows from the output b of decoder driver 23, via red LED 2*b* and red bus 5, to the output of buffer 63*a*. The current flows from the output c of decoder driver 23, via red LED 2*c* and red bus 5, to the output of buffer 63*a*. As a result, segments a, b, and c illuminate in red color, thereby causing a visual impression of a character '7'. The green LEDs 3a, 3b, 3c remain extinguished because the output of buffer 63b is at a high logic level, thereby disabling green bus 6.

To illuminate display element 42 in green color, the color control input G is raised to a high logic level, while the color control inputs R and Y are maintained at a low logic level. As a result, the output of OR gate 60b rises to a high logic level, thereby causing the output of buffer 63b to drop to a low logic level. The current flows from the output a of decoder driver 23, via green LED 3a and green bus 6, to current sinking output of buffer 63b. Similarly, the current flows from the output b of decoder driver 23, via green LED 3b and green bus 6, to the output of buffer 63b. The current flows from the output c of decoder driver 23, via green LED 3c and green bus 6, to the output of buffer 63b. As a result, segments a, b, and c illuminate in green color. The red LEDs 2a, 2b, and 2c remain extinguished because the output of buffer 63a is at a high logic level, thereby disabling red bus 5.

To illuminate display element 42 in yellow color, the color control input Y is raised to a high logic level, while the color inputs R and G are maintained at a low logic level. As a result, the outputs of both OR gates 60a and 60b rise to a high logic level, thereby causing the outputs of both buffers 63a and 63b to drop to a low logic level. The current flows from the output a of decoder driver 23, via red LED 2a and red bus 5, to current sinking output of buffer 63a, and, via green LED 3a and green bus 6, to current sinking output of buffer 63b. Similarly, the current flows from the output b of decoder driver 23, via red LED 2b and red bus 5, to the output of buffer 63a, and, via green LED 3b and green bus 6, to the output of buffer 63b. The current flows from the output c of decoder driver 23, via red LED 2c and red bus 5, to the output of buffer 63a, and, via green LED 3c and green bus 6, to the output of buffer 63b. As a result of blending light of red and green colors in each segment, segments a, b, and c illuminate in substantially yellow color.

Figure 10:
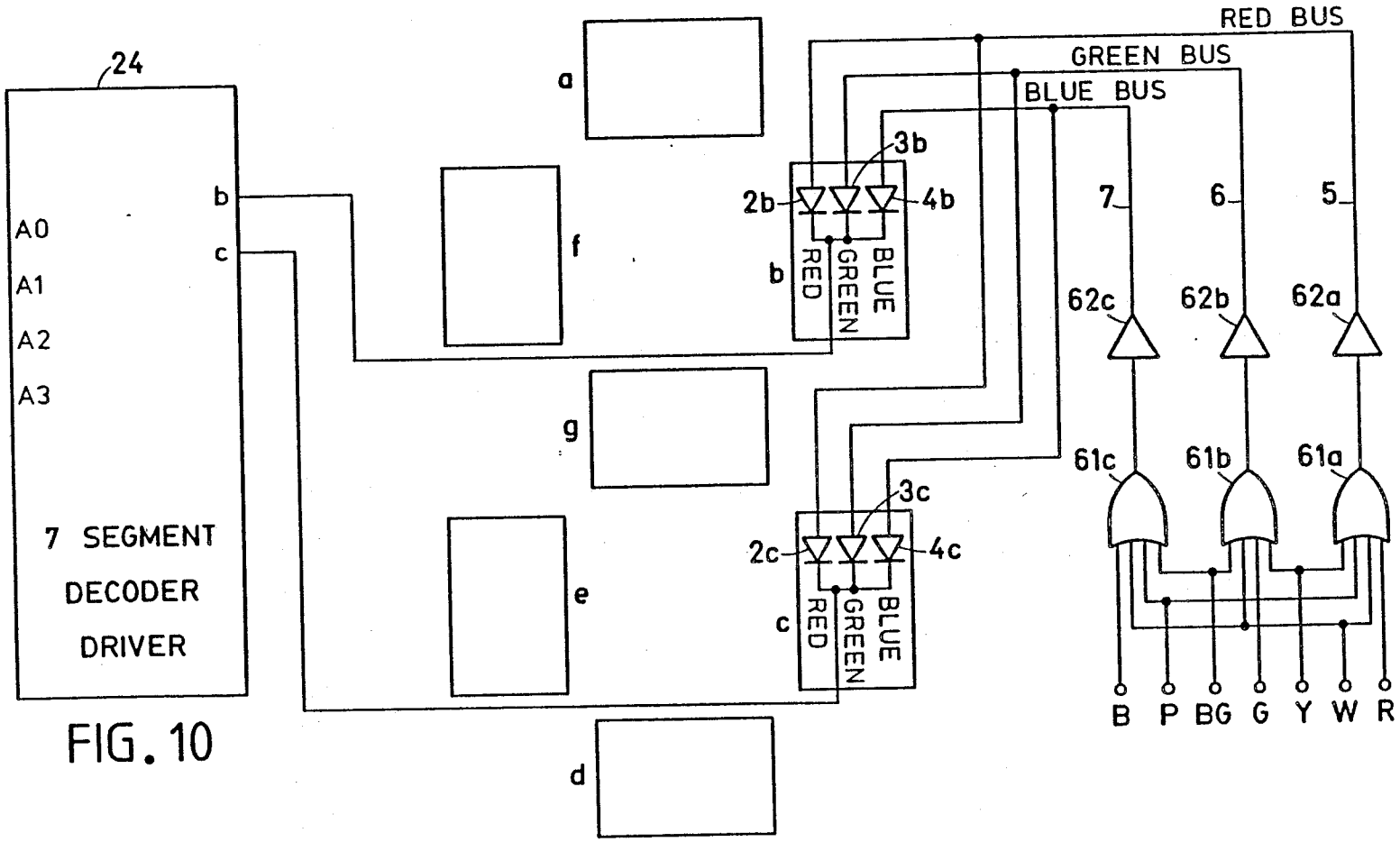
FIG. 10 is a simplified schematic diagram, similar to FIG. 8, showing how number '1' can be displayed in seven different colors.

The operation of display element 43 shown in FIG. 8 will be now explained by the example of illuminating a digit '1' in seven different colors. A simplified schematic diagram to facilitate the explanation is shown in FIG. 10. To display decimal number '1', a BCD code 0001 is applied to the inputs A0, A1, A2, and A3 of common anode 7-segment decoder driver 24. The decoder driver 24 develops low voltage levels at its outputs b and c, to illuminate equally designated segments b and c, and high voltage levels at all remaining outputs (not shown), to extinguish all remaining segments a, d, e, f, and g.

To illuminate display element 43 in red color, the color control input R is raised to a high logic level, while all remaining color control inputs are maintained at a low logic level. As a result, the output of OR gate 61a rises to a high logic level, thereby causing the output of buffer 62a to rise to a high logic level. The current flows from the output of buffer 62a, via red bus 5 and red LED 2b, to the output b of decoder driver 24, and, via red LED 2c, to the output c of decoder driver 24. As a result, segments b and c illuminate in red color, thereby causing a visual impression of a character '1'. The green LEDs 3b, 3c and blue LEDs 4b, 4c remain extinguished because green bus 6 and blue bus 7 are disabled.

To illuminate display element 43 in green color, the color control input G is raised to a high logic level, while all remaining color control inputs are maintained at a low logic level. As a result, the output of OR gate 61b rises to a high logic level, thereby causing the output of buffer 62b to rise to a high logic level. The current flows from the output of buffer 62b, via green bus 6 and green LED 3b, to the output b of decoder driver 24, and, via green LED 3c, to the output c of decoder driver 24. As a result, segments b and c illuminate in green color.

To illuminate display element 43 in blue color, the color control input B is raised to a high logic level, while all remaining color control inputs are maintained at a low logic level. As a result, the output of OR gate 61c rises to a high logic level, thereby causing the output of buffer 62c to rise to a high logic level. The current flows from the output of buffer 62c, via blue bus 7 and blue LED 4b, to the output b of decoder driver 24, and, via blue LED 4c, to the output c of decoder driver 24. As a result, segments b and c illuminate in blue color.

To illuminate display element 43 in yellow color, the color control input Y is raised to a high logic level, while all remaining color control inputs are maintained at a low logic level. As a result, the outputs of OR gates 61a and 61b rise to a high logic level, thereby causing the outputs of buffers 62a and 62b to rise to a high logic level. The current flows from the output of buffer 62a, via red bus 5 and red LED 2b, to the output b of decoder driver 24, and, via red LED 2c, to the output c of decoder driver 24. The current also flows from the output of buffer 62b, via green bus 6 and green LED 3b, to the output b of decoder driver 24, and, via green LED 3c, to the output c of decoder driver 24. As a result of blending light of red and green colors in each segment, the segments b and c illuminate in substantially yellow color.

To illuminate display element 43 in purple color, the color control input P is raised to a high logic level, while all remaining color control inputs are maintained at a low logic level. As a result, the outputs of OR gates 61a and 61c rise to a high logic level, thereby causing the outputs of buffers 62a and 62c to rise to a high logic level. The current flows from the output of buffer 62a, via red bus 5 and red LED 2b, to the output b of decoder driver 24, and, via red LED 2c, to the output c of decoder driver 24. The current also flows from the output of buffer 62c, via blue bus 7 and blue LED 4b, to the output b of decoder driver 24, and, via blue LED 4c, to the output c of decoder driver 24. As a result of blending light of red and blue colors in each segment, segments b and c illuminate in substantially purple color.

To illuminate display element 43 in blue-green color, the color control input BG is raised to a high logic level, while all remaining color control inputs are maintained at a low logic level. As a result, the outputs of OR gates 61b and 61c rise to a high logic level, thereby causing the outputs of buffers 62b and 62c to rise to a high logic level. The current flows from the output of buffer 62b, via green bus 6 and green LED 3b, to the output b of decoder driver 24, and, via green LED 3c, to the output c of decoder driver 24. The current also flows from the output of buffer 62c, via blue bus 7 and blue LED 4b, to the output b of decoder driver 24, and, via blue LED 4c, to the output c of decoder driver 24. As a result of blending light of green and blue colors in each segment, segments b and c illuminate in substantially blue-green color.

To illuminate display element 43 in white color, the color control input W is raised to a high logic level, while all remaining color control inputs are maintained at a low logic level. As a result, the outputs of OR gates 61*a*, 61*b*, and 61*c* rise to a high logic level, thereby causing the outputs of respective buffers 62*a*, 62*b*, and 62*c* to rise to a high logic level. The current flows from the output of buffer 62*a*, via red bus 5 and red LED 2*b*, to the output b of decoder driver 24, and, via red LED 2*c*, to the output c of decoder driver 24. The current also flows from the output of buffer 62*b*, via green bus 6 and green LED 3*b*, to the output b of decoder driver 24, and, via green LED 3*c*, to the output c of decoder driver 24. The current also flows from the output of buffer 62*c*, via blue bus 7 and blue LED 4*b*, to the output b of decoder driver 24, and, via blue LED 4*c*, to the output c of decoder driver 24. As a result of blending light of red, green, and blue colors in each segment, segments b and c illuminate in substantially white color.

Since the outputs of decoder driver 24 may be overloaded by driving a triad of LEDs in parallel in display element 43, rather than a single LED in a monochromatic display, it would be obvious to employ suitable buffers to drive respective color display segments (not shown).

Figure 11:
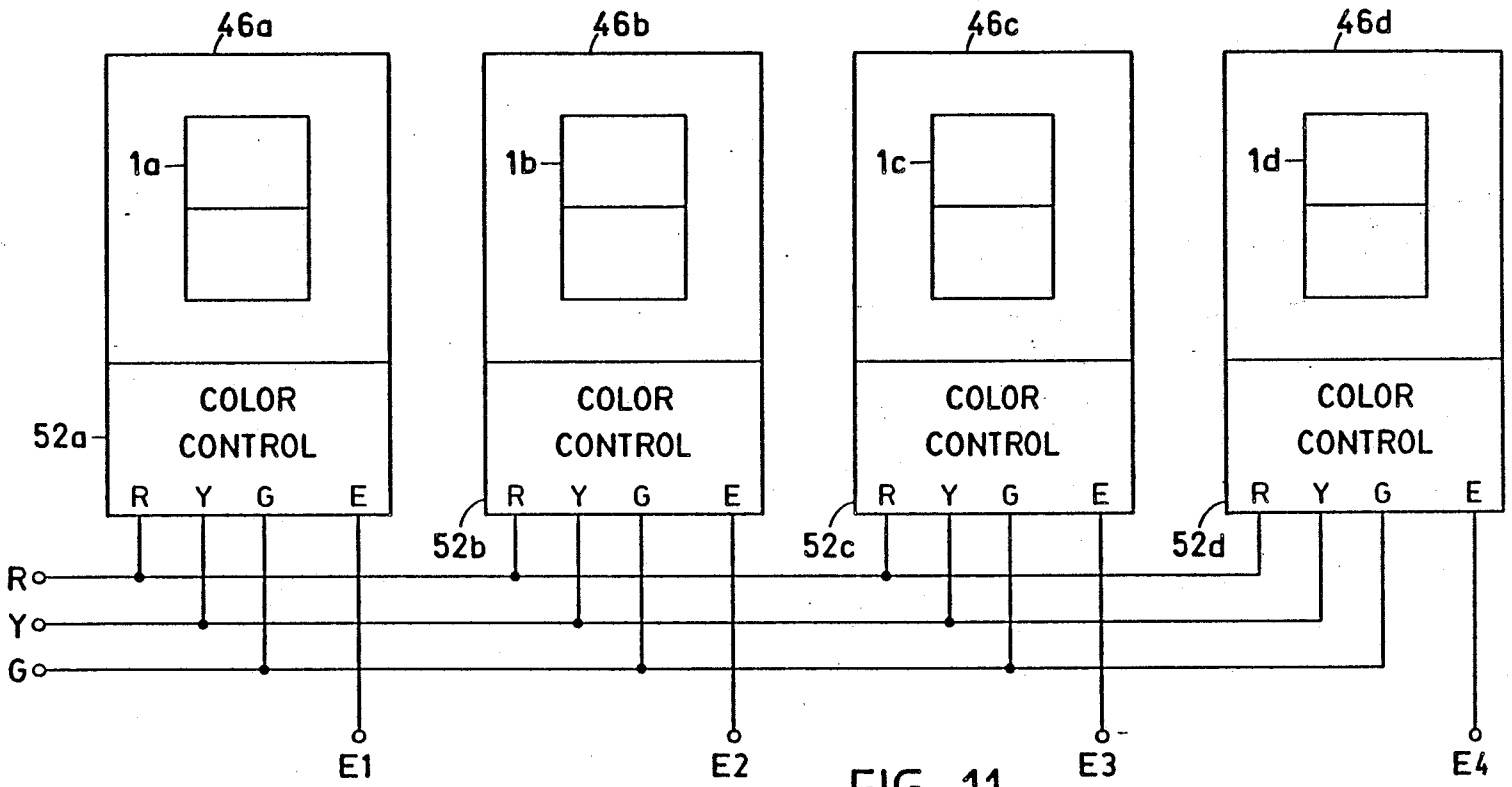
FIG. 11 is a block diagram of 2-primary color 4-digit display.

To illustrate how the present invention can be utilized in a multi-element variable color display configuration, in FIG. 11 is shown a detail of the interconnection in a 2-primary color 4-digit display having display segments 1*a*, 1*b*, 1*c*, and 1*d* arranged in a 7-segment font. The color control inputs R, Y, and G of color controls 52*a*, 52*b*, 52*c*, and 52*d* of all display elements 46*a*, 46*b*, 46*c*, and 46*d* are interconnected, respectively, and enable inputs E1, E2, E3, and E4 are used to control the conditions of respective display elements 46*a*, 46*b*, 46*c*, and 46*d*. A high logic level at the enable input E extinguishes the particular display element 46*a*, 46*b*, 46*c*, or 46*d*; a low logic level therein illuminates display element 46*a*, 46*b*, 46*c*, or 46*d* in a color determined by the instant conditions of the color control inputs R, Y, and G.

Figure 12:
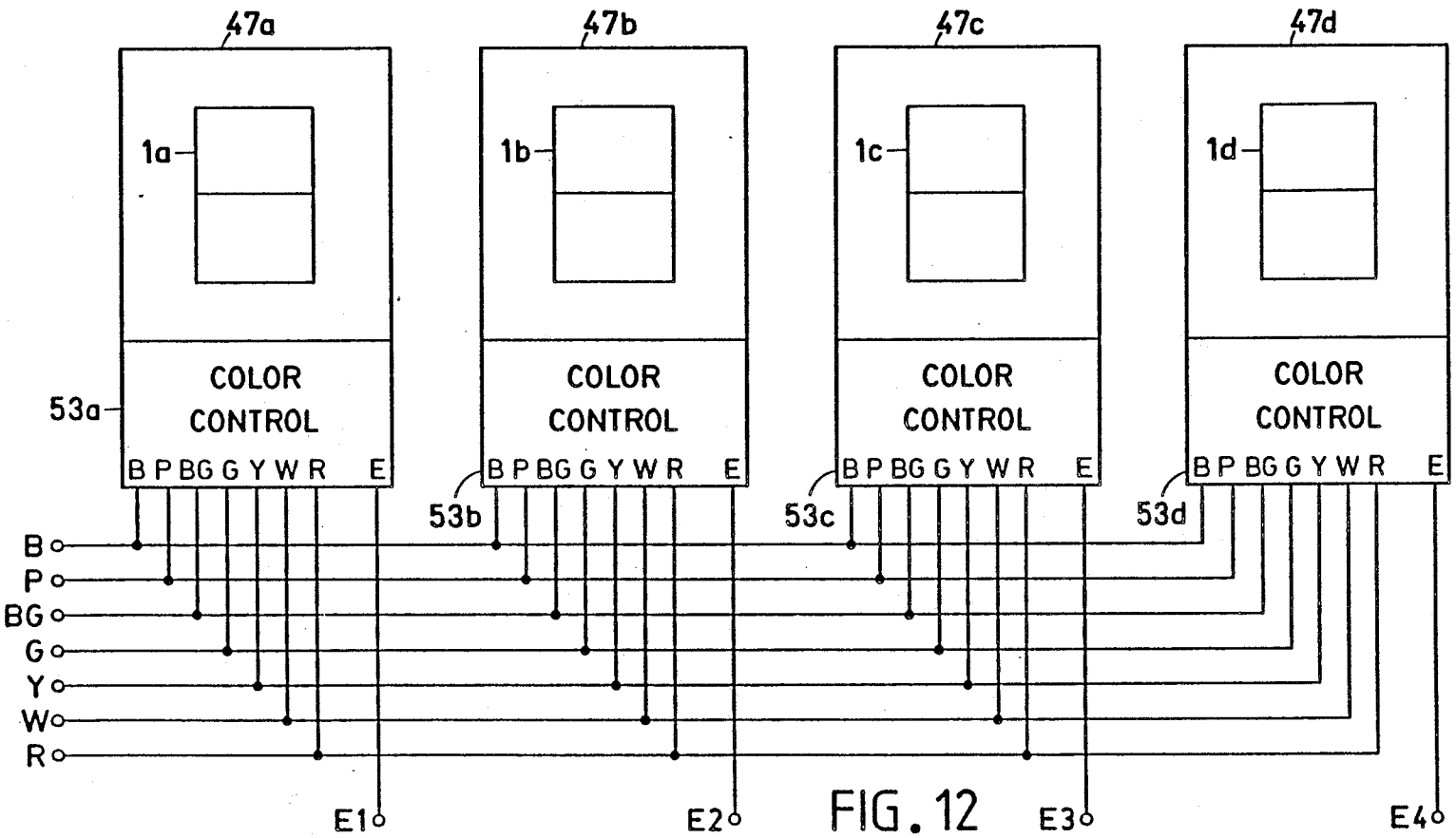
FIG. 12 is a block diagram of 3-primary color 4-digit display.

In FIG. 12 is shown a like detail of the interconnection in a 3-primary color 4-digit display having display segments 1*a*, 1*b*, 1*c*, and 1*d* arranged in a 7-segment font. Similarly, the color control inputs B, P, BG, G, Y, W, and R of color controls 53*a*, 53*b*, 53*c*, and 53*d* of all display elements 47*a*, 47*b*, 47*c*, and 47*d* are interconnected, and the conditions of respective display elements 47*a*, 47*b*, 47*c*, and 47*d* are controlled by enable inputs E1, E2, E3, and E4. A high logic level at the enable input E extinguishes the particular display element 47*a*, 47*b*, 47*c*, or 47*d*; a low logic level therein illuminates display element 47*a*, 47*b*, 47*c*, or 47*d* in a color determined by the instant conditions of the color control inputs B, P, BG, G, Y, W, and R.

The exemplary color control circuits described herein will cooperate equally well with a multi-element variable color display constructed either in common cathodes or in common anodes configuration.

CONTINUOUSLY VARIABLE COLOR CONVERTER

Figure 13:
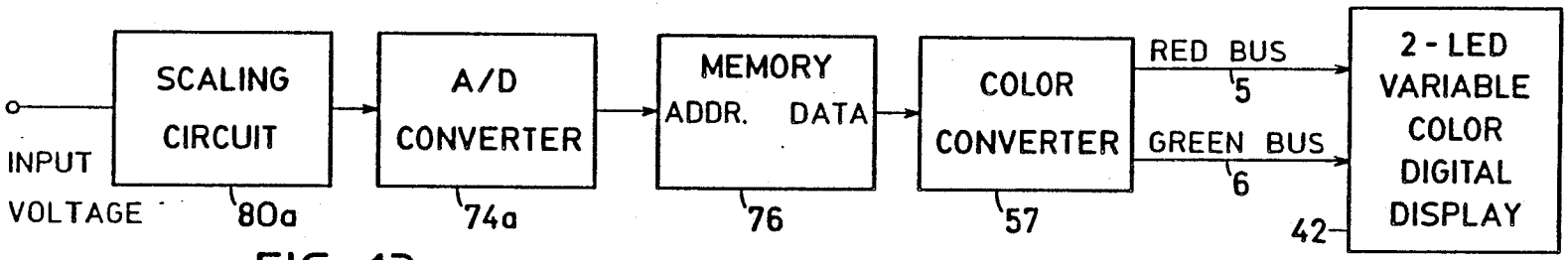
FIG. 13 is an expanded block diagram of 2-LED color converter.

The display system shown in FIG. 13 utilizes a scaling circuit 80*a* which scales input analog voltage levels to a voltage range suitable for an A/D converter 74*a*, which in turn develops at its outputs a digital code having relation to the value of the input analog voltage. The output lines of A/D converter 74*a* are connected to the address inputs of a memory 76 having a plurality of addressable locations which contain data indicating the portions of red color for several different values of the input analog voltage. The output data of memory 76 are applied to the inputs of a color converter 57 which will develop control signals for red bus 5 and green bus 6, respectively, of variable color display element 42.

Figure 14:
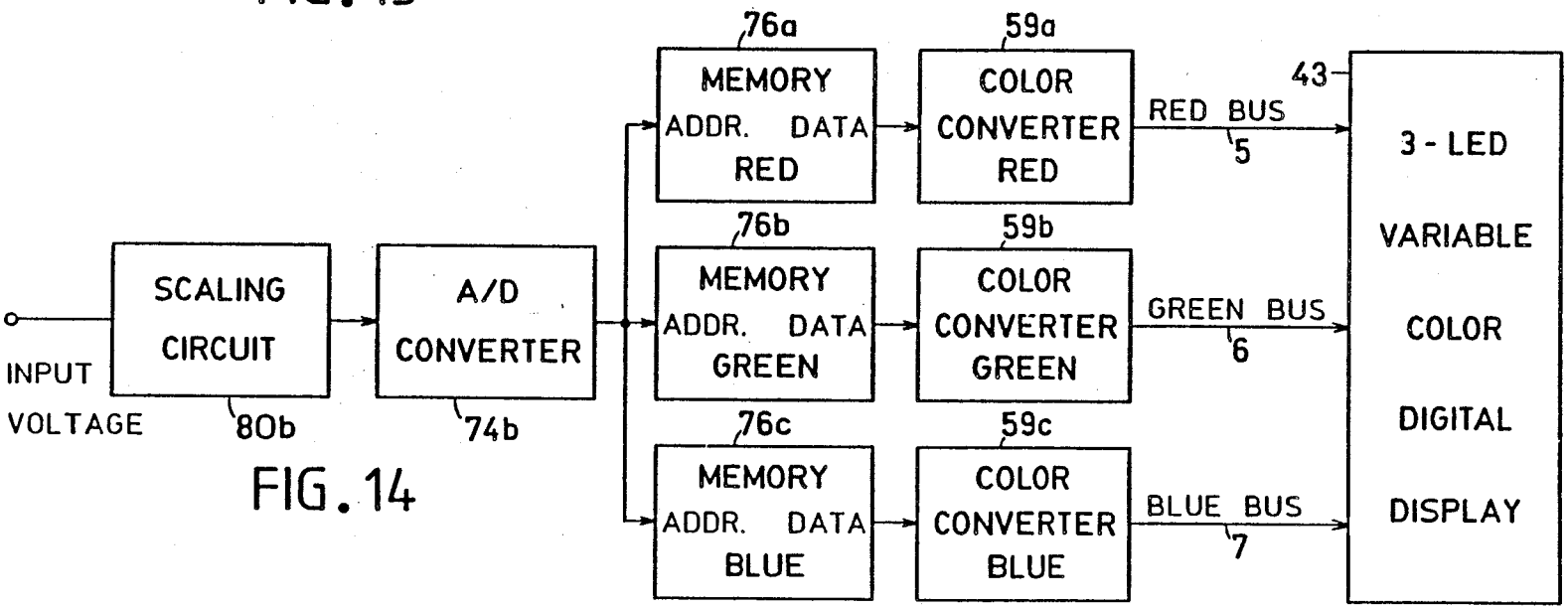
FIG. 14 is an expanded block diagram of 3-LED color converter.

The display system shown in FIG. 14 utilizes a scaling circuit 80*b* and an A/D converter 74*b* for converting the instant value of an input analog voltage to a digital code. The outputs of A/D converter 74*b* are connected, in parallel, to the address inputs of memory 76*a*, which contains data indicating the portions of red color, to the address inputs of memory 76*b*, which contains data indicating the portions of green color, and to the address inputs of memory 76*c*, which contains data indicating the portions of blue color. The output data of memory 76*a* are applied to red color converter 59*a* which will develop control signals for red bus 5 of variable color display element 43. The output data of memory 76*b* are applied to green color converter 59*b* which will develop control signals for green bus 6 of display element 43. The output data of memory 76*c* are applied to blue color converter 59*c* which will develop control signals for blue bus 7 of display element 43.

Figure 15:
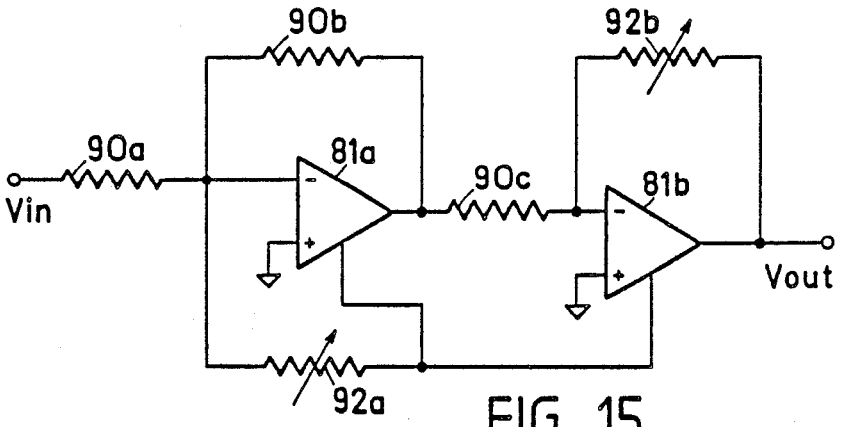
FIG. 15 is a schematic diagram of a scaling circuit.

FIG. 15 is a schematic diagram of a scaling circuit capable of shifting and amplifying the input voltage levels. The circuit utilizes two operational amplifiers 81*a* and 81*b* in a standard inverting configuration. The amplifier 81*a* is set for a unity gain by using resistors 90*a* and 90*b* of equal values; potentiometer 92*a* is adjusted to set a desired offset voltage. The amplifier 81*b* sets the gain by adjusting feedback potentiometer 92*b* to a desired value with respect to resistor 90*c*. As a result, an input voltage, which may vary between arbitrary limits Vlow and Vhigh, may be scaled and shifted to the range between 0 Volts and 9.961 Volts, to facilitate the use of a commercially available A/D converter.

Figure 16:
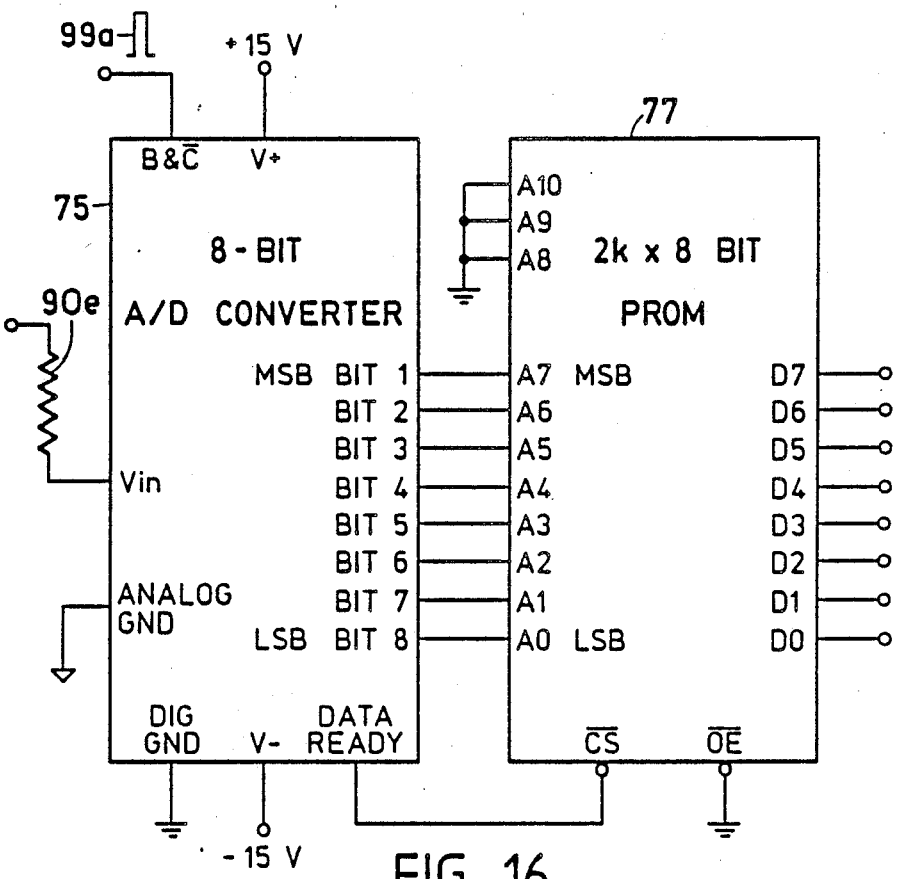
FIG. 16 is a schematic diagram of an A/D converter and memory combination of FIGS. 13 and 14.

FIG. 16 is a schematic diagram of an A/D (analog-to-digital) converter 75 which is capable of converting input analog voltage, applied via resistor 90*e* to its input Vin, to 8-bit digital data for addressing a memory 77. The conversion may be initiated from time to time by applying a short positive pulse 99*a* to the Blank and Convert input B&C. A/D converter 75 will thereafter perform a conversion of the instant input voltage to 8-bit data indicative of its value. When the conversion is completed, the Data Ready output drops to a low logic level, thereby indicating that the data are available at the outputs Bit 1 to Bit 8, which are directly connected to respective address inputs A0 to A7 of memory 77. When the DATA READY output drops to a low logic level, the Chip Select input CS of memory 77 is activated, memory 77 is enabled, and the data, residing at the address selected by the instant output of A/D converter 75, will appear at its data outputs D0 to D7.

Figure 17:
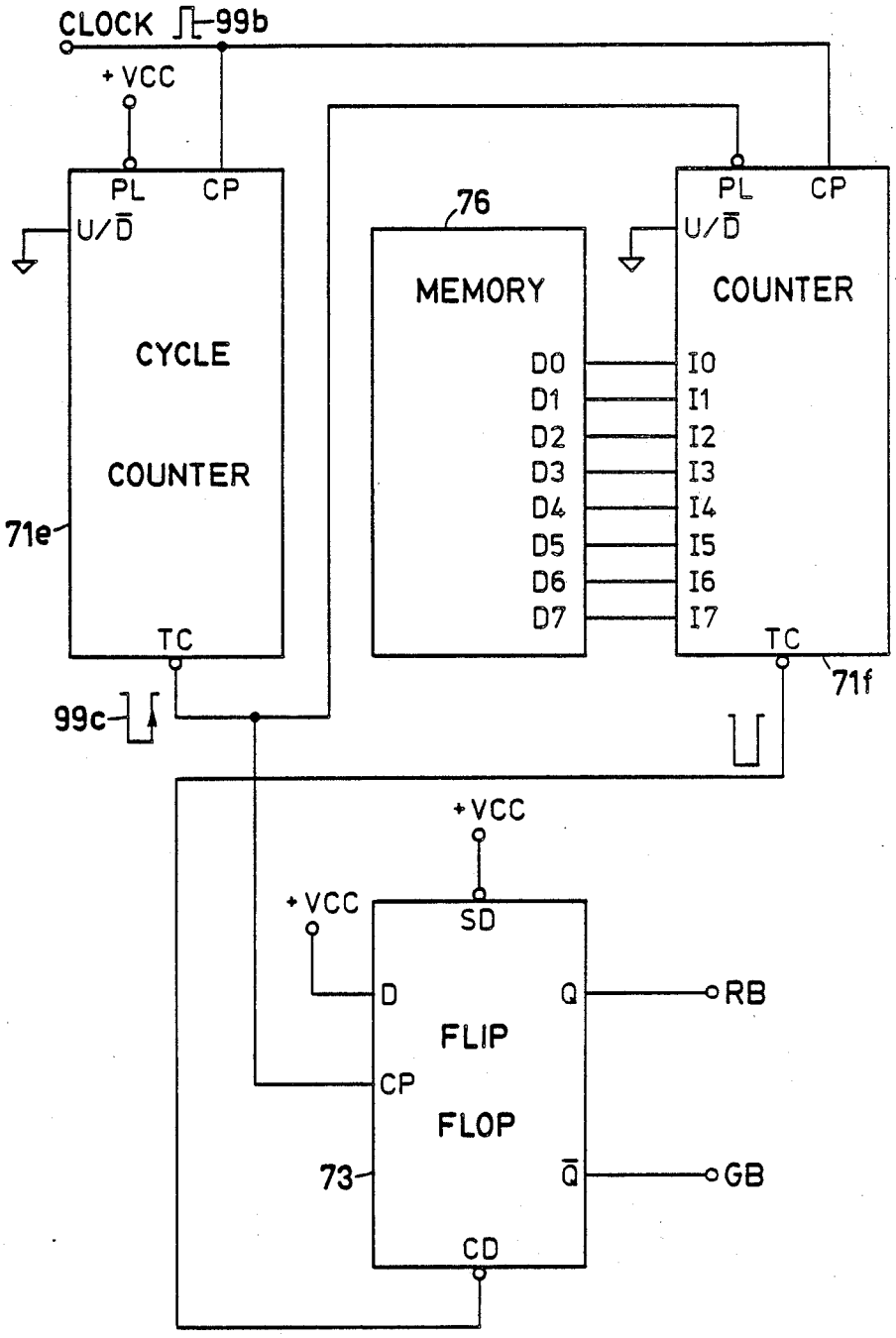
FIG. 17 is a schematic diagram of a memory and color converter combination of FIG. 13.
Figure 18:
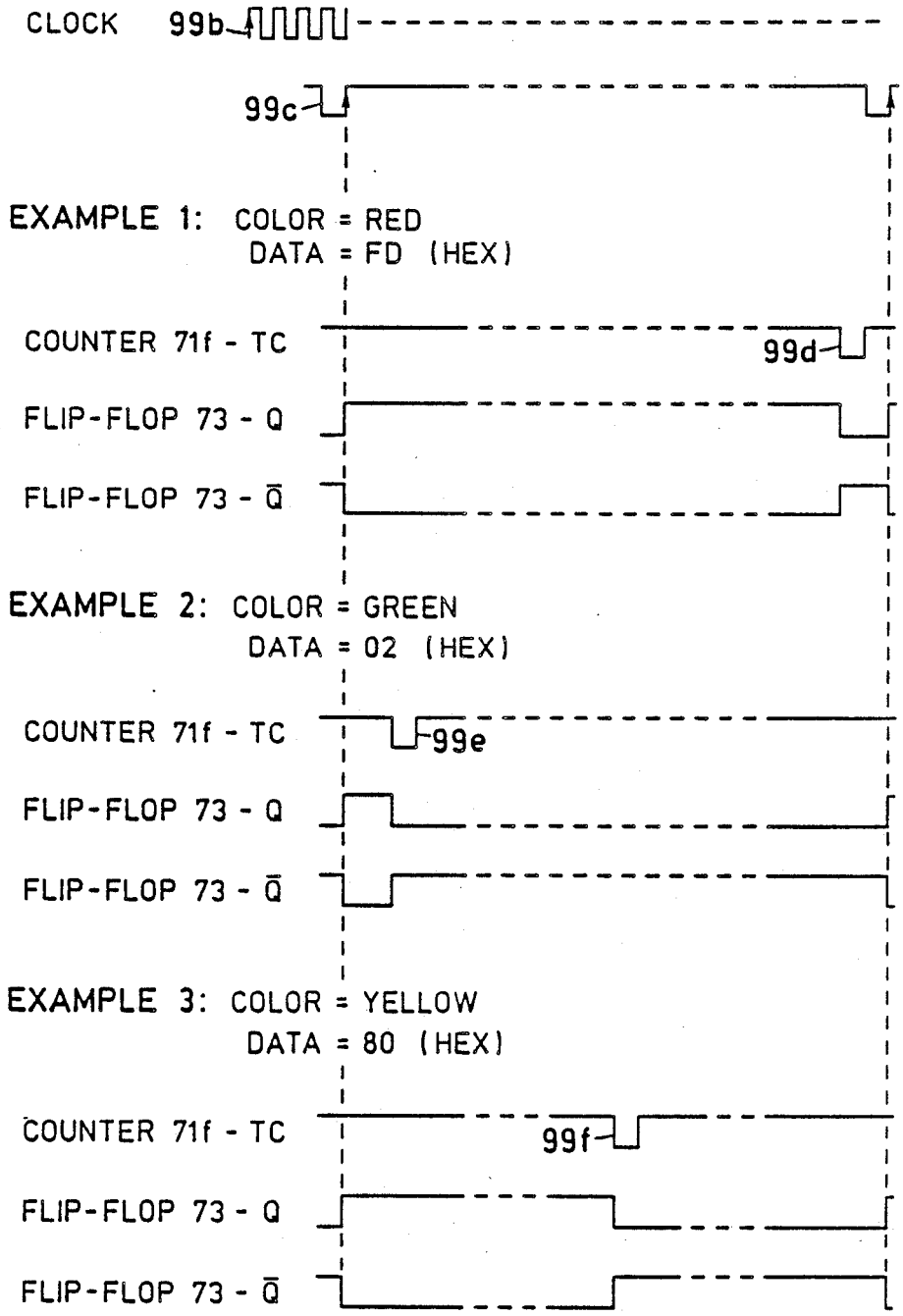
FIG. 18 is a timing diagram of the circuit shown in FIG. 17.

The description of the schematic diagram in FIG. 17 should be considered together with its accompanying timing diagram shown in FIG. 18. A clock signal 99*b* of a suitable frequency (e.g., 10 kHz), to provide a flicker-free display, is applied to the Clock Pulse inputs CP of 8-bit binary counters 71*e* and 71*f* to step them down. At the end of each counter cycle, which takes 256 clock cycles to complete, the Terminal Count output TC of counter 71*e* drops to a low logic level for one clock cycle, to thereby indicate that the lowest count was reached. The negative pulse 99c at the TC output of counter 71e, which is connected to the Parallel Load input PL of counter 71f, causes the instant data at the outputs of memory 76 to be loaded into counter 71f. The data at memory 76 represent the portion of red color; the portion of green color is complementary. The rising edge of the TC pulse 99c triggers flip-flop 73 into its set condition wherein its output Q rises to a high logic level.

The counter 71f will count down, from the loaded value, until it reaches zero count, at which moment its TC output drops to a low logic level. The negative pulse at the TC output of counter 71f, which is connected to Clear Direct input CD of flip-flop 73, causes the latter to be reset and to remain in its reset condition until it is set again at the beginning of the next 256-count cycle. It is thus obvious that the Q output of flip-flop 73 is at a high logic level for a period of time proportional to the data initially loaded into counter 71f. The complementary output $\overline{Q}$ is at a high logic level for a complementary period of time.

The Q and $\overline{Q}$ outputs of flip-flop 73 are connected to red bus 5 and green bus 6, respectively, via suitable buffers 63a and 63b, shown in detail in FIG. 7, to respectively energize red bus 5 and green bus 6 for variable time periods, depending on the data stored in memory 76.

By referring now, more particularly, to the timing diagram shown in FIG. 18, in which the waveforms are compressed to facilitate the illustration, the EXAMPLE 1 considers the memory data 'FD', in a standard hexadecimal notation, to generate light of substantially red color. At the beginning of the counter cycle, pulse 99c loads data 'FD' into counter 71f. Simultaneously, flip-flop 73 is set by the rising edge of pulse 99c. The counter 71f will be thereafter stepped down by clock pulses 99b, until it reaches zero count, 2 clock cycles before the end of the counter cycle. At that instant a short negative pulse 99d is produced at its output TC to reset flip-flop 73, which will remain reset for 2 clock cycles and will be set again by pulse 99c at the beginning of the next counter cycle, which will repeat the process. It is readily apparent that flip-flop 73 was set for 254 clock cycles, or about 99% of the time, and reset for 2 clock cycles, or about 1% of the time. Accordingly, red bus 5 of display element 42 is energized for about 99% of the time, and green bus 6 is energized for the remaining about 1% of the time. As a result, display element 42 illuminates in substantially red color.

The EXAMPLE 2 considers the memory data '02' (HEX) to generate light of substantially green color. At the beginning of the counter cycle, data '02' are loaded into counter 71f, and, simultaneously, flip-flop 73 is set. The counter 71f will count down and will reach zero count after 2 clock cycles. At that instant it produces at its output TC a negative pulse 99e to reset flip-flop 73. It is readily apparent that flip-flop 73 was set for 2 clock cycles, or about 1% of the time, and reset for 254 clock cycles, or about 99% of the time. Accordingly, red bus 5 of display element 42 is energized for about 1% of the time, and green bus 6 is energized for the remaining about 99% of the time. As a result, display element 42 illuminates in substantially green color.

The EXAMPLE 3 considers the memory data '80' (HEX) to generate light of substantially yellow color. At the beginning of the counter cycle, data '80' are loaded into counter 71f, and, simultaneously, flip-flop 73 is set. The counter 71f will count down and will reach zero count after 128 clock cycles. At that instant it produces at its output TC a negative pulse 99f to reset flip-flop 73. It is readily apparent that flip-flop 73 was set for 128 clock cycles, or about 50% of the time, and reset for 128 clock cycles, or about 50% of the time. Accordingly, red bus 5 of display element 42 is energized for about 50% of the time, and green bus 6 is energized for the remaining about 50% of the time. As a result of blending substantially equal portions of red and green colors, display element 42 illuminates in substantially yellow color.

Figure 19:
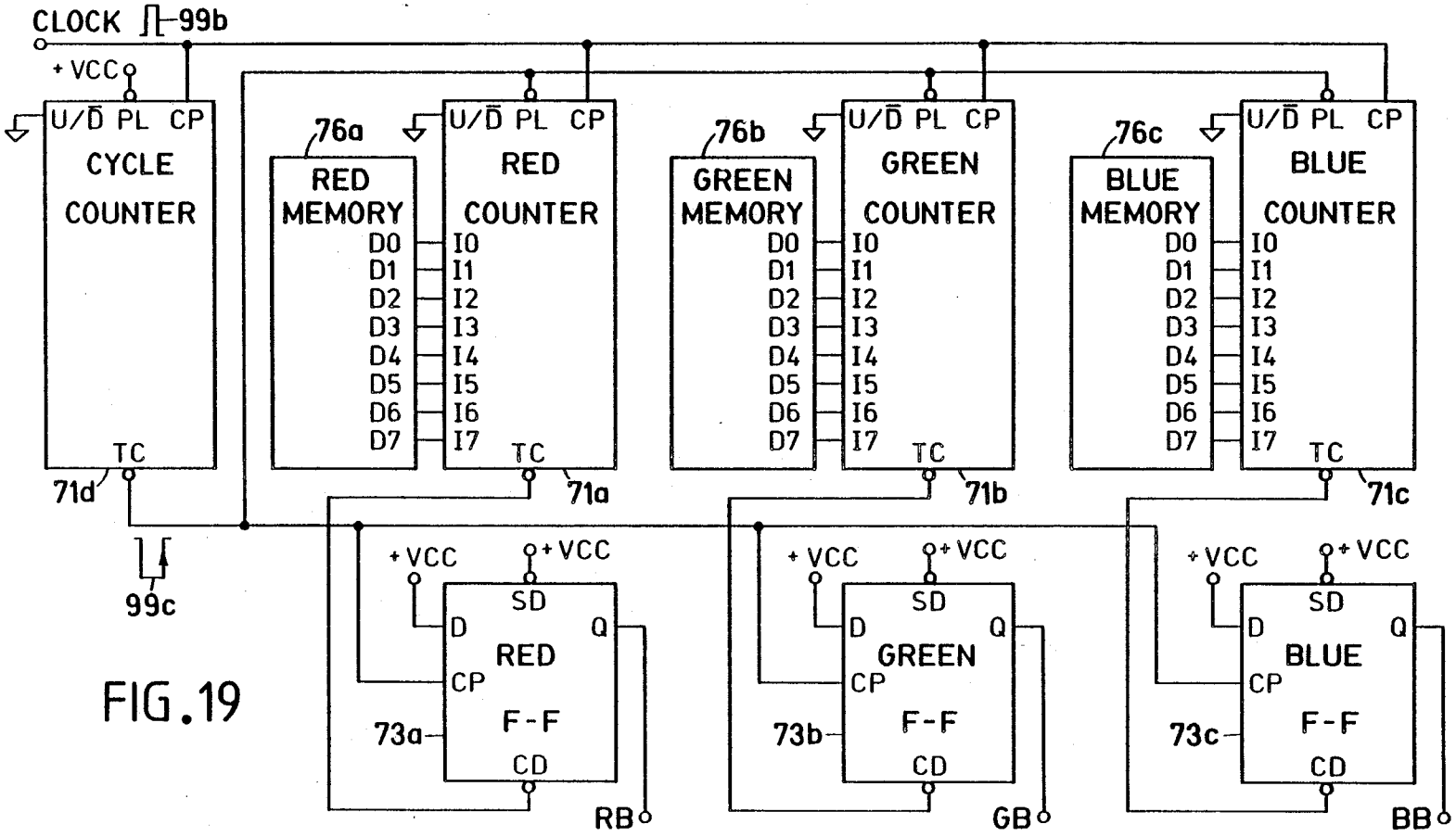
FIG. 19 is a schematic diagram of a memory and color converter combination of FIG. 14.
Figure 20:
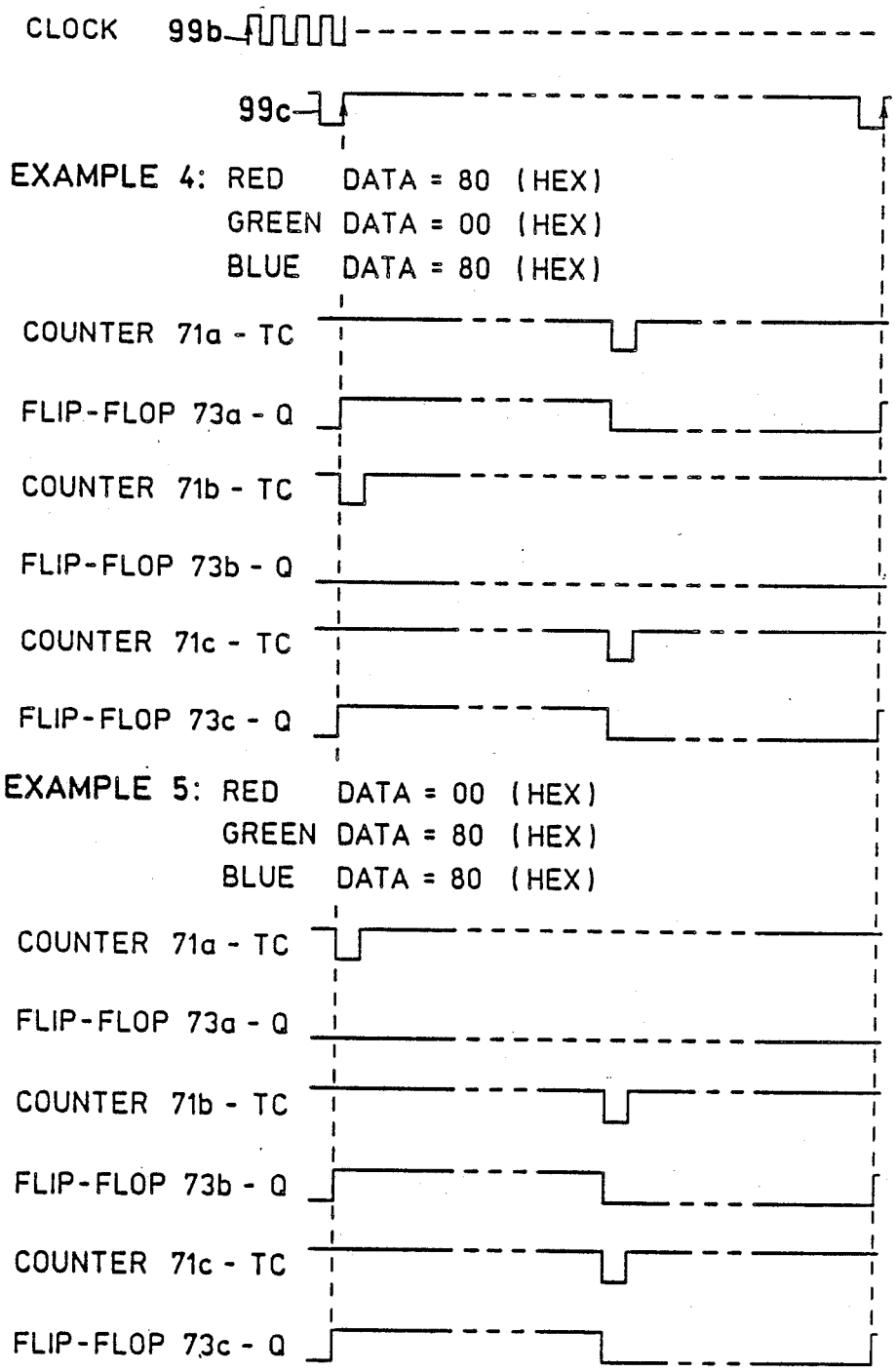
FIG. 20 is a timing diagram of the circuit shown in FIG. 19.
Figure 21:
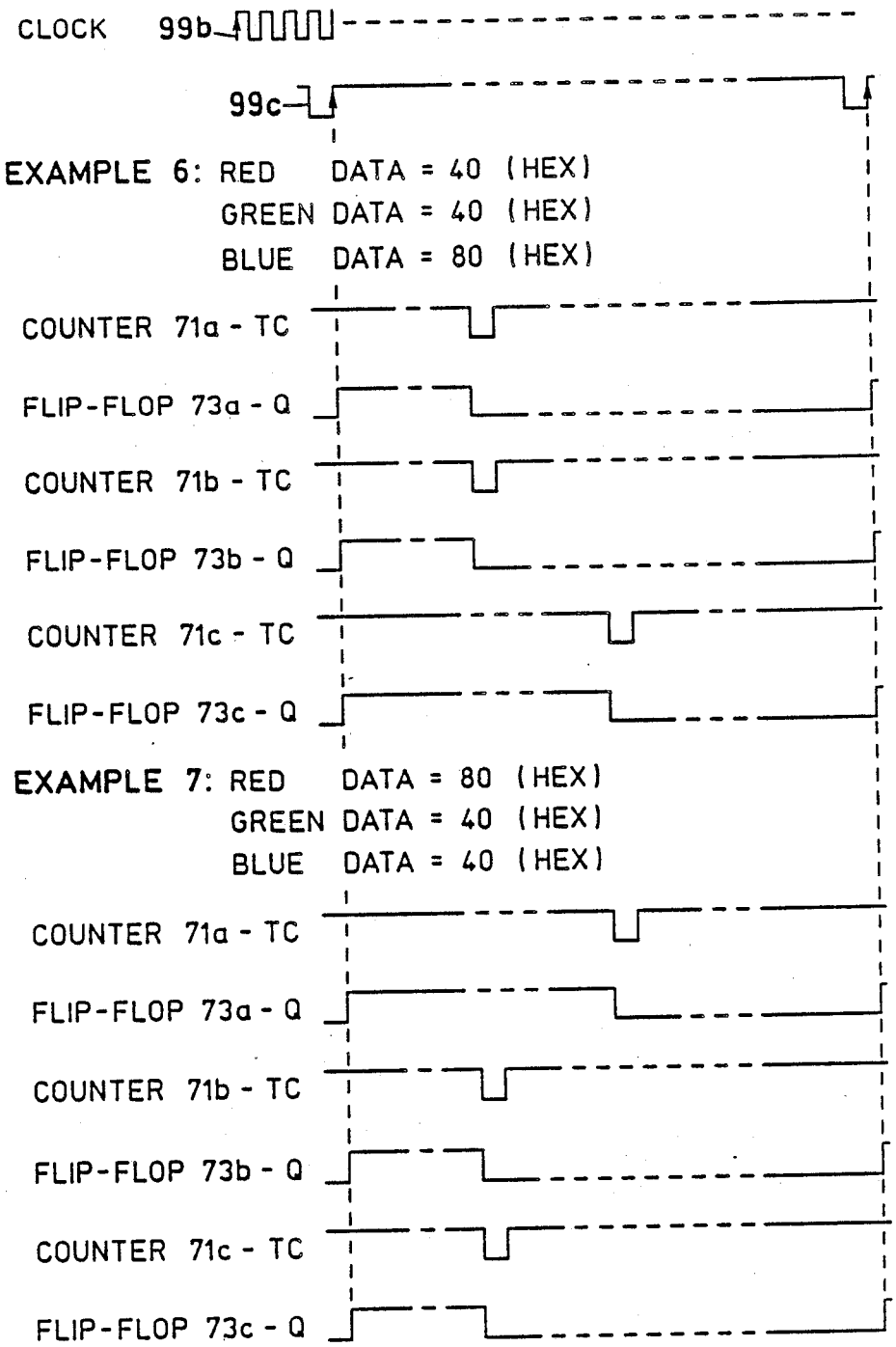
FIG. 21 is a continuation of the timing diagram of FIG. 20.

The description of the schematic diagram of a 3-LED color converter in FIG. 19 should be considered together with its accompanying timing diagrams shown in FIGS. 20 and 21. A clock signal 99b is applied to the CP inputs of counters 71d, 71a, 71b, and 71c to step them down. Every 256 counts a negative pulse 99c is generated at the TC output of counter 71d, to load data into counters 71a, 71b, and 71c from respective memories 76a, 76b, and 76c, and to set flip-flops 73a, 73b, and 73c. The data in red memory 76a represent the portions of red color, the data in green memory 76b represent the portions of green color, and the data in blue memory 76c represent the portions of blue color to be blended.

The counters 71a, 71b, and 71c will count down, from the respective loaded values, until zero counts are reached. When the respective values of the loaded data are different, the length of time of the count-down is different for each counter 71a, 71b, and 71c. When a particular counter 71a, 71b, or 71c reaches zero count, its TC output momentarily drops to a low logic level, to reset its associated flip-flop (red counter 71a resets its red flip-flop 73a, green counter 71b resets its associated green flip-flop 73b, and blue counter 71c resets its associated blue flip-flop 73c). Eventually, all three flip-flops 73a, 73b, and 73c will be reset. The Q outputs of flip-flops 73a, 73b, and 73c are connected to red bus 5, green bus 6, and blue bus 7, respectively, via suitable buffers 62a, 62b, and 62c, as shown in FIG. 8, to respectively energize red bus 5, green bus 6, and blue bus 7 for variable periods of time.

By referring now more particularly to the timing diagram shown in FIGS. 20 and 21, the EXAMPLE 4 considers red memory data '80', green memory data '00', and blue memory data '80', all in hexadecimal notation, to generate light of substantially purple color. At the beginning of the counter cycle, the pulse 99c simultaneously loads data '80' from red memory 76a into red counter 71a, data '00' from green memory 76b into green counter 71b, and data '80' from blue memory 76c into blue counter 71c. The counters 71a, 71b, and 71c will be thereafter stepped down. The red counter 71a will reach its zero count after 128 clock cycles; green counter 71b will reach its zero count immediately; blue counter 71c will reach its zero count after 128 clock cycles.

It is readily apparent that red flip-flop 73a was set for 128 clock cycles, or about 50% of the time, green flip-flop 73b was never set, and blue flip-flop 73c was set for 128 clock cycles, or about 50% of the time. Accordingly, red bus 5 of display element 43 is energized for about 50% of the time, green bus 6 is never energized, and blue bus 7 is energized for about 50% of the time. As a result of blending substantially equal portions of red and blue colors, display element 43 illuminates in substantially purple color.

The EXAMPLE 5 considers red memory data '00', green memory data '80', and blue memory data '80', to generate light of substantially blue-green color. At the beginning of the counter cycle, data '00' are loaded into red counter 71a, data '80' are loaded into green counter 71b, and data '80' are loaded into blue counter 71c. The red counter 71a will reach its zero count immediately, green counter 71b will reach its zero count after 128 clock periods, and so will blue counter 71c.

The red flip-flop 73a was never set, green flip-flop 73b was set for 128 clock pulses, or about 50% of the time, and so was blue flip-flop 73c. Accordingly, green bus 6 of display element 43 is energized for about 50% of the time, and so is blue bus 7. As a result, display element 43 illuminates in substantially blue-green color.

The EXAMPLE 6 considers red memory data '40', green memory data '40', and blue memory data '80', to generate light of substantially cyan color. At the beginning of the counter cycle, the data '40' are loaded into red counter 71a, data '40' are loaded into green counter 71b, and data '80' are loaded into blue counter 71c. The red counter 71a will reach its zero count after 64 clock cycles, and so will green counter 71b. The blue counter 71c will reach its zero count after 128 clock cycles.

The red flip-flop 73a was set for 64 clock cycles, or about 25% of the time, and so was green flip-flop 73b. The blue flip-flop 73c was set for 128 clock cycles, or about 50% of the time. Accordingly, red bus 5 and green bus 6 of display element 43 are energized for about 25% of the time, and blue bus 7 is energized for about 50% of the time. As a result of blending about 50% of blue color, 25% of red color, and 25% of green color, display element 43 illuminates in substantially cyan color.

The EXAMPLE 7 considers red memory data '80', green memory data '40', and blue memory data '40', to generate light of substantially magenta color. At the beginning of the counter cycle, the data '80' are loaded into red counter 71a, data '40' are loaded into green counter 71b, and data '40' are loaded into blue counter 71c. The red counter 71a will reach its zero count after 128 clock cycles, green counter 71b will reach its zero count after 64 clock cycles, and so will blue counter 71c.

The red flip-flop 73a was set for 128 clock cycles, or about 50% of the time, green flip-flop 73b and blue flip-flop 73c were set for 64 clock cycles, or about 25% of the time. Accordingly, red bus 5 of display element 43 is energized for about 50% of the time, green bus 6 and blue bus 7 are energized for about 25% of the time. As a result, display element 43 illuminates in substantially magenta color.

Figure 22:
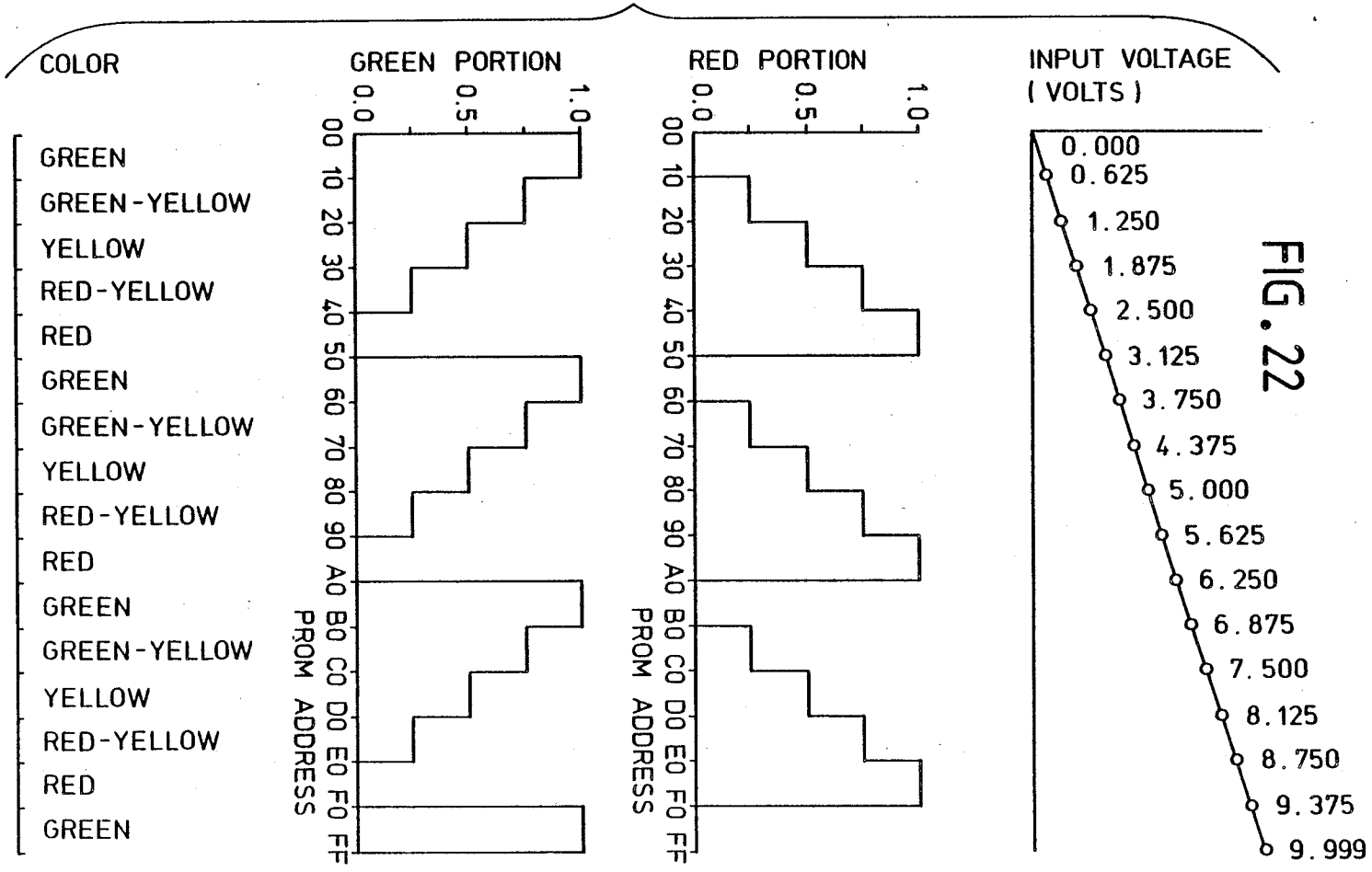
FIG. 22 is a graphic representation of TABLE 1.
Figure 23:
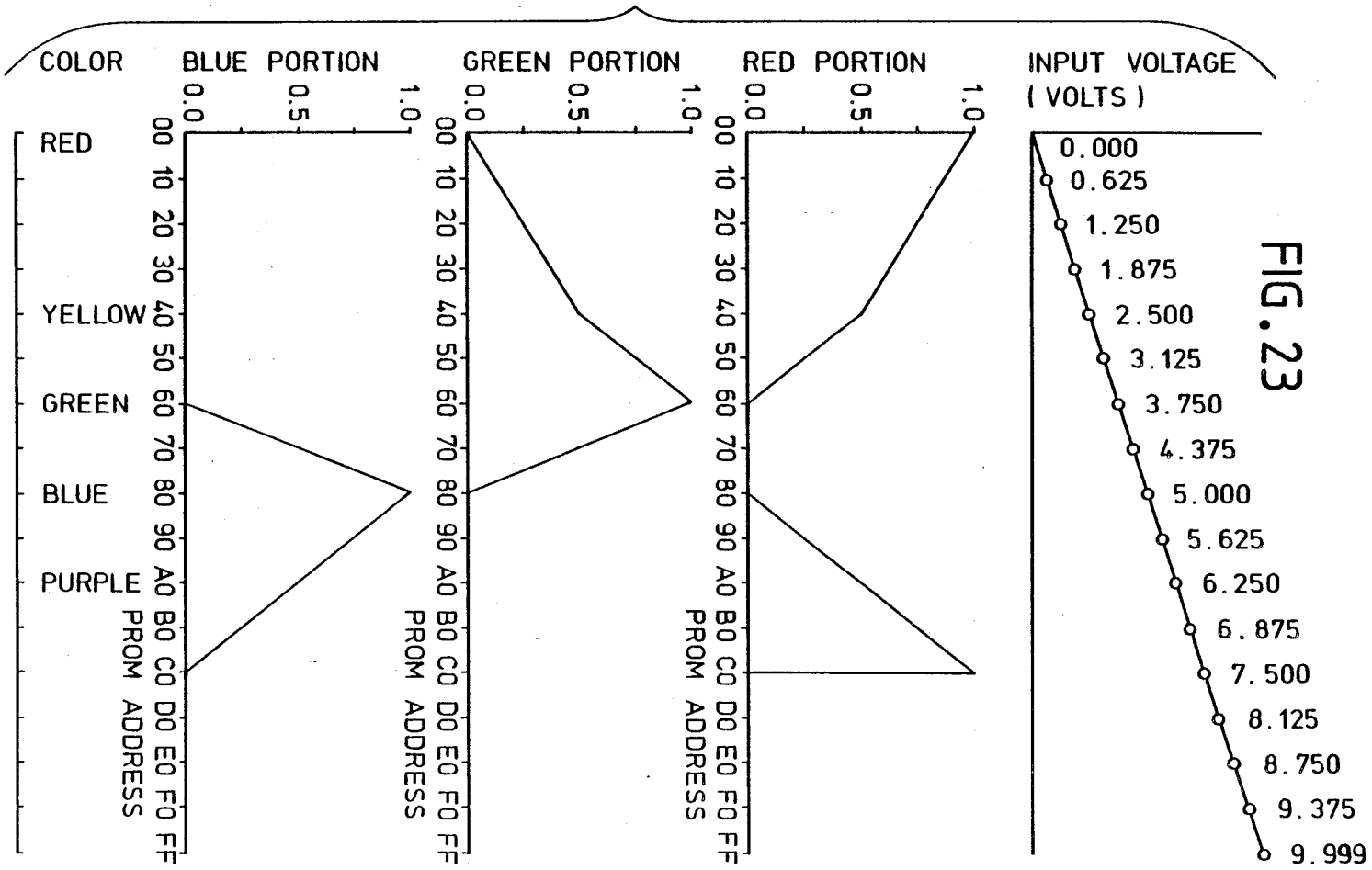
FIG. 23 is a graphic representation of TABLE 2.

By referring now more particularly to FIGS. 22 and 23, which are graphic representations of TABLES 1 and 2, respectively, the data at each memory address are digital representation of the portion of the particular primary color. All examples consider an 8-bit wide PROM (Programmable Read Only Memory). However, the principles of the invention could be applied to other types of memories.

In FIG. 22, RED PORTION indicates the portion of red primary color; GREEN PORTION indicates the portion of green primary color. The RED PORTION for a particular memory address was calculated by dividing the actual value of data residing at that address by the maximum possible data 'FF' (HEX). The GREEN PORTION for the same memory address is complementary; it was obtained by subtracting the calculated value of the RED PORTION from number 1.0.

In FIG. 22 is shown the characteristic of a 2-primary color converter, defined in TABLE 1, for developing color variable in steps: pure green for input voltages less than 0.625 V, substantially yellow for voltages between 1.25 V and 1.875 V, pure red for voltages between 2.5 V and 3.125 V, and of intermediate colors therebetween, this sequence being repeated three times over the voltage range.

In FIG. 23, RED PORTION indicates the portion of red primary color; GREEN PORTION indicates the portion of green primary color; BLUE PORTION indicates the portion of blue primary color. The RED PORTION for a particular memory address was calculated by dividing the value of red data residing at such address by the maximum possible data 'FF' (HEX). Similarly, the GREEN PORTION for that memory address was obtained by dividing the value of green data by 'FF' (HEX). The BLUE PORTION was obtained by dividing the value of blue data by 'FF' (HEX).

In FIG. 23 is shown the characteristic of a 3-primary color converter, defined in TABLE 2, for developing color continuously variable from pure red, through substantially orange and yellow, pure green, pure blue, to substantially purple, in a rainbow-like fashion.

In the examples of the characteristics of color converters shown in TABLE 1 and TABLE 2, the data values stored in red memory 76a, green memory 76b, and blue memory 76c are so designed that the sums of the red data, green data, and blue data are constant for all memory addresses, to provide uniform light intensities for all colors. It is further contemplated that data stored in red memory 76a, green memory 76b, and blue memory 76c may be modified in order to compensate for different efficiencies of red, green, and blue LEDs. By way of an example, data values for a low efficiency LED may be proportionally incremented such that time of energization is proportionally increased, to effectively provide equal luminances for LEDs of unequal efficiencies.

Figure 24:
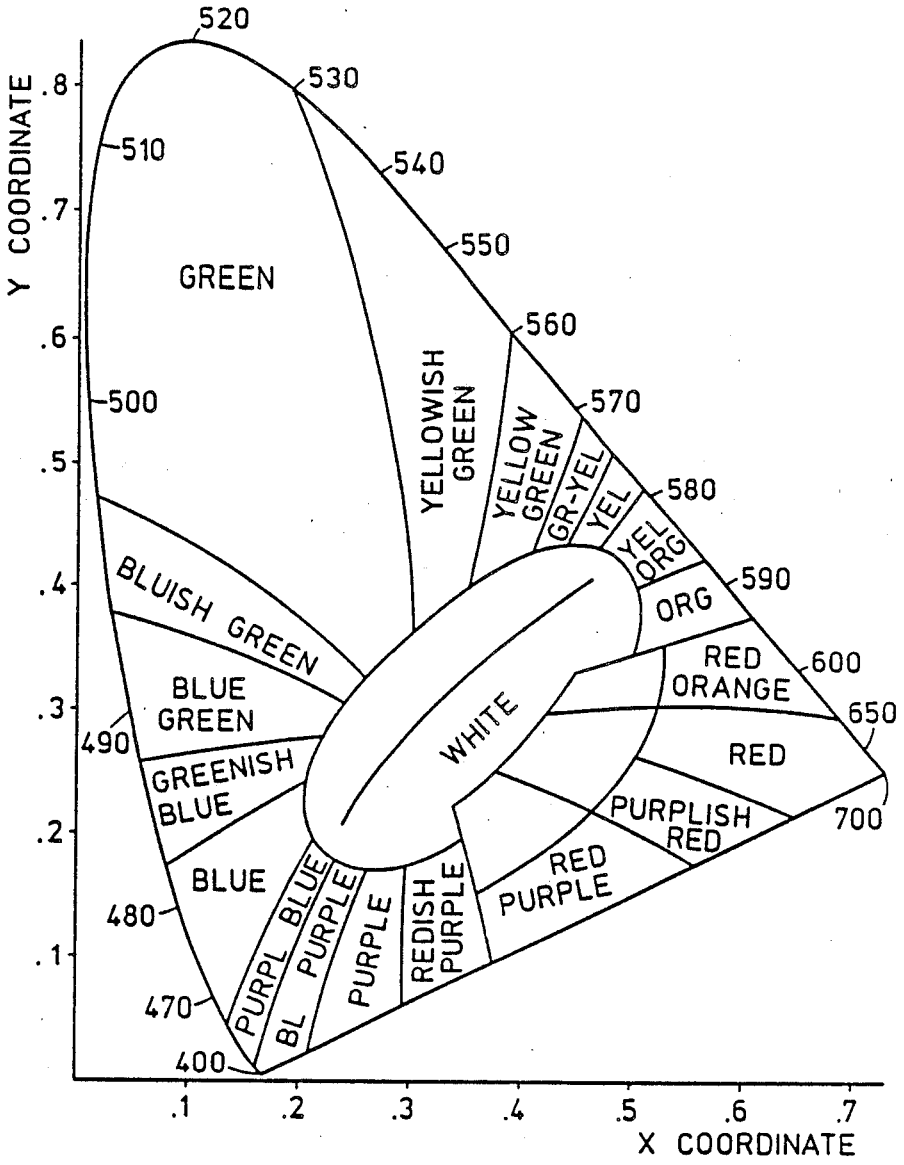
FIG. 24 is a graph of the ICI chromaticity diagram.

With reference to FIG. 24 there is shown the ICI (International Committee on Illumination) chromaticity diagram designed to specify a particular color in terms of x and y coordinates. Pure colors are located along the horseshoe-like periphery. Reference numbers along the periphery indicate wavelength in nanometers. When relative portions of three primary colors are known, the color of light produced by blending their emissions can be determined by examining the x and y values of ICI coordinates.

TYPEWRITER

Figure 25:
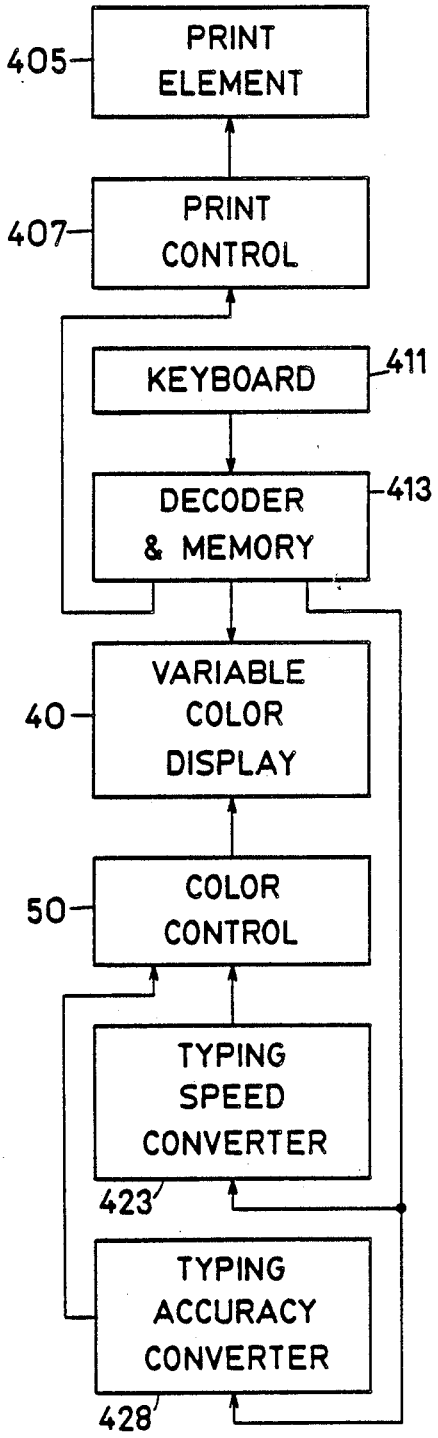
FIG. 25 is a general block diagram of a variable color display typewriter wherein the color of the display is variable in accordance with the typing speed.

Turning now to FIG. 25, the variable color display typewriter of this invention includes a keyboard 411 having a plurality of keys adapted for actuation, decoder and memory 413, for interrogating keyboard 411 to detect actuated keys and for developing and storing codes corresponding to the actuated keys, print control 407, for activating a print element 405 to effect the printing of a character associated with the actuated key, and variable color display 40, for visually presenting the typed characters. The invention resides in the addition of a color control 50 for controlling the color of display 40 in accordance with output signals developed by a typing speed converter 423 and a typing accuracy converter 428. Such typewriter will visually present typed text in a color variable in accordance with both typing speed and typing accuracy.

Figure 26:
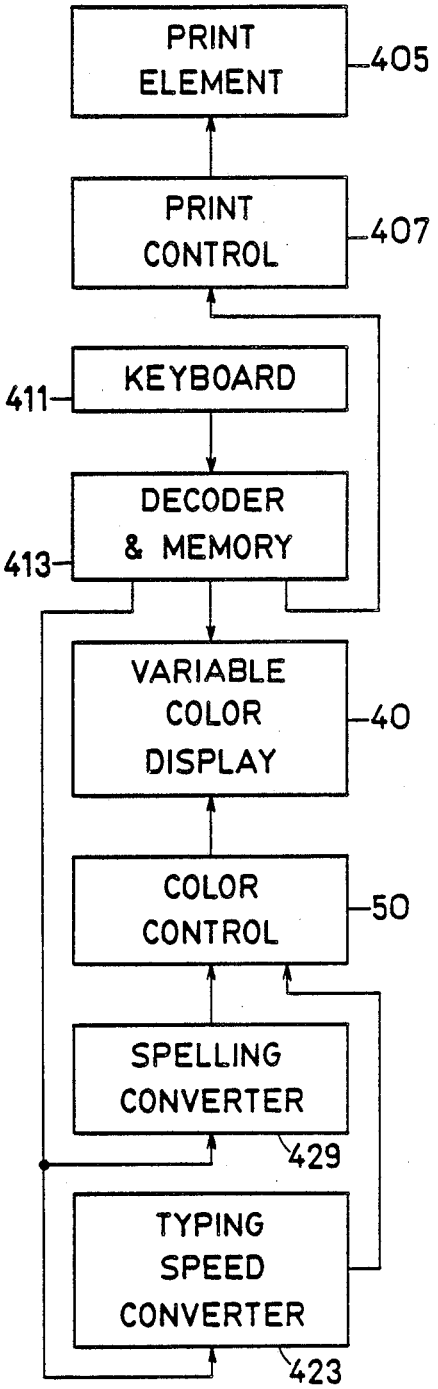
FIG. 26 is a general block diagram of a variable color display typewriter wherein the color of the display is variable in accordance with the typing accuracy.

In FIG. 26 is shown a like typewriter, characterized by a typing speed converter 423 and a spelling converter 429, which will visually present typed text in a color variable in accordance with both typing speed and correct spelling of typed words.

Figure 27:
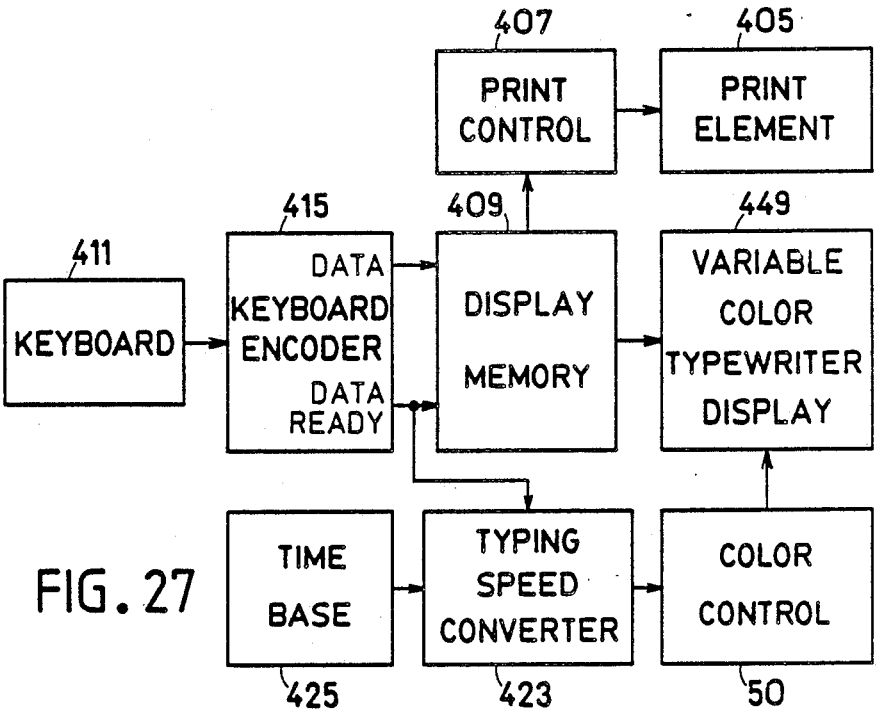
FIG. 27 is an expanded block diagram of a variable color display typewriter shown in FIG. 25.

The preferred embodiment of the invention is illustrated in FIG. 27 in a block diagram configuration so as not to obscure the invention by unnecessary details. As keyboard 411, keyboard encoder 415, display memory 409, print control 407, and print element 405 may be substantially conventional, their operation will not be described in detail. The invention resides in the addition of typing speed converter 423 and associated circuitry for measuring the typing speed and for controlling the color of typewriter display 449 accordingly. When a particular key of keyboard 411 is actuated, keyboard encoder 415 develops at its DATA outputs a code corresponding to the actuated key and at its DATA READY output a positive going pulse indicating that the code is valid. When another key is actuated, new code appears at the DATA outputs and another pulse is produced at the DATA READY output. The typing speed converter 423 counts the DATA READY pulses during predetermined time intervals defined by a time base 425. The characters typed into display memory 409 may be visually presented on typewriter display 449 in a substantially conventional manner (not shown).

Figure 28:
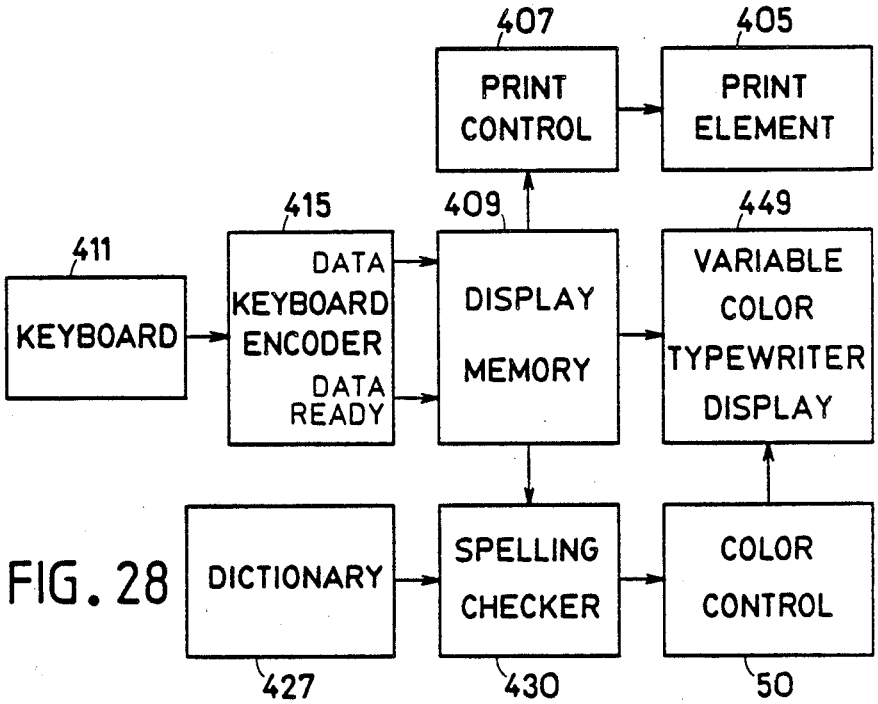
FIG. 28 is an expanded block diagram of a variable color display typewriter shown in FIG. 26.

FIG. 28 is a block diagram of a similar circuit characterized by a spelling checker 430 with associated dictionary 427 of words for checking typed text for accuracy. The typed text will be visually presented on typewriter display 449 in a color variable in accordance with the typing accuracy.

The typing speed converter 423 illustrated in FIG. 29 includes a counter 450 responsive to pulses that appear at the DATA READY output of keyboard encoder 415, an oscillator 455 for furnishing a periodic sequence of clock pulses of a predetermined frequency, counter control 437 for starting and stopping counter 450 such that its accumulated count is proportional to the instant typing speed, as will be more fully explained later, color control latch 435 for assuming, when enabled, the count accumulated in counter 450, and step variable color control 51 for developing color control signals accordingly.

Figure 29:
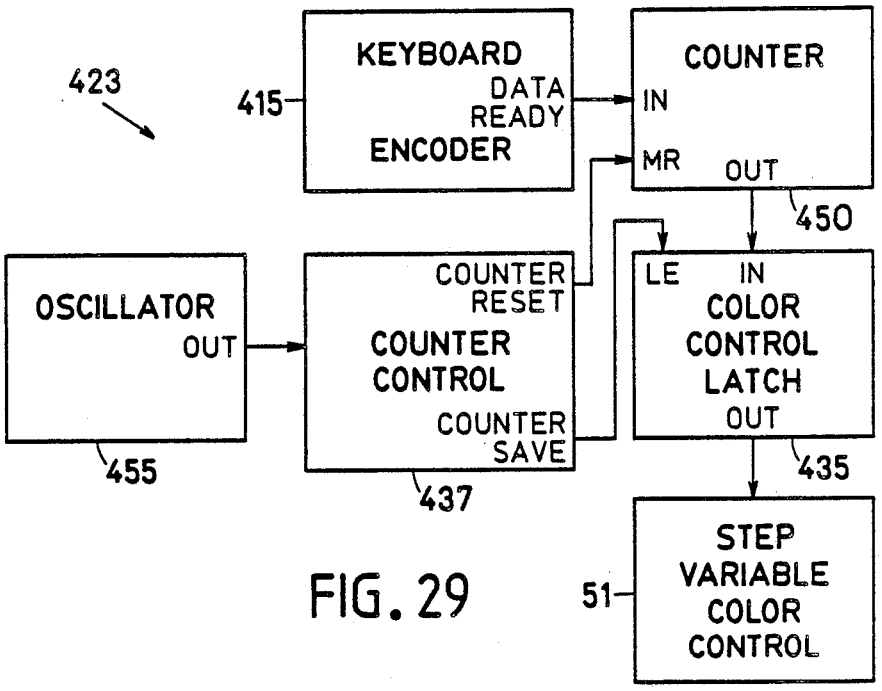
FIG. 29 is an expanded diagram of a typing speed converter for controlling the color of the typewriter display in steps.
Figure 30:
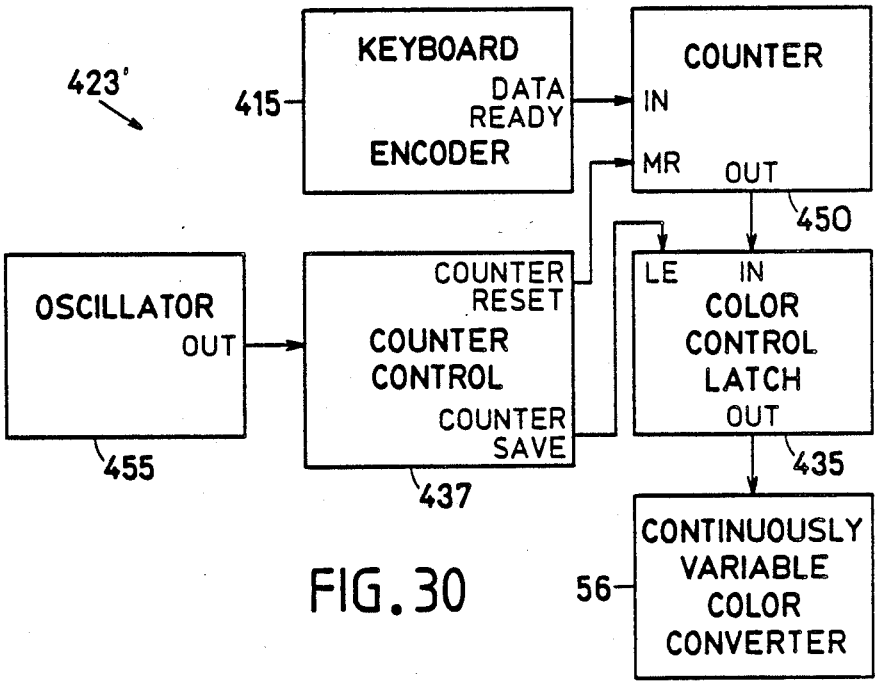
FIG. 30 is an expanded diagram of a like typing speed converter for controlling the color of the typewriter display continuously.

A like typing speed converter 423' shown in FIG. 30 differs from the one in FIG. 29 in that a continuously variable color converter 56 is used in lieu of step variable color control 51. When counter 450 completes its counting cycle, its output data are intermediately stored in color control latch 435 and thence applied to the input of color converter 56 for developing color bus driving signals accordingly.

Figure 31:
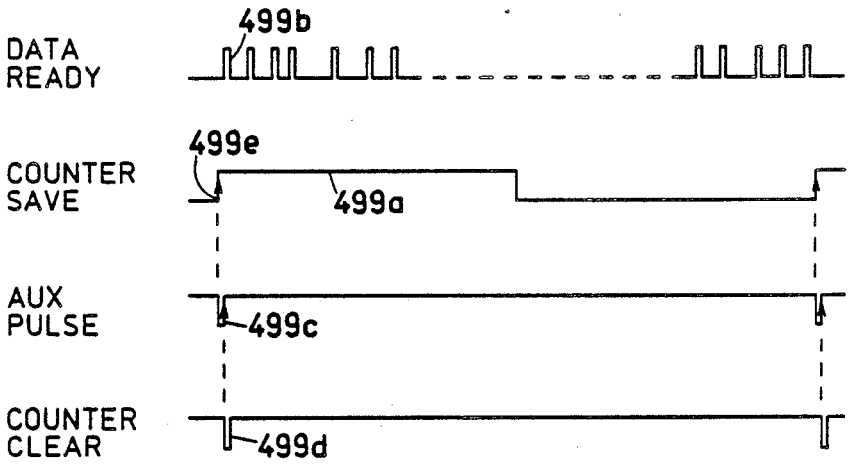
FIG. 31 is a timing diagram showing the relationship between the measured typing speed and generated COUNTER SAVE and COUNTER CLEAR signals.

By referring now to the timing diagram shown in FIG. 31, the typing speed measuring method may be briefly explained. In essence, the number of pulses **499*b* that appear at the DATA READY output of keyboard encoder 415 is counted during predetermined time intervals defined by adjacent COUNTER SAVE positive going edges 499*e* of stable clock pulses 499*a*, and the instant typing speed is calculated therefrom. The COUNTER SAVE edge 499*e* is also used to trigger a negative AUX PULSE 499*c* of a short duration, which in turn is used to trigger a short negative COUNTER CLEAR pulse 499*d*. In practice, the COUNTER SAVE edge 499*e* is used to effect the transfer of the instant count of counter 451, representing the number of typed characters during the measurement interval, to its output register, viewed in FIG. 32. Immediately after that, counter 451 will be restored to its initial condition by COUNTER CLEAR pulse 499*d* and will start accumulating pulses 499*b*** again to repeat the measurement. The instant typing speed may be calculated by multiplying the accumulated count by the clock frequency, to obtain the number of typed characters per second, and then by 12 (60 divided by 5), to obtain the number of 5-letter words per minute, in accordance with the official typing rules. It would be appreciated by persons skilled in the art that the principles of the invention are also applicable to other methods of typing speed measurement.

Figure 32:
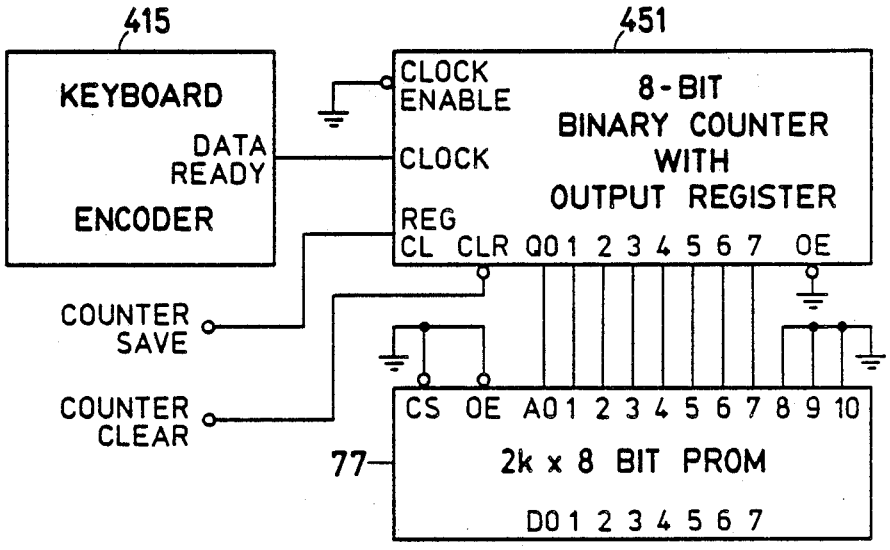
FIG. 32 is a detail of the combination of the counter shown generally in FIG. 30 with a memory for 2-primary color converter.

FIG. 32 is a detail of the combination of 8-bit binary counter with output register 451 and PROM 77. The counter 451 may be from time to time reset to its zero count by applying a short negative COUNTER CLEAR pulse to its Clear input CLR. When not in its reset condition, counter 451 is incremented by pulses **499*b* that appear at the DATA READY output of keyboard encoder 415. When the COUNTER SAVE signal appears at the Register Clock input REG CL of counter 451, the instant accumulated count data are transferred to its output register and appear at the outputs Q0 to Q7, which are directly connected to respective address inputs A0 to A7 of memory 77 which contains data representing the portions of red color for all possible output data of counter 451. The memory data residing at the address selected by the instant output data of counter 451 will appear at the memory outputs D0 to D7, which may be connected as shown in the detail in FIG. 17 to develop bus control signals RB and GB, which may be applied to like inputs shown in FIG. 47, to cause typewriter display 449*c*** to illuminate in a specific color.

Figure 33:
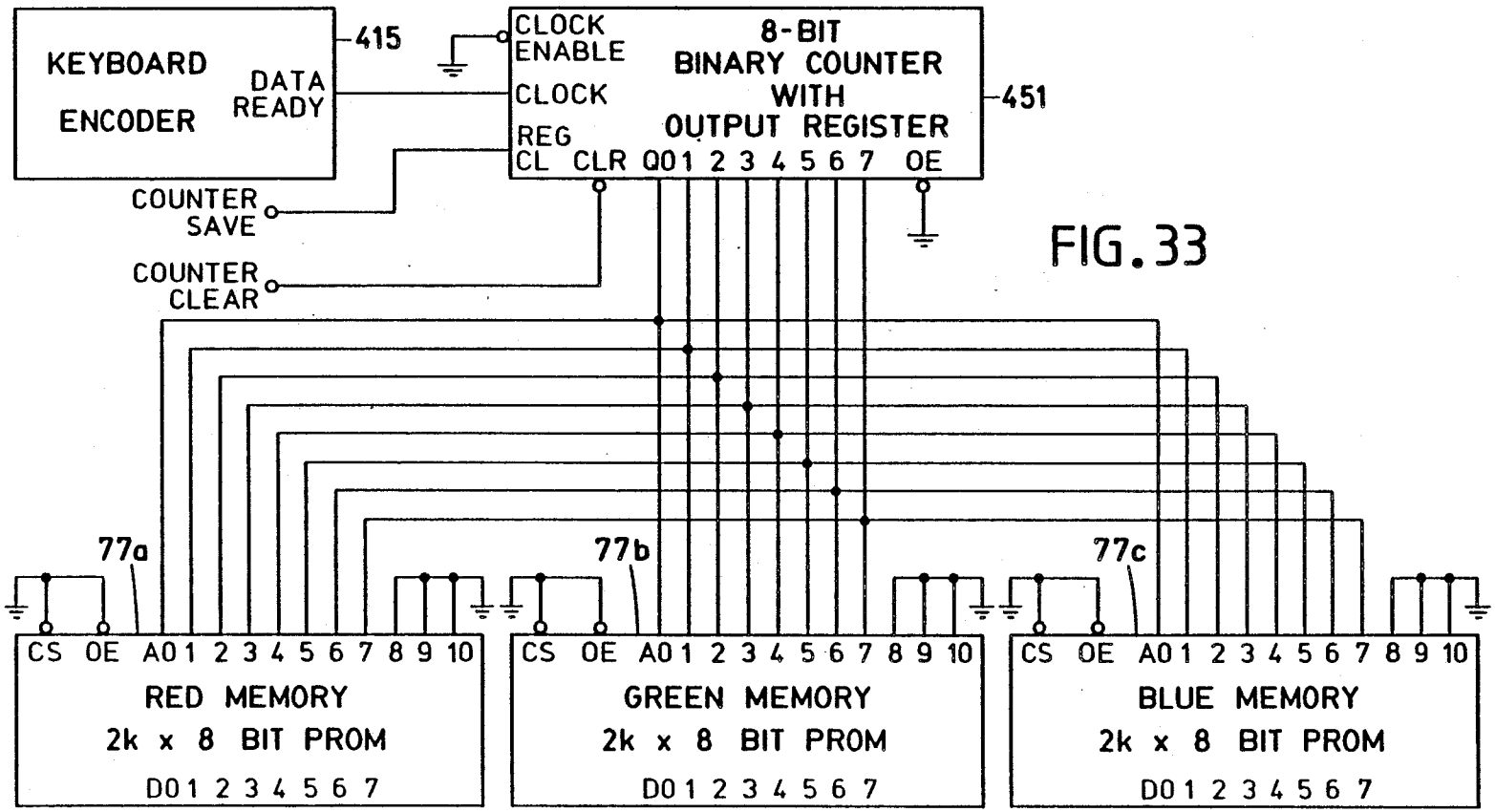
FIG. 33 is a detail of the combination of the counter shown generally in FIG. 30 with a memory for 3-primary color converter.

In FIG. 33 is shown a similar schematic diagram of the combination of 8-bit binary counter with output register 451 with red memory **77*a*, green memory 77*b*, and blue memory 77*c*. The outputs Q0 to Q7 of counter 451 are respectively connected to interconnected address inputs A0 to A7 of red memory 77*a*, green memory 77*b*, and blue memory 77*c*. When the instant output data of counter 451 are applied to the address inputs of memories 77*a*, 77*b*, and 77*c*, the memory data residing at such address in memory 77*a*, representing the portion of red primary color, appear at its memory outputs D0 to D7, memory data residing at the same address in memory 77*b*, representing the portion of green primary color, appear at its memory outputs D0 to D7, and memory data residing at the same address in memory 77*c*, representing the portion of blue primary color, appear at its memory outputs D0 to D7. The memory outputs of the three memories 77*a*, 77*b*, and 77*c* may be connected as shown in the detail in FIG. 19, to develop bus control signals RB, GB, and BB, which may be applied to like inputs shown in FIG. 48, to cause typewriter display 449*d*** to illuminate in a specific color.

Figure 34:
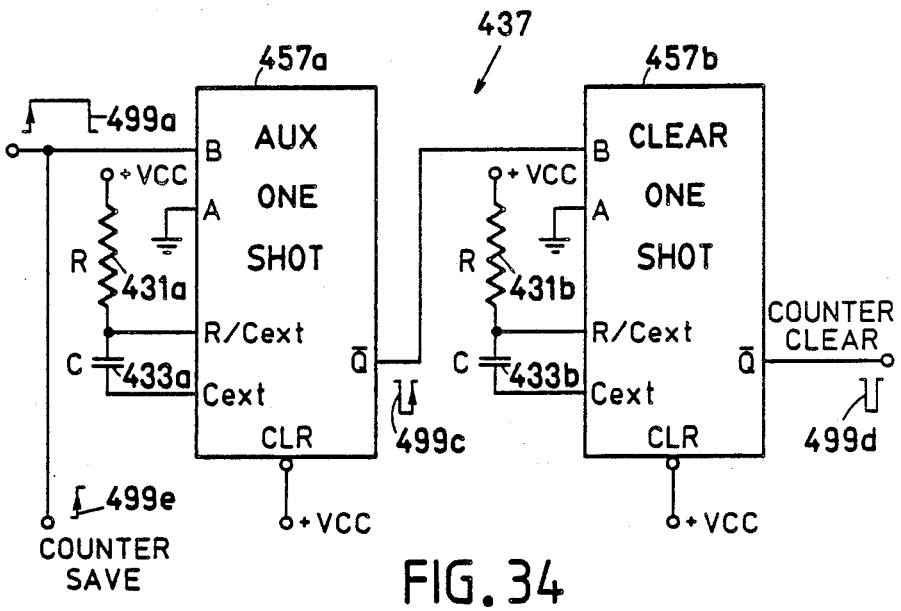
FIG. 34 is a schematic diagram of a circuit for generating COUNTER SAVE and COUNTER CLEAR signals.

FIG. 34 is a detail of counter control 437, shown generally in FIGS. 29 and 30, for controlling counter 451. The description of the circuit should be considered together with its associated timing diagram viewed in FIG. 31. The leading positive going edge of clock pulse **499*a* is used as COUNTER SAVE signal 499*e*, to transfer the instant data in counter 451, which represent the typing speed for the previous measurement interval, to its output register, viewed in FIG. 32, for storing them until new data are available. The clock pulse 499*a* is applied to the B input of AUX ONE SHOT 457*a* to produce at its complementary output $\overline{Q}$ a negative AUX PULSE 499*c* of a short duration, determined by the values of a resistor 431*a* and capacitor 433*a***. The pulse 499*c* will trigger, by its trailing edge, CLEAR ONE SHOT 457*b*, which will produce at its complementary output $\overline{Q}$ a short negative COUNTER CLEAR pulse 499*d*, of a width determined by the values of a resistor 431*b* and capacitor 433*b*, for resetting counter 451 immediately after its contents were stored in its output register.

Figure 35:
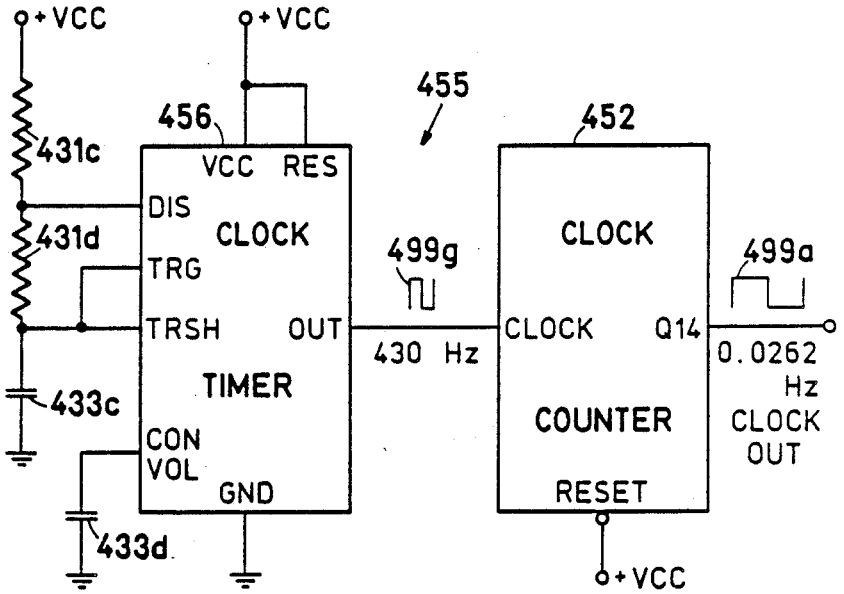
FIG. 35 is a schematic diagram of an oscillator shown generally in FIGS. 29 and 30.

In FIG. 35 is revealed a schematic diagram of oscillator 455 shown generally in FIGS. 29 and 30. A CLOCK TIMER 456 is used in its astable configuration to generate at its output OUT square wave pulses 499*g* of 430 Hz frequency, determined by the values of resistors 431*c*, 431*d* and capacitors 433*c*, 433*d*. The square wave pulses 499*g* are applied to the CLOCK input of a 14-bit CLOCK COUNTER 452, which divides the frequency by 16,384, to provide at its output Q14 clock pulses 499*a* of 0.0262 Hz frequency and of equal duty cycle that are used in the circuits for typing speed measurements. It would be apparent to those skilled in the art that the inventive concepts may be also applied without the use of specific frequencies. It will be appreciated that the typing speed limits may be different from those shown in the charts and may be selected to accommodate any specific situation.

Figure 45:
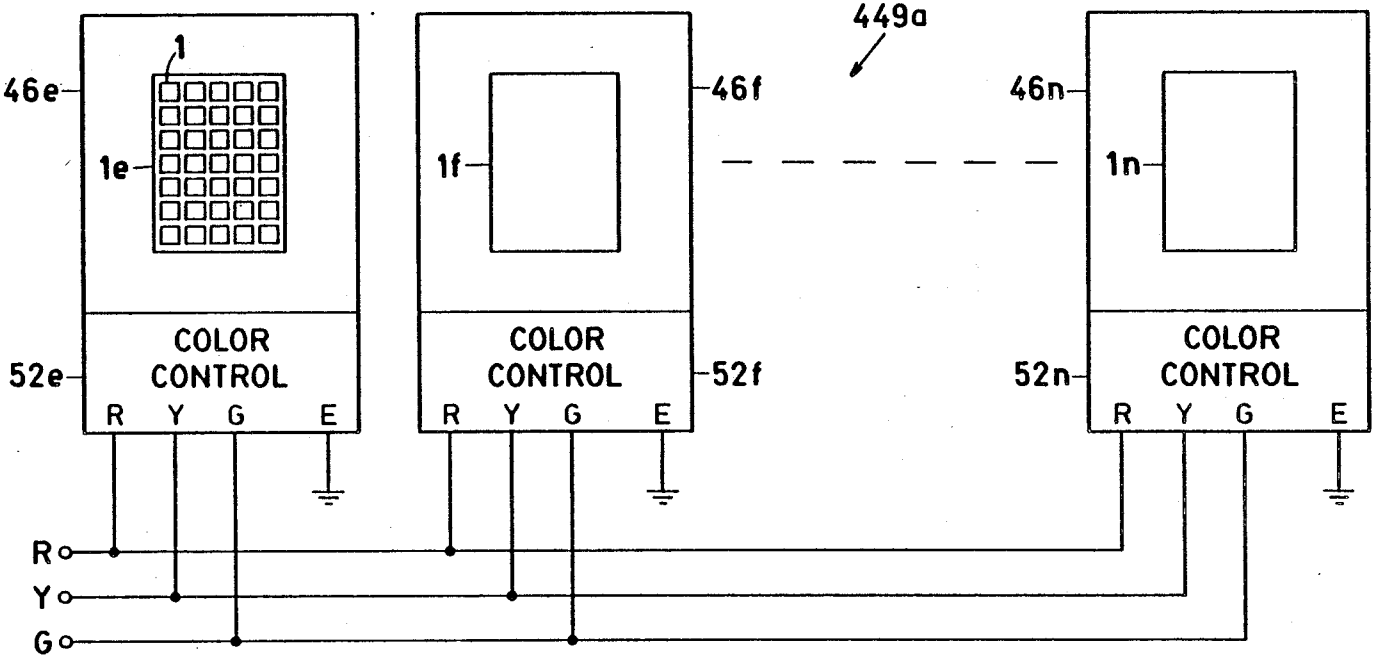
FIG. 45 is a detail of a variable color typewriter display showing the interconnection of three step variable color display elements.

FIG. 36 is a detail of the combination of 8-bit binary counter with output register 451 and 3-to-8 line decoder 454, for generating color control signals to cause typewriter display 449 to illuminate in one of three possible colors in accordance with the accumulated count in the output register of counter 451. The description of the circuit should be considered together with its associated CHART 1. The 8-bit binary counter 451 contains an output register with outputs Q0 to Q7 available. Two most significant outputs Q6 and Q7 are respectively connected to inputs A and B of 3-to-8 line decoder 454; the most significant input C of decoder 454 is grounded. In response to the conditions of the outputs Q6 and Q7 of counter 451, decoder 454 develops output signals Y0, Y1, and Y2. It is readily apparent that the output Y0 rises to a high logic level when both counter outputs Q6 and Q7 are at a low logic level (which is typical for counts less than 64), to generate active color control signal R (red). When the counter output Q6 rises to a high logic level, while the output Q7 is low (which is typical for counts between 64 and 127), the decoder output Y1 rises to a high logic level to generate active color control signal Y (yellow). When the counter output Q7 rises to a high logic level and Q6 drops to a low logic level (which is typical for counts between 128 and 191), the decoder output Y2 rises to a high logic level to generate active color control signal G (green). The decoder outputs Y0 to Y2 may be connected as shown in FIG. 45. The values of the typing speed limits, in words per minute, in CHART 1 were calculated by multiplying particular counts in the left column by constant 0.3144. This constant was obtained by multiplying the clock frequency (0.0262 Hz) by 60, to convert from seconds to minutes, and by dividing the result by 5, to consider 5-letter words per minute. The resulting typing speed limits were rounded for ease of description.

As viewed in CHART 1, the color control causes typewriter display 449 to be illuminated in red color for typing speeds between 0 and 20 words per minute, in yellow color for typing speeds between 21 and 40 words per minute, and in green color for typing speeds between 41 and 60 words per minute. It would be obvious to those skilled in the art, in the view of this disclosure, that other typing speed limits and color combinations may be devised.

Figure 46:
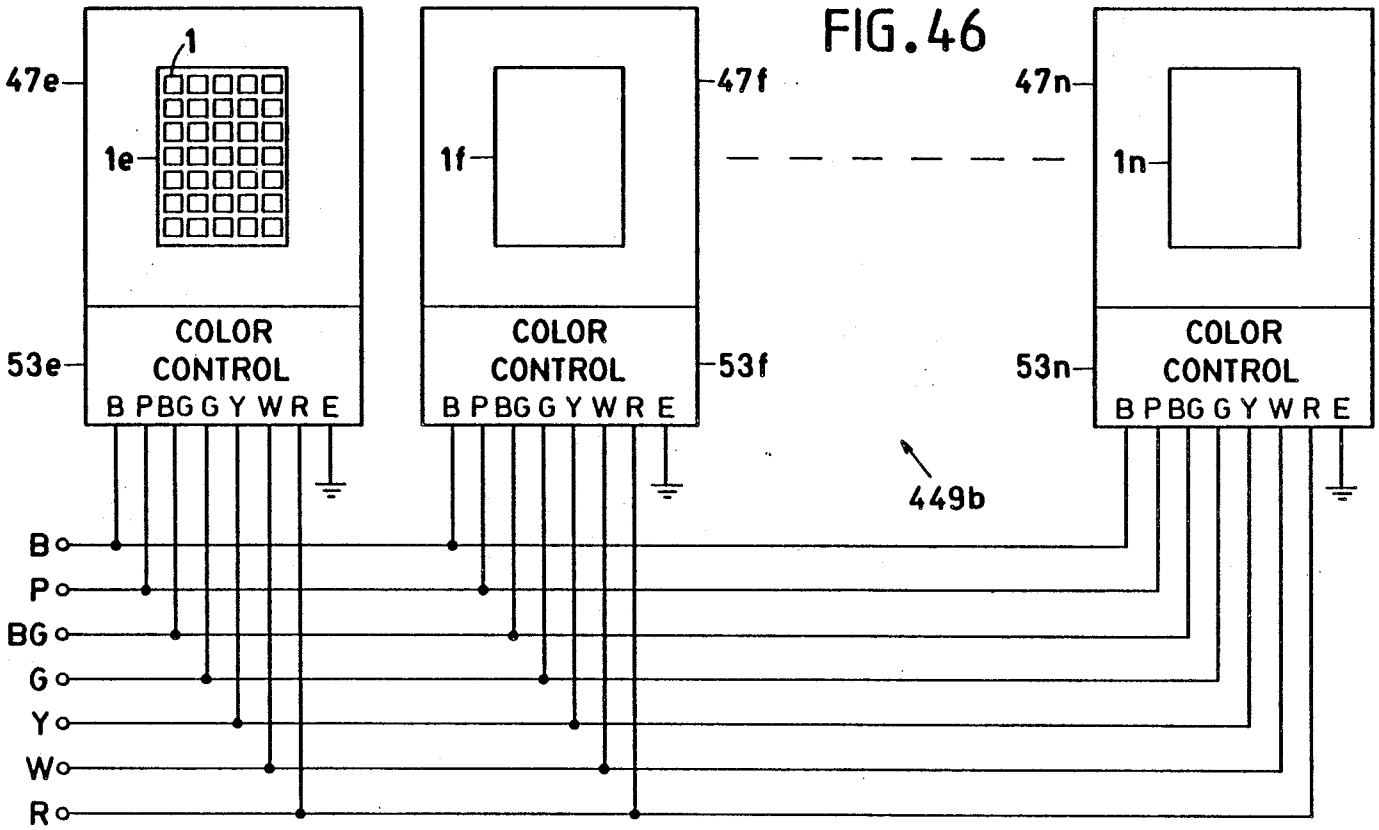
FIG. 46 is a detail of a variable color typewriter display showing the interconnection of seven step variable color display elements.

FIG. 37 is a like detail of the combination of 8-bit binary counter with output register 451 and 3-to-8 line decoder 454, for generating color control signals to cause typewriter display 449 to illuminate in one of seven possible colors, depending on the accumulated count in the output register of counter 451. The associated chart is CHART 2. This circuit differs from the one in FIG. 36 in that three counter outputs Q5, Q6, and Q7 are connected to respective inputs A, B, and C of decoder 454, to develop color control signals R, W, Y, G, BG, P, and B at respective decoder outputs Y0 to Y7. When all counter outputs Q5, Q6, and Q7 are at a low logic level (which is typical for counts between 0 and 31), the decoder output Y0 rises to a high logic level. When the counter output Q5 is at a high logic level and Q6, Q7 are at a low logic level (which is typical for counts between 32 and 63), the decoder output Y1 rises to a high logic level. The Y0 and Y1 signals are combined in a logic fashion by an OR gate 461 to develop active color control signal R (red) for counts between 0 and 63. The remaining color control signals are developed similarly, as shown in CHART 2. The output of OR gate 461 and decoder outputs Y2 to Y7 may be connected as shown in FIG. 46. The values of the typing speed limits in CHART 2 were again calculated by multiplying particular counts in the left column by the constant 0.3144.

As viewed in CHART 2, the color control causes typewriter display 449 to be illuminated in red color for typing speeds between 0 and 20 words per minute, in white color for typing speeds between 21 and 30 words per minute, in yellow color for typing speeds between 31 and 40 words per minute, in green color for typing speeds between 41 and 50 words per minute, in blue-green color for typing speeds between 51 and 60 words per minute, in purple color for typing speeds between 61 and 70 words per minute, and in blue color for typing speeds greater than 70 words per minute. Other typing speed limits and color combinations may be devised by those skilled in the art.

Figure 38:
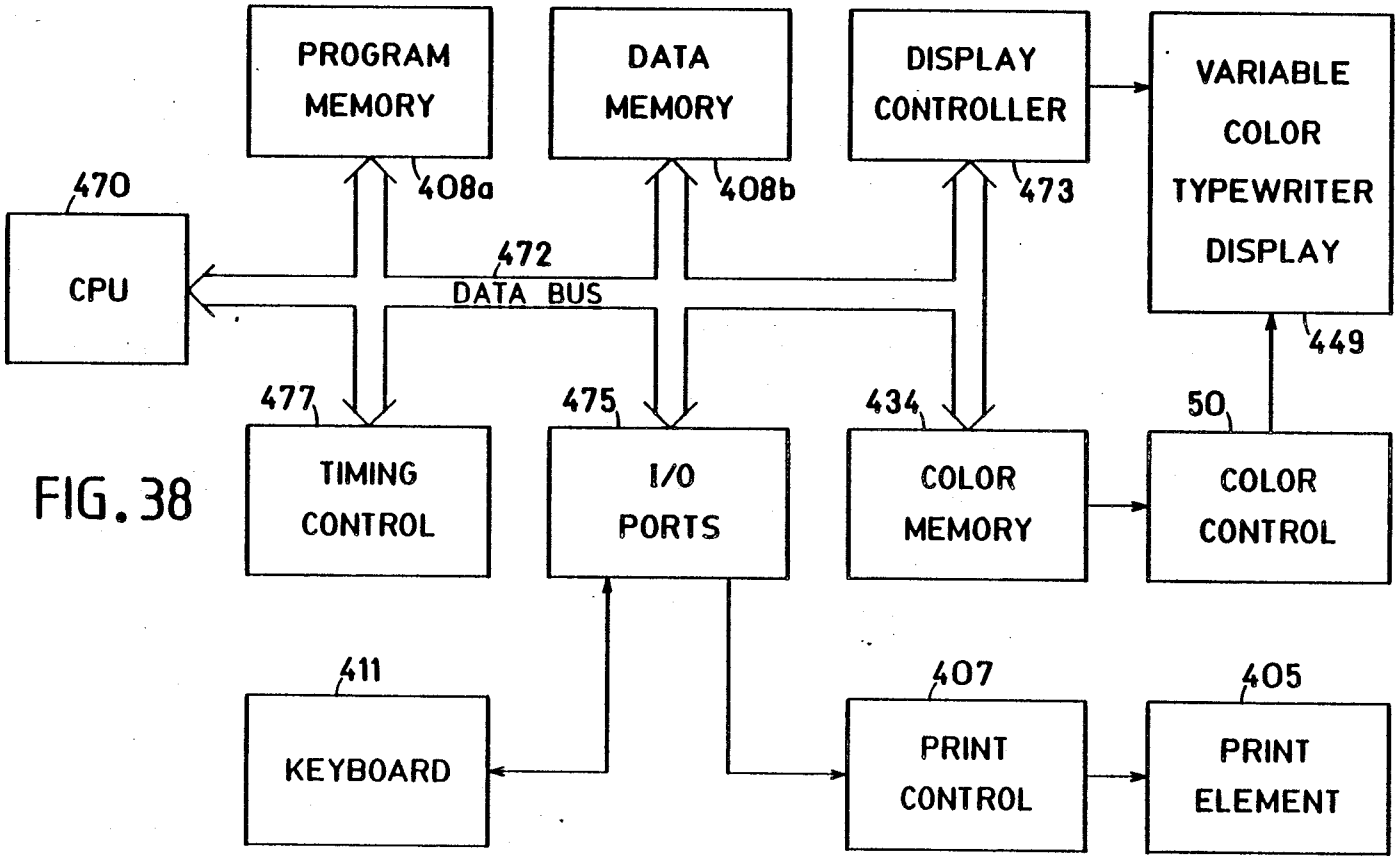
FIG. 38 is a block diagram of a variable color display typewriter controlled by a central processor.

Another embodiment of a variable color display typewriter, disclosed in FIG. 38 in somewhat simplified form, is controlled by a CPU (Central Processing Unit) 470, which may include a microprocessor, microcomputer, or like device for processing a program of instructions. The instructions for controlling CPU 470 and tables of certain codes are stored in a program memory 408*a*. CPU 470 communicates with other devices over a data bus 472 and stores temporary data in a memory 408*b*. The operation of the typewriter will be outlined only briefly, with emphasis on the novel features provided by the invention. CPU 470 scans keyboard 411 in cyclic sequence and reads back data indicative of the activity of keyboard 411. When CPU 470 receives data indicating that a key has been actuated, it stops the scanning process and uses the received data to fetch from program memory 408*a*, which contains the table of codes for all keys, the code for the character corresponding to the actuated key, so it could be displayed and printed. CPU 470 then accesses display controller 473, for causing the character to be displayed on typewriter display 449, and print control 407, via appropriate I/O port 475, for causing the character to be imprinted by print element 405.

The invention resides in the addition of a color memory 434, color control 50, and certain software instructions for measuring typing speed and for controlling the color of typewriter display 449 accordingly. To measure typing speed, CPU 470 repeatedly measures time necessary for typing a group of characters (e.g., 10 characters), by using timing control 477. By referring to associated CHART 3 and CHART 4, it is readily apparent that the values of the typing speed limits, in words per minute, in the third columns were calculated by dividing constant 120 by particular times for 10 characters, in seconds, in the first columns. The constant 120 was obtained by dividing 600 (10 characters multiplied by 60 seconds) by 5 (5 characters per word), to obtain the number of 5-letter words per minute. The values of typing speed limits were rounded in the interest of simplifying the disclosure. It is readily apparent that the principles of the invention are equally applicable to other methods of measuring typing speed.

When the time measurement for the typing of a particular 10 character group is completed, CPU 470 compares the measured value with predetermined time limits, defining a plurality of time ranges, to determine in which time range the measured value lies. In accordance with such determination, CPU 470 then fetches from program memory 408*a*, which contains the table of codes for all time ranges, the binary code defining a particular color of typewriter display 449 corresponding to the determined time range, and conveys the code to color memory 434 to be stored therein, until the next time measurement is completed, and thence applied to color control 50 for illuminating typewriter display 449 in the selected color.

By way of an example, and with reference to CHART 3, when CPU 470 measures the time for the typing of the 10 character group to be 4.2 seconds, it will be determined that this value lies in the time range 6 to 3 seconds (CHART 3, line 2), which corresponds to typing speed range 20 to 40 words per minute. CPU 470 accordingly selects binary code 010 and conveys the code to color memory 436*a* shown in detail in FIG. 39. It is readily apparent that the binary code, when latched in color memory 436*a*, drives the color control line Y to a high logic level, to thereby cause typewriter display 449*a*, shown in detail in FIG. 45, to be illuminated in yellow color.

By way of another example, and with reference to CHART 4, when CPU 470 measures time for the typing of the 10 character group to be 2.8 seconds, it will be determined that this value lies in the time range 3 to 2.4 seconds (CHART 4, line 4), which corresponds to typing speed range 40 to 50 words per minute. CPU 470 accordingly selects and conveys to the color memory 436*b*, shown in detail in FIG. 40, binary code 0001000. It is readily apparent that the binary code, when latched in color memory 436*b*, drives the color control line G to a high logic level, to thereby cause typewriter display 449*b*, shown in detail in FIG. 46, to be illuminated in green color.

In the view of this disclosure, the composition of software commanding CPU 470 to measure typing speed and to control the color of typewriter display 449 accordingly would be within the scope of ordinary skill.

As viewed in CHART 3, typewriter display 449 is illuminated in one of three possible colors in accordance with the measured typing speed, comparably with CHART 1.

As viewed in CHART 4, typewriter display 449 is illuminated in one of seven possible colors in accordance with the measured typing speed, comparably with CHART 2.

In a detail of color memory 436*a* shown in FIG. 39, three least significant data bus lines D0, D1, and D2 are applied to like inputs of color memory 436*a* and may be latched therein by a suitable transition on the data line D7. The need for latching is dictated by the fact that data bus 472, viewed in FIG. 38, may carry at other times signals for other devices. The latched data appear at the outputs Q0, Q1, and Q2 as color control signals R, Y, and G, which may be applied to like color control inputs R, Y, and G of typewriter display 449*a* shown in FIG. 45.

In a like detail of color memory 436*b* shown in FIG. 40, seven least significant data bus lines D0 to D6 are applied to like inputs of color memory 436*b* and may be latched therein by a suitable transition on the data line D7. The latched data appear at the outputs Q0 to Q6 as color control signals R, W, Y, G, BG, P, and B, which may be applied to like color control inputs R, W, Y, G, BG, P, and B of typewriter display 449*b* shown in FIG. 46.

To control the color of typewriter display 449 substantially continuously, CPU 470, at the completion of each time measurement of a group of 10 characters, conveys the measured value directly to color memory 434, viewed in FIG. 38, to be used as an address for the color converter memory which contains data representing the values of primary colors for all possible measured time values.

Figure 41:
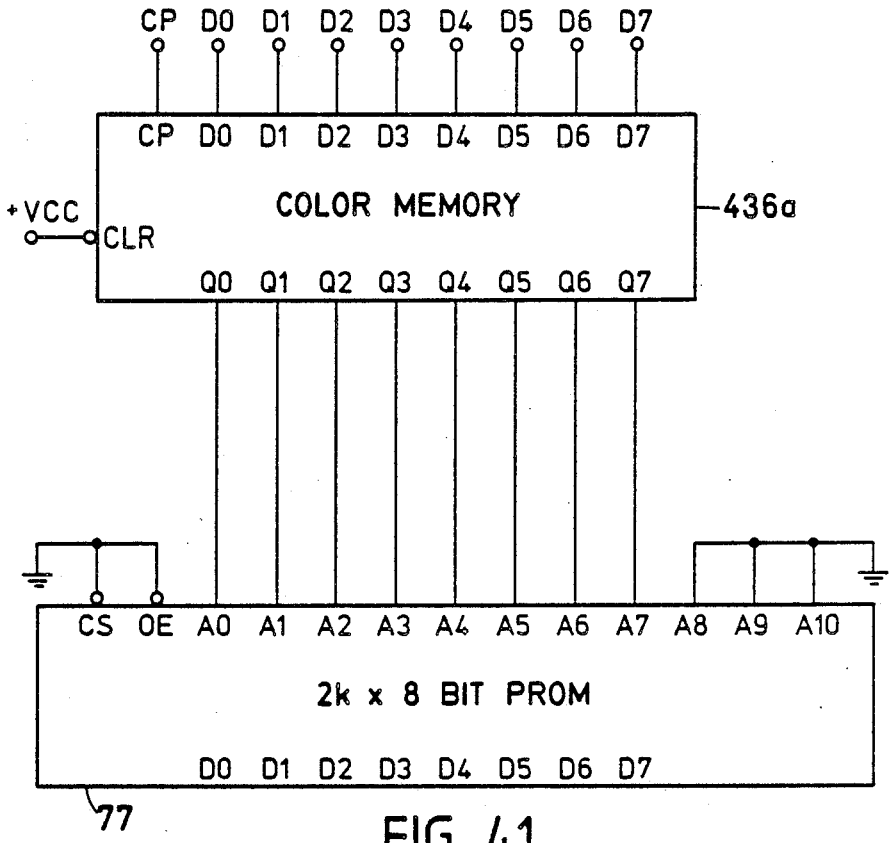
FIG. 41 is a detail of the color memory of FIG. 38 used in a 2-LED continuously variable color converter.

In a detail of the combination of color memory 436*a* and PROM 77, shown in FIG. 41, the data bus lines D0 to D7 are applied to corresponding inputs of color memory 436*a* and may be latched therein by a suitable signal at its input CP. The latched data appear at the outputs Q0 to Q7 and thence are respectively applied to the address inputs A0 to A7 of memory 77, which contains data representing the portions of red color for all possible input combinations. The memory outputs D0 to D7 may be applied as shown in FIG. 17, to develop control signals RB and GB, which may be applied to like bus control inputs RB and GB of typewriter display 449*c* shown in FIG. 47.

Figure 42:
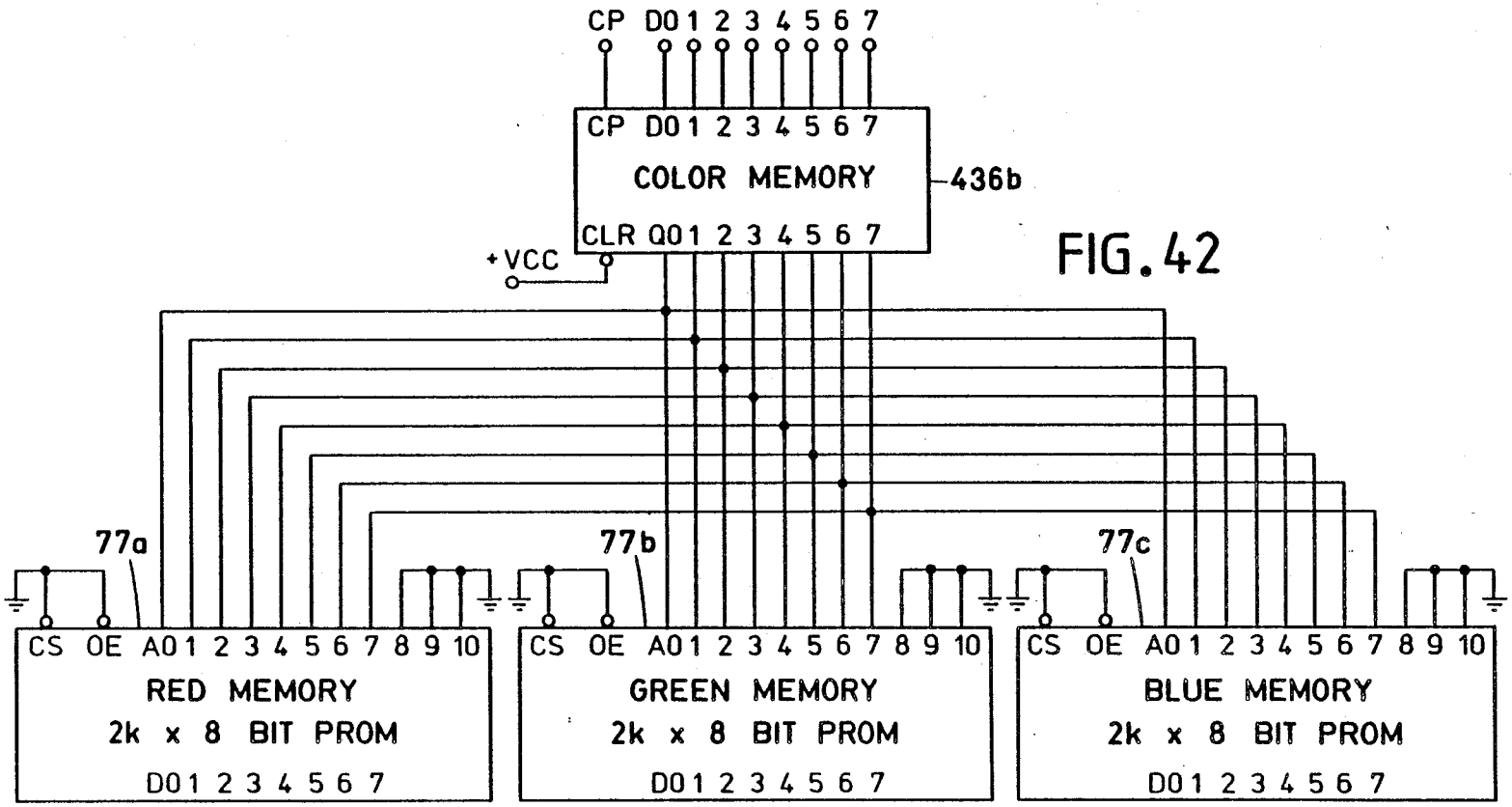
FIG. 42 is a detail of the color memory of FIG. 38 used in a 3-LED continuously variable color converter.

In a like detail of the color memory 436*b* in combination with red memory 77*a*, green memory 77*b*, and blue memory 77*c*, shown in FIG. 42, the data bus lines D0 to D7 are applied to interconnected address inputs A0 to A7 of red memory 77*a*, green memory 77*b*, and blue memory 77*c*, which contain data representing the portions of red, green, and blue primary colors, respectively, for all possible input combinations, as explained previously. The memory outputs D0 to D7 may be connected as shown in FIG. 19, to develop control signals RB, GB, and BB, which may be applied to like bus control inputs RB, GB, and BB of typewriter display 449*d* shown in FIG. 48.

Figure 43:
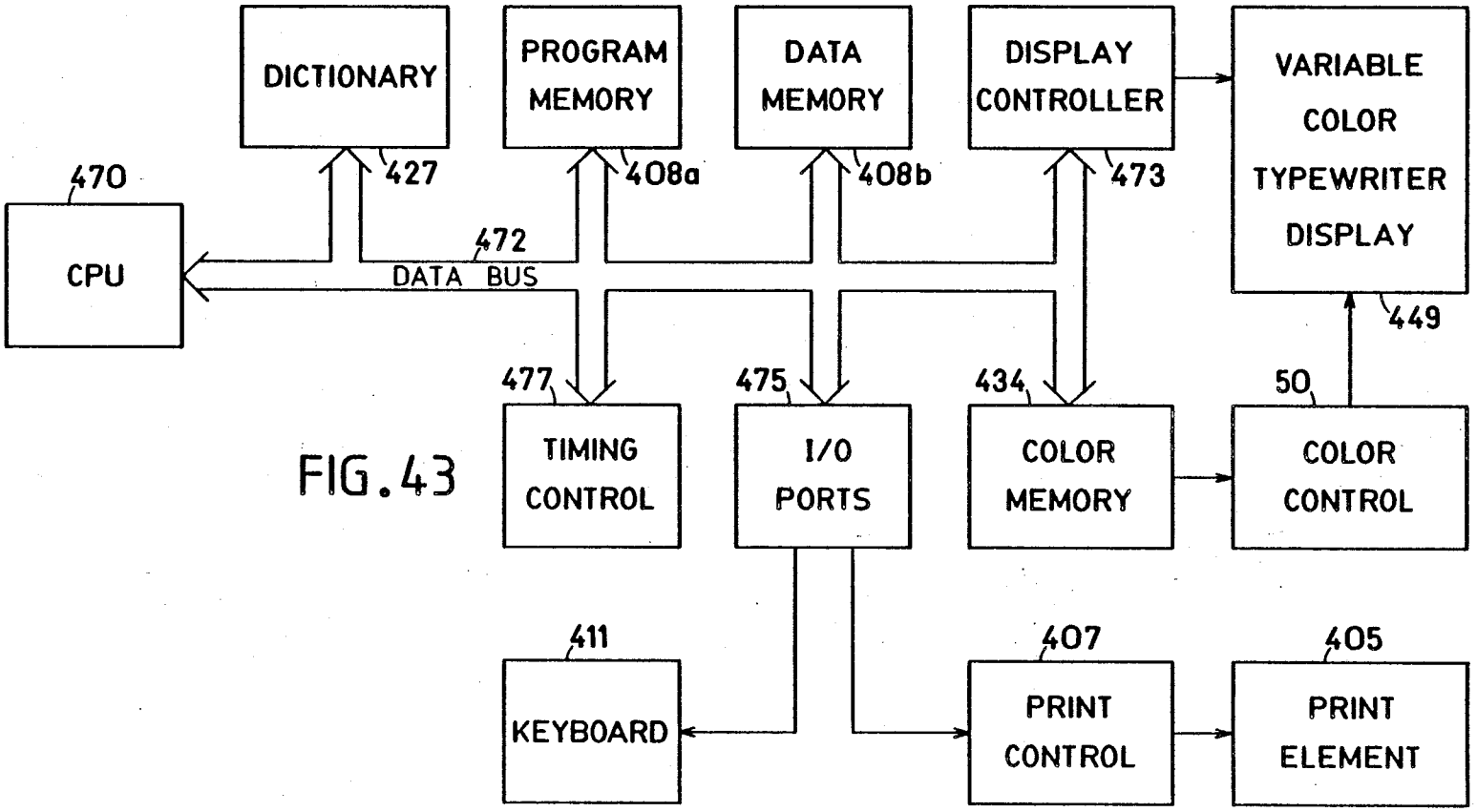
FIG. 43 is a block diagram of a CPU controlled variable color display typewriter with spelling checker.

Another embodiment of a variable color display typewriter, shown in FIG. 43, is additionally equipped with a dictionary 427 containing suitably arranged words for verification of spelling. The dictionary 427 may reside in a suitable memory, such as a ROM or magnetic disk. CPU 470 is employed verifying the accuracy of typed words. Since the operation of spelling checkers is well known, it will not be described in detail. It will suffice to state that CPU 470 identifies a group of typed characters as a word by noting word separators, such are space, comma, period, question mark, exclamation mark, and the like, and eliminates one letter words and other than fully alphabetic words. CPU 470 then attempts to find the instant typed word in dictionary 427. If the word is found, it is assumed to be spelled correctly; if it is not found, it is assumed to be incorrect - either misspelled or unknown.

The invention resides in the method of displaying the typed text when an incorrectly typed word is detected. The method can be as unsophisticated as merely changing the color of typewriter display 449 when an incorrectly typed word is detected, or it may involve more complex decisions based on the number of spelling errors, complexity of the particular word, and the like.

By way of an example, and with reference to CHART 3, when the instant measured typing speed is 50 words per minute, typewriter display 449 is illuminated in green color. When an incorrectly typed word is detected under such conditions, the color of typewriter display 449 is changed to yellow for the remainder of the measurement period. As another example, and with reference to CHART 4, when an incorrectly typed word is detected while typewriter display 449 is illuminated in purple color, which indicates typing speed between 61 to 70 words per minute, CPU 470 sends data to color memory 434 for changing the color of typewriter display 449 to blue-green for the remainder of the measurement period, to effectively decrease the indicated typing speed. It would be obvious to those skilled in the art, in the view of this disclosure, how to compose software commanding CPU 470 to modify the color of typewriter display 449 in accordance with the detection of incorrectly typed words.

Figure 44:
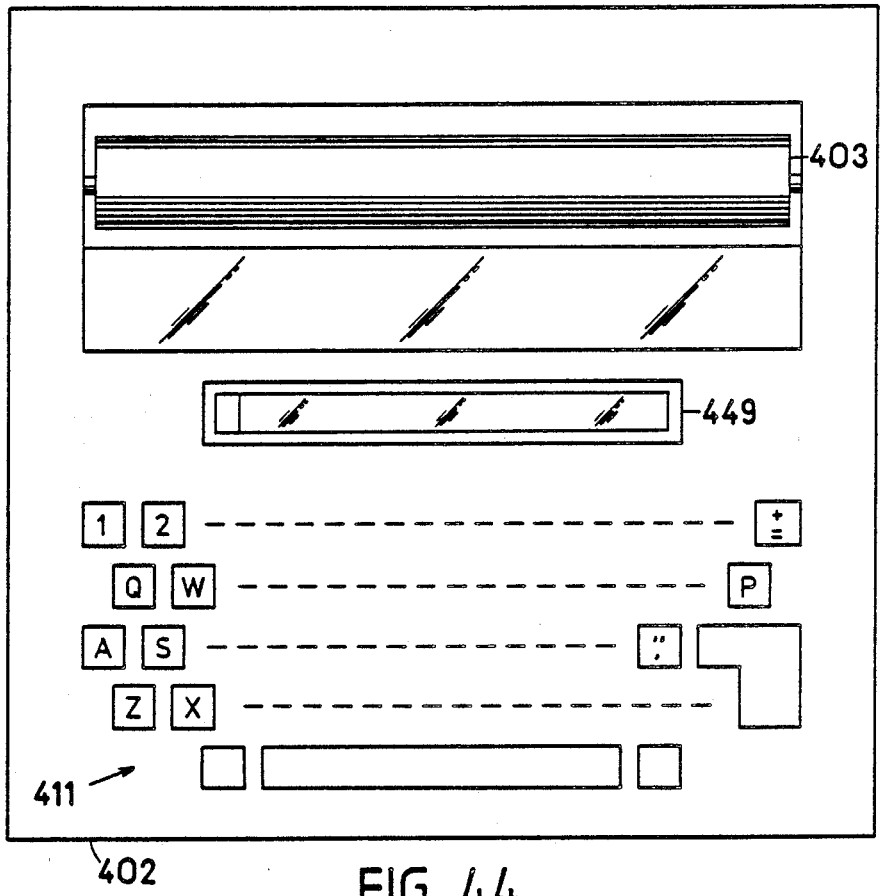
FIG. 44 is a top view of a variable color display typewriter of the present invention.

The typewriter of this invention, portrayed in FIG. 44, includes substantially conventional keyboard 411, having keys representing individual alphanumeric characters, and platen 403, which may be enclosed in a suitable frame 402. As will be more fully pointed out subsequently, typewriter display 449 is formed of a plurality of variable color display elements mounted in a side by side relation such that typed text may be visually presented in a substantially conventional manner. Although not specifically illustrated, it will be appreciated that typewriter display 449 may be, alternatively, located adjacent to the typewriter or even remotely.

In the detail of typewriter display **449*a* shown in FIG. 45, the broken lines indicate that in reality there may be more display elements than illustrated (e.g., thirty). The display elements 46*e*, 46*f* to 46*n* use variable color display segments 1 arranged in 7 rows by 5 columns dot matrices 1*e*, 1*f* to 1*n*, which may be selectively energized in different combinations to display all known alpha-numeric characters. The color control inputs R, Y, and G of associated color controls 52*e*, 52*f* to 52*n* are respectively interconnected for controlling the color of all display elements 46*e*, 46*f* to 46*n* uniformly in three steps. All enable inputs E are grounded to permit display elements 46*e*, 46*f* to 46*n*** to be illuminated.

In the detail of a like typewriter display **449*b* shown in FIG. 46, display elements 47*e*, 47*f* to 47*n* use variable color display segments 1 similarly arranged in dot matrices 1*e*, 1*f* to 1*n*. The color control inputs B, P, BG, G, Y, W, and R of associated color controls 53*e*, 53*f* to 53*n* are respectively interconnected in a comparable fashion for controlling the color of all display elements 47*e*, 47*f* to 47*n*** uniformly in seven steps.

Figure 47:
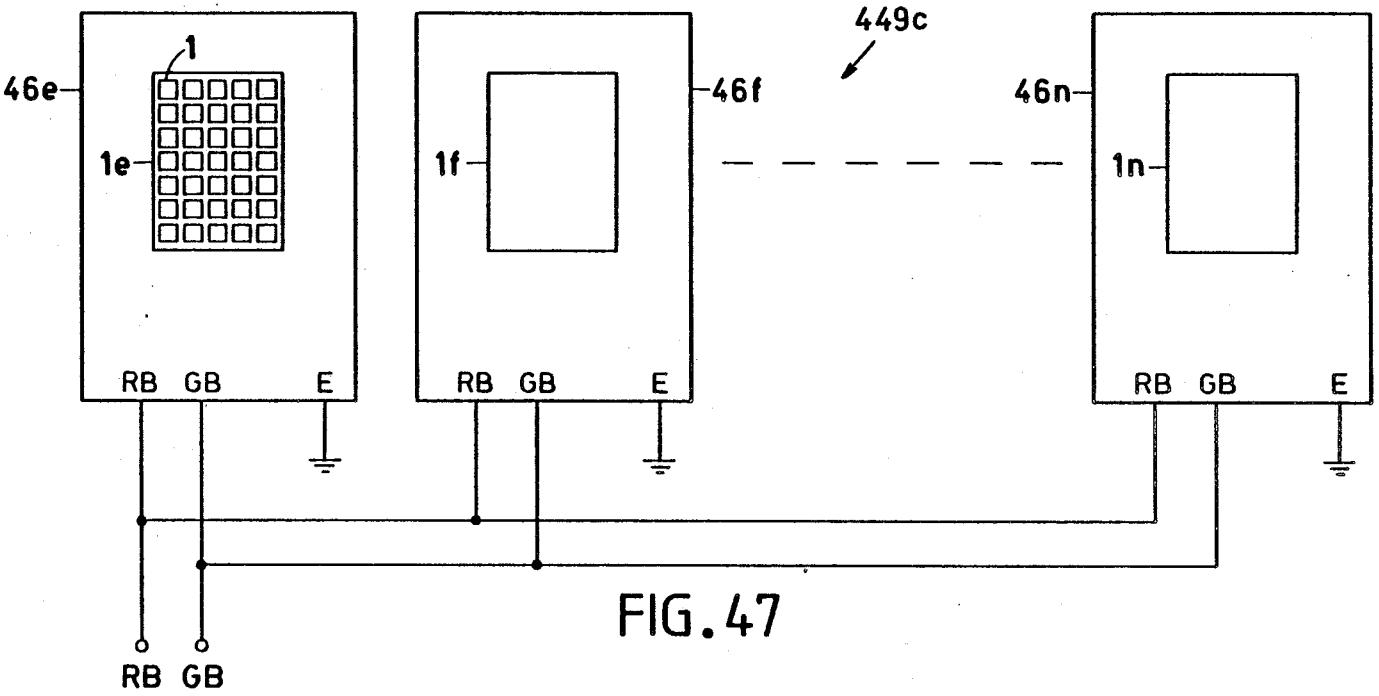
FIG. 47 is a detail of a variable color typewriter display showing the interconnection of continuously variable color 2-LED display elements.

In the detail of a like typewriter display **449*c* shown in FIG. 47, the bus control inputs RB and GB of all display elements 46*e*, 46*f* to 46*n* are respectively interconnected for uniformly controlling their color substantially continuously. It would be obvious to those skilled in the art that suitable buffers may be used, if needed, to ensure that the bus driving circuits are not overloaded. All enable inputs E are grounded to allow all display elements 46*e*, 46*f* to 46*n*** to be illuminated.

Figure 48:
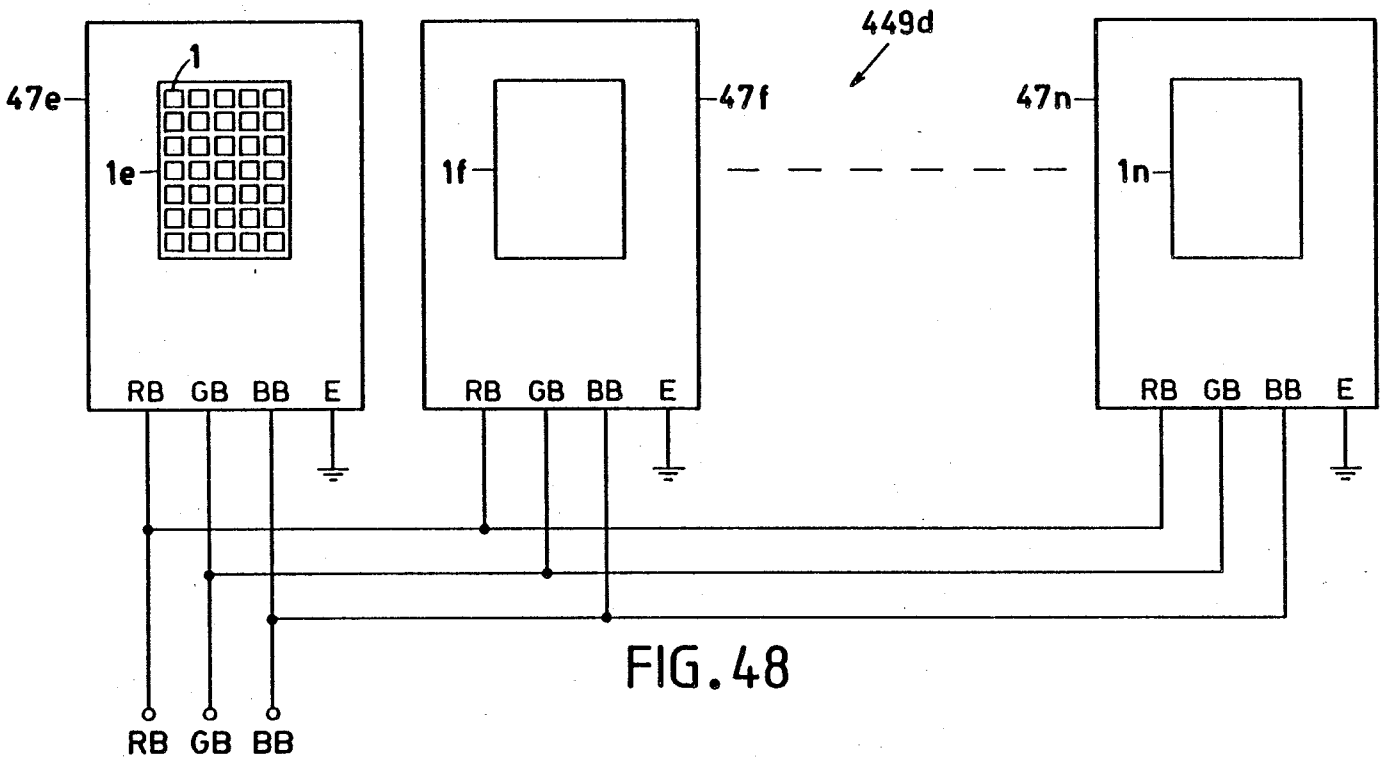
FIG. 48 is a detail of a variable color typewriter display showing the interconnection of continuously variable color 3-LED display elements.

In the detail of a like typewriter display **449*d* shown in FIG. 48, the bus control inputs RB, GB, and BB of all display elements 47*e*, 47*f* to 47*n*** are respectively interconnected for uniformly controlling their color substantially continuously.

In brief summary, the invention describes a method and apparatus, in a variable color display typewriter, for simultaneously displaying typed text and indicating typing speed and accuracy, by visually presenting the typed text in a color variable in accordance with the typing speed and accuracy.

It would be obvious that numerous modifications can be made in the construction of the preferred embodiments shown herein, without departing from the spirit of the invention as defined in the appended claims. It is contemplated that the principles of the invention may be also applied to numerous diverse types of display devices, such as liquid crystal, plasma devices, and the like.

CORRELATION TABLE

This is a correlation table of reference characters used in the drawings herein, their descriptions, and examples of commercially available parts.

| # | DESCRIPTION | EXAMPLE |
|---|---|---|
| 1 | display segment | |
| 2 | red LED | |
| 3 | green LED | |
| 4 | blue LED | |
| 5 | red bus | |
| 6 | green bus | |
| 7 | blue bus | |
| 15 | segment body | |
| 16 | light scattering material | |
| 21 | display decoder | |
| 23 | common cathode 7-segment decoder driver | 74LS49 |
| 24 | common anode 7-segment decoder driver | 74LS47 |
| 40 | variable color display | |
| 42 | variable color 7-segment display element (2 LEDs) | |
| 43 | variable color 7-segment display element (3 LEDs) | |
| 46 | variable color display element (2 LEDs) | |
| 47 | variable color display element (3 LEDs) | |
| 50 | color control | |
| 51 | step variable color control | |
| 52 | color control (2 LEDs) | |
| 53 | color control (3 LEDs) | |
| 56 | continuously variable color converter | |
| 57 | 2-primary color converter | |
| 59 | single color converter | |
| 60 | 2-input OR gate | 74HC32 |
| 61 | 4-input OR gate | 4072 |
| 62 | non-inverting buffer | 74LS244 |
| 63 | inverting buffer | 74LS240 |
| 64 | inverter part of | 74LS240,4 |
| 71 | 8-bit counter | 74F579 |
| 73 | D type flip-flop | 74HC74 |
| 74 | A/D converter | |
| 75 | 8-bit A/D converter | AD570 |
| 76 | memory | |
| 77 | 2k × 8 bit PROM | 2716 |
| 80 | scaling circuit | |
| 81 | op amp | LM741 |
| 90 | resistor | |
| 92 | potentiometer | |
| 99 | pulse | |
| 402 | typewriter frame | |
| 403 | platen | |
| 405 | print element | |
| 407 | print control | |
| 408 | memory | |

CORRELATION TABLE-continued

This is a correlation table of reference characters used in the drawings herein, their descriptions, and examples of commercially available parts.

| # | DESCRIPTION | EXAMPLE |
|---|---|---|
| 409 | display memory | |
| 411 | keyboard | |
| 413 | decoder & memory | |
| 415 | keyboard encoder | KR9600-STD |
| 423 | typing speed converter | |
| 425 | time base | |
| 427 | dictionary | |
| 428 | typing accuracy converter | |
| 429 | spelling converter | |
| 430 | spelling checker | |
| 431 | resistor | |
| 433 | capacitor | |
| 434 | color memory | |
| 435 | color control latch | |
| 436 | 8-bit color memory | 74HC273 |
| 437 | counter control | |
| 449 | variable color typewriter display | |
| 450 | counter | |
| 451 | 8-bit counter with register | 74HC590 |
| 452 | 14-bit binary counter | 14020 |
| 454 | 3-to-8 line decoder | 74HC237 |
| 455 | oscillator | |
| 456 | timer | NE555 |
| 457 | one shot multivibrator | 74HC123 |
| 461 | 2-input OR gate | 74HC32 |
| 470 | CPU | 8049 |
| 472 | data bus | |
| 473 | display controller | |
| 475 | I/O ports | Am2950 |
| 477 | timing control | Am9513A |
| 499 | pulse | |

The examples of commercially available components should be considered as merely illustrative. It will be appreciated that other components may be readily and effectively used. The integrated circuits used in the description of the invention are manufactured by several well known companies, such are Analog Devices, Inc., Fairchild Camera and Instrument Corporation, Intel Corporation, Motorola Semiconductor Products Inc., National Semiconductor Incorporated, Texas Instruments Incorporated, etc.

TABLE 1

| Input Voltage (volts) | PROM Address (Hex) | DATA 'Red' PROM (hex) | Portions red | Portions green |
|---|---|---|---|---|
| 0.0 | 00 | 00 | 0.0 | 1.0 |
| 0.039 | 01 | 00 | 0.0 | 1.0 |
| 0.078 | 02 | 00 | 0.0 | 1.0 |
| 0.117 | 03 | 00 | 0.0 | 1.0 |
| 0.156 | 04 | 00 | 0.0 | 1.0 |
| 0.195 | 05 | 00 | 0.0 | 1.0 |
| 0.234 | 06 | 00 | 0.0 | 1.0 |
| 0.273 | 07 | 00 | 0.0 | 1.0 |
| 0.312 | 08 | 00 | 0.0 | 1.0 |
| 0.352 | 09 | 00 | 0.0 | 1.0 |
| 0.391 | 0A | 00 | 0.0 | 1.0 |
| 0.430 | 0B | 00 | 0.0 | 1.0 |
| 0.469 | 0C | 00 | 0.0 | 1.0 |
| 0.508 | 0D | 00 | 0.0 | 1.0 |
| 0.547 | 0E | 00 | 0.0 | 1.0 |
| 0.586 | 0F | 00 | 0.0 | 1.0 |
| 0.625 | 10 | 40 | 0.25 | 0.75 |
| 0.664 | 11 | 40 | 0.25 | 0.75 |
| 0.703 | 12 | 40 | 0.25 | 0.75 |
| 0.742 | 13 | 40 | 0.25 | 0.75 |
| 0.781 | 14 | 40 | 0.25 | 0.75 |
| 0.820 | 15 | 40 | 0.25 | 0.75 |
| 0.859 | 16 | 40 | 0.25 | 0.75 |
| 0.898 | 17 | 40 | 0.25 | 0.75 |
| 0.937 | 18 | 40 | 0.25 | 0.75 |

TABLE 1-continued

| Input Voltage (volts) | PROM Address (Hex) | DATA 'Red' PROM (hex) | Portions red | Portions green |
|---|---|---|---|---|
| 0.977 | 19 | 40 | 0.25 | 0.75 |
| 1.016 | 1A | 40 | 0.25 | 0.75 |
| 1.055 | 1B | 40 | 0.25 | 0.75 |
| 1.094 | 1C | 40 | 0.25 | 0.75 |
| 1.133 | 1D | 40 | 0.25 | 0.75 |
| 1.172 | 1E | 40 | 0.25 | 0.75 |
| 1.211 | 1F | 40 | 0.25 | 0.75 |
| 1.250 | 20 | 80 | 0.5 | 0.5 |
| 1.289 | 21 | 80 | 0.5 | 0.5 |
| 1.328 | 22 | 80 | 0.5 | 0.5 |
| 1.367 | 23 | 80 | 0.5 | 0.5 |
| 1.406 | 24 | 80 | 0.5 | 0.5 |
| 1.445 | 25 | 80 | 0.5 | 0.5 |
| 1.484 | 26 | 80 | 0.5 | 0.5 |
| 1.523 | 27 | 80 | 0.5 | 0.5 |
| 1.562 | 28 | 80 | 0.5 | 0.5 |
| 1.602 | 29 | 80 | 0.5 | 0.5 |
| 1.641 | 2A | 80 | 0.5 | 0.5 |
| 1.680 | 2B | 80 | 0.5 | 0.5 |
| 1.719 | 2C | 80 | 0.5 | 0.5 |
| 1.758 | 2D | 80 | 0.5 | 0.5 |
| 1.797 | 2E | 80 | 0.5 | 0.5 |
| 1.836 | 2F | 80 | 0.5 | 0.5 |
| 1.875 | 30 | C0 | 0.75 | 0.25 |
| 1.914 | 31 | C0 | 0.75 | 0.25 |
| 1.953 | 32 | C0 | 0.75 | 0.25 |
| 1.992 | 33 | C0 | 0.75 | 0.25 |
| 2.031 | 34 | C0 | 0.75 | 0.25 |
| 2.070 | 35 | C0 | 0.75 | 0.25 |
| 2.109 | 36 | C0 | 0.75 | 0.25 |
| 2.148 | 37 | C0 | 0.75 | 0.25 |
| 2.187 | 38 | C0 | 0.75 | 0.25 |
| 2.227 | 39 | C0 | 0.75 | 0.25 |
| 2.266 | 3A | C0 | 0.75 | 0.25 |
| 2.305 | 3B | C0 | 0.75 | 0.25 |
| 2.344 | 3C | C0 | 0.75 | 0.25 |
| 2.389 | 3D | C0 | 0.75 | 0.25 |
| 2.422 | 3E | C0 | 0.75 | 0.25 |
| 2.461 | 3F | C0 | 0.75 | 0.25 |
| 2.500 | 40 | FF | 1.0 | 0.0 |
| 2.539 | 41 | FF | 1.0 | 0.0 |
| 2.578 | 42 | FF | 1.0 | 0.0 |
| 2.617 | 43 | FF | 1.0 | 0.0 |
| 2.656 | 44 | FF | 1.0 | 0.0 |
| 2.695 | 45 | FF | 1.0 | 0.0 |
| 2.734 | 46 | FF | 1.0 | 0.0 |
| 2.773 | 47 | FF | 1.0 | 0.0 |
| 2.812 | 48 | FF | 1.0 | 0.0 |
| 2.852 | 49 | FF | 1.0 | 0.0 |
| 2.891 | 4A | FF | 1.0 | 0.0 |
| 2.930 | 4B | FF | 1.0 | 0.0 |
| 2.969 | 4C | FF | 1.0 | 0.0 |
| 3.008 | 4D | FF | 1.0 | 0.0 |
| 3.047 | 4E | FF | 1.0 | 0.0 |
| 3.086 | 4F | FF | 1.0 | 0.0 |
| 3.125 | 50 | 00 | 0.0 | 1.0 |
| 3.164 | 51 | 00 | 0.0 | 1.0 |
| 3.203 | 52 | 00 | 0.0 | 1.0 |
| 3.242 | 53 | 00 | 0.0 | 1.0 |
| 3.281 | 54 | 00 | 0.0 | 1.0 |
| 3.320 | 55 | 00 | 0.0 | 1.0 |
| 3.359 | 56 | 00 | 0.0 | 1.0 |
| 3.398 | 57 | 00 | 0.0 | 1.0 |
| 3.437 | 58 | 00 | 0.0 | 1.0 |
| 3.477 | 59 | 00 | 0.0 | 1.0 |
| 3.516 | 5A | 00 | 0.0 | 1.0 |
| 3.555 | 5B | 00 | 0.0 | 1.0 |
| 3.594 | 5C | 00 | 0.0 | 1.0 |
| 3.633 | 5D | 00 | 0.0 | 1.0 |
| 3.672 | 5E | 00 | 0.0 | 1.0 |
| 3.711 | 5F | 00 | 0.0 | 1.0 |
| 3.750 | 60 | 40 | 0.25 | 0.75 |
| 3.789 | 61 | 40 | 0.25 | 0.75 |
| 3.828 | 62 | 40 | 0.25 | 0.75 |
| 3.867 | 63 | 40 | 0.25 | 0.75 |
| 3.906 | 64 | 40 | 0.25 | 0.75 |
| 3.945 | 65 | 40 | 0.25 | 0.75 |

TABLE 1-continued

| Input Voltage (volts) | PROM Address (Hex) | DATA 'Red' PROM (hex) | Portions red | Portions green |
|---|---|---|---|---|
| 3.984 | 66 | 40 | 0.25 | 0.75 |
| 4.023 | 67 | 40 | 0.25 | 0.75 |
| 4.062 | 68 | 40 | 0.25 | 0.75 |
| 4.102 | 69 | 40 | 0.25 | 0.75 |
| 4.141 | 6A | 40 | 0.25 | 0.75 |
| 4.178 | 6B | 40 | 0.25 | 0.75 |
| 4.219 | 6C | 40 | 0.25 | 0.75 |
| 4.258 | 6D | 40 | 0.25 | 0.75 |
| 4.299 | 6E | 40 | 0.25 | 0.75 |
| 4.336 | 6F | 40 | 0.25 | 0.75 |
| 4.375 | 70 | 80 | 0.5 | 0.5 |
| 4.414 | 71 | 80 | 0.5 | 0.5 |
| 4.453 | 72 | 80 | 0.5 | 0.5 |
| 4.492 | 73 | 80 | 0.5 | 0.5 |
| 4.531 | 74 | 80 | 0.5 | 0.5 |
| 4.570 | 75 | 80 | 0.5 | 0.5 |
| 4.609 | 76 | 80 | 0.5 | 0.5 |
| 4.648 | 77 | 80 | 0.5 | 0.5 |
| 4.687 | 78 | 80 | 0.5 | 0.5 |
| 4.727 | 79 | 80 | 0.5 | 0.5 |
| 4.766 | 7A | 80 | 0.5 | 0.5 |
| 4.805 | 7B | 80 | 0.5 | 0.5 |
| 4.844 | 7C | 80 | 0.5 | 0.5 |
| 4.883 | 7D | 80 | 0.5 | 0.5 |
| 4.922 | 7E | 80 | 0.5 | 0.5 |
| 4.961 | 7F | 80 | 0.5 | 0.5 |
| 5.000 | 80 | C0 | 0.75 | 0.25 |
| 5.039 | 81 | C0 | 0.75 | 0.25 |
| 5.078 | 82 | C0 | 0.75 | 0.25 |
| 5.117 | 83 | C0 | 0.75 | 0.25 |
| 5.156 | 84 | C0 | 0.75 | 0.25 |
| 5.195 | 85 | C0 | 0.75 | 0.25 |
| 5.234 | 86 | C0 | 0.75 | 0.25 |
| 5.273 | 87 | C0 | 0.75 | 0.25 |
| 5.312 | 88 | C0 | 0.75 | 0.25 |
| 5.352 | 89 | C0 | 0.75 | 0.25 |
| 5.391 | 8A | C0 | 0.75 | 0.25 |
| 5.430 | 8B | C0 | 0.75 | 0.25 |
| 5.469 | 8C | C0 | 0.75 | 0.25 |
| 5.508 | 8D | C0 | 0.75 | 0.25 |
| 5.547 | 8E | C0 | 0.75 | 0.25 |
| 5.586 | 8F | C0 | 0.75 | 0.25 |
| 5.625 | 90 | FF | 1.0 | 0.0 |
| 5.664 | 91 | FF | 1.0 | 0.0 |
| 5.703 | 92 | FF | 1.0 | 0.0 |
| 5.742 | 93 | FF | 1.0 | 0.0 |
| 5.781 | 94 | FF | 1.0 | 0.0 |
| 5.820 | 95 | FF | 1.0 | 0.0 |
| 5.859 | 96 | FF | 1.0 | 0.0 |
| 5.898 | 97 | FF | 1.0 | 0.0 |
| 5.937 | 98 | FF | 1.0 | 0.0 |
| 5.977 | 99 | FF | 1.0 | 0.0 |
| 6.016 | 9A | FF | 1.0 | 0.0 |
| 6.055 | 9B | FF | 1.0 | 0.0 |
| 6.094 | 9C | FF | 1.0 | 0.0 |
| 6.133 | 9D | FF | 1.0 | 0.0 |
| 6.172 | 9E | FF | 1.0 | 0.0 |
| 6.211 | 9F | FF | 1.0 | 0.0 |
| 6.250 | A0 | 00 | 0.0 | 1.0 |
| 6.289 | A1 | 00 | 0.0 | 1.0 |
| 6.328 | A2 | 00 | 0.0 | 1.0 |
| 6.367 | A3 | 00 | 0.0 | 1.0 |
| 6.406 | A4 | 00 | 0.0 | 1.0 |
| 6.445 | A5 | 00 | 0.0 | 1.0 |
| 6.484 | A6 | 00 | 0.0 | 1.0 |
| 6.524 | A7 | 00 | 0.0 | 1.0 |
| 6.562 | A8 | 00 | 0.0 | 1.0 |
| 6.602 | A9 | 00 | 0.0 | 1.0 |
| 6.641 | AA | 00 | 0.0 | 1.0 |
| 6.680 | AB | 00 | 0.0 | 1.0 |
| 6.719 | AC | 00 | 0.0 | 1.0 |
| 6.758 | AD | 00 | 0.0 | 1.0 |
| 6.797 | AE | 00 | 0.0 | 1.0 |
| 6.836 | AF | 00 | 0.0 | 1.0 |
| 6.875 | B0 | 40 | 0.25 | 0.75 |
| 6.914 | B1 | 40 | 0.25 | 0.75 |
| 6.953 | B2 | 40 | 0.25 | 0.75 |

TABLE 1-continued

| Input Voltage (volts) | PROM Address (Hex) | DATA 'Red' PROM (hex) | Portions red | Portions green |
|---|---|---|---|---|
| 6.992 | B3 | 40 | 0.25 | 0.75 |
| 7.031 | B4 | 40 | 0.25 | 0.75 |
| 7.070 | B5 | 40 | 0.25 | 0.75 |
| 7.109 | B6 | 40 | 0.25 | 0.75 |
| 7.148 | B7 | 40 | 0.25 | 0.75 |
| 7.187 | B8 | 40 | 0.25 | 0.75 |
| 7.227 | B9 | 40 | 0.25 | 0.75 |
| 7.266 | BA | 40 | 0.25 | 0.75 |
| 7.305 | BB | 40 | 0.25 | 0.75 |
| 7.344 | BC | 40 | 0.25 | 0.75 |
| 7.383 | BD | 40 | 0.25 | 0.75 |
| 7.422 | BE | 40 | 0.25 | 0.75 |
| 7.461 | BF | 40 | 0.25 | 0.75 |
| 7.500 | C0 | 80 | 0.5 | 0.5 |
| 7.539 | C1 | 80 | 0.5 | 0.5 |
| 7.587 | C2 | 80 | 0.5 | 0.5 |
| 7.617 | C3 | 80 | 0.5 | 0.5 |
| 7.656 | C4 | 80 | 0.5 | 0.5 |
| 7.695 | C5 | 80 | 0.5 | 0.5 |
| 7.734 | C6 | 80 | 0.5 | 0.5 |
| 7.773 | C7 | 80 | 0.5 | 0.5 |
| 7.812 | C8 | 80 | 0.5 | 0.5 |
| 7.852 | C9 | 80 | 0.5 | 0.5 |
| 7.891 | CA | 80 | 0.5 | 0.5 |
| 7.930 | CB | 80 | 0.5 | 0.5 |
| 7.969 | CC | 80 | 0.5 | 0.5 |
| 8.008 | CD | 80 | 0.5 | 0.5 |
| 8.047 | CE | 80 | 0.5 | 0.5 |
| 8.086 | CF | 80 | 0.5 | 0.5 |
| 8.125 | D0 | C0 | 0.75 | 0.25 |
| 8.164 | D1 | C0 | 0.75 | 0.25 |
| 8.203 | D2 | C0 | 0.75 | 0.25 |
| 8.242 | D3 | C0 | 0.75 | 0.25 |
| 8.281 | D4 | C0 | 0.75 | 0.25 |
| 8.320 | D5 | C0 | 0.75 | 0.25 |
| 8.359 | D6 | C0 | 0.75 | 0.25 |
| 8.398 | D7 | C0 | 0.75 | 0.25 |
| 8.437 | D8 | C0 | 0.75 | 0.25 |
| 8.477 | D9 | C0 | 0.75 | 0.25 |
| 8.516 | DA | C0 | 0.75 | 0.25 |
| 8.555 | DB | C0 | 0.75 | 0.25 |
| 8.594 | DC | C0 | 0.75 | 0.25 |
| 8.633 | DD | C0 | 0.75 | 0.25 |
| 8.672 | DE | C0 | 0.75 | 0.25 |
| 8.711 | DF | C0 | 0.75 | 0.25 |
| 8.750 | E0 | FF | 1.0 | 0.0 |
| 8.789 | E1 | FF | 1.0 | 0.0 |
| 8.828 | E2 | FF | 1.0 | 0.0 |
| 8.867 | E3 | FF | 1.0 | 0.0 |
| 8.906 | E4 | FF | 1.0 | 0.0 |
| 8.945 | E5 | FF | 1.0 | 0.0 |
| 8.984 | E6 | FF | 1.0 | 0.0 |
| 9.023 | E7 | FF | 1.0 | 0.0 |
| 9.062 | E8 | FF | 1.0 | 0.0 |
| 9.102 | E9 | FF | 1.0 | 0.0 |
| 9.141 | EA | FF | 1.0 | 0.0 |
| 9.180 | EB | FF | 1.0 | 0.0 |
| 9.219 | EC | FF | 1.0 | 0.0 |
| 9.258 | ED | FF | 1.0 | 0.0 |
| 9.299 | EE | FF | 1.0 | 0.0 |
| 9.336 | EF | FF | 1.0 | 0.0 |
| 9.375 | F0 | 00 | 0.0 | 1.0 |
| 9.414 | F1 | 00 | 0.0 | 1.0 |
| 9.453 | F2 | 00 | 0.0 | 1.0 |
| 9.492 | F3 | 00 | 0.0 | 1.0 |
| 9.531 | F4 | 00 | 0.0 | 1.0 |
| 9.570 | F5 | 00 | 0.0 | 1.0 |
| 9.609 | F6 | 00 | 0.0 | 1.0 |
| 9.648 | F7 | 00 | 0.0 | 1.0 |
| 9.687 | F8 | 00 | 0.0 | 1.0 |
| 9.727 | F9 | 00 | 0.0 | 1.0 |
| 9.766 | FA | 00 | 0.0 | 1.0 |
| 9.805 | FB | 00 | 0.0 | 1.0 |
| 9.844 | FC | 00 | 0.0 | 1.0 |
| 9.883 | FD | 00 | 0.0 | 1.0 |
| 9.922 | FE | 00 | 0.0 | 1.0 |

TABLE 1-continued

| Input Voltage (volts) | PROM Address (Hex) | DATA 'Red' PROM (hex) | Portions red | green |
|---|---|---|---|---|
| 9.961 | FF | 00 | 0.0 | 1.0 |

TABLE 2

| Input Voltage (Volts) | PROM Address (Hex) | DATA 'Red' PROM (Hex) | 'Green' PROM (Hex) | 'Blue' PROM (Hex) | PORTIONS red | green | blue |
|---|---|---|---|---|---|---|---|
| 0.0 | 00 | FF | 00 | 00 | 1.0 | 0.0 | 0.0 |
| 0.039 | 01 | FE | 02 | 00 | 0.992 | 0.008 | 0.0 |
| 0.078 | 02 | FC | 04 | 00 | 0.984 | 0.016 | 0.0 |
| 0.117 | 03 | FA | 06 | 00 | 0.976 | 0.024 | 0.0 |
| 0.156 | 04 | F8 | 08 | 00 | 0.969 | 0.031 | 0.0 |
| 0.195 | 05 | F6 | 0A | 00 | 0.961 | 0.039 | 0.0 |
| 0.234 | 06 | F4 | 0C | 00 | 0.953 | 0.047 | 0.0 |
| 0.273 | 07 | F2 | 0E | 00 | 0.945 | 0.055 | 0.0 |
| 0.312 | 08 | F0 | 10 | 00 | 0.937 | 0.063 | 0.0 |
| 0.352 | 09 | EE | 12 | 00 | 0.930 | 0.070 | 0.0 |
| 0.391 | 0A | EC | 14 | 00 | 0.922 | 0.078 | 0.0 |
| 0.430 | 0B | EA | 16 | 00 | 0.914 | 0.086 | 0.0 |
| 0.469 | 0C | E8 | 18 | 00 | 0.906 | 0.094 | 0.0 |
| 0.508 | 0D | E6 | 1A | 00 | 0.899 | 0.101 | 0.0 |
| 0.547 | 0E | E4 | 1C | 00 | 0.891 | 0.109 | 0.0 |
| 0.586 | 0F | E2 | 1E | 00 | 0.883 | 0.117 | 0.0 |
| 0.625 | 10 | E0 | 20 | 00 | 0.875 | 0.125 | 0.0 |
| 0.664 | 11 | DE | 22 | 00 | 0.867 | 0.133 | 0.0 |
| 0.703 | 12 | DC | 24 | 00 | 0.859 | 0.141 | 0.0 |
| 0.742 | 13 | DA | 26 | 00 | 0.851 | 0.149 | 0.0 |
| 0.781 | 14 | D8 | 28 | 00 | 0.844 | 0.156 | 0.0 |
| 0.820 | 15 | D6 | 2A | 00 | 0.836 | 0.164 | 0.0 |
| 0.859 | 16 | D4 | 2C | 00 | 0.828 | 0.172 | 0.0 |
| 0.898 | 17 | D2 | 2E | 00 | 0.820 | 0.180 | 0.0 |
| 0.937 | 18 | D0 | 30 | 00 | 0.812 | 0.188 | 0.0 |
| 0.977 | 19 | CE | 32 | 00 | 0.804 | 0.196 | 0.0 |
| 1.016 | 1A | CC | 34 | 00 | 0.796 | 0.204 | 0.0 |
| 1.055 | 1B | CA | 36 | 00 | 0.788 | 0.212 | 0.0 |
| 1.094 | 1C | C8 | 38 | 00 | 0.781 | 0.219 | 0.0 |
| 1.133 | 1D | C6 | 3A | 00 | 0.773 | 0.227 | 0.0 |
| 1.172 | 1E | C4 | 3C | 00 | 0.766 | 0.234 | 0.0 |
| 1.211 | 1F | C2 | 3E | 00 | 0.758 | 0.242 | 0.0 |
| 1.250 | 20 | C0 | 40 | 00 | 0.75 | 0.25 | 0.0 |
| 1.289 | 21 | BE | 42 | 00 | 0.742 | 0.258 | 0.0 |
| 1.328 | 22 | BC | 44 | 00 | 0.734 | 0.266 | 0.0 |
| 1.367 | 23 | BA | 46 | 00 | 0.726 | 0.274 | 0.0 |
| 1.406 | 24 | B8 | 48 | 00 | 0.719 | 0.281 | 0.0 |
| 1.445 | 25 | B6 | 4A | 00 | 0.711 | 0.289 | 0.0 |
| 1.484 | 26 | B4 | 4C | 00 | 0.703 | 0.297 | 0.0 |
| 1.523 | 27 | B2 | 4E | 00 | 0.695 | 0.305 | 0.0 |
| 1.562 | 28 | B0 | 50 | 00 | 0.687 | 0.313 | 0.0 |
| 1.602 | 29 | AE | 52 | 00 | 0.680 | 0.320 | 0.0 |
| 1.641 | 2A | AC | 54 | 00 | 0.672 | 0.328 | 0.0 |
| 1.680 | 2B | AA | 56 | 00 | 0.664 | 0.336 | 0.0 |
| 1.719 | 2C | A8 | 58 | 00 | 0.656 | 0.344 | 0.0 |
| 1.758 | 2D | A6 | 5A | 00 | 0.648 | 0.352 | 0.0 |
| 1.797 | 2E | A4 | 5C | 00 | 0.641 | 0.359 | 0.0 |
| 1.836 | 2F | A2 | 5E | 00 | 0.633 | 0.367 | 0.0 |
| 1.875 | 30 | A0 | 60 | 00 | 0.625 | 0.375 | 0.0 |
| 1.914 | 31 | 9E | 62 | 00 | 0.613 | 0.383 | 0.0 |
| 1.953 | 32 | 9C | 64 | 00 | 0.609 | 0.391 | 0.0 |
| 1.992 | 33 | 9A | 66 | 00 | 0.602 | 0.398 | 0.0 |
| 2.031 | 34 | 98 | 68 | 00 | 0.594 | 0.406 | 0.0 |
| 2.070 | 35 | 96 | 6A | 00 | 0.586 | 0.414 | 0.0 |
| 2.109 | 36 | 94 | 6C | 00 | 0.578 | 0.422 | 0.0 |
| 2.148 | 37 | 92 | 6E | 00 | 0.570 | 0.430 | 0.0 |
| 2.187 | 38 | 90 | 70 | 00 | 0.562 | 0.438 | 0.0 |
| 2.227 | 39 | 8E | 72 | 00 | 0.554 | 0.446 | 0.0 |
| 2.266 | 3A | 8C | 74 | 00 | 0.547 | 0.453 | 0.0 |
| 2.305 | 3B | 8A | 76 | 00 | 0.539 | 0.461 | 0.0 |
| 2.344 | 3C | 88 | 78 | 00 | 0.531 | 0.469 | 0.0 |
| 2.389 | 3D | 86 | 7A | 00 | 0.524 | 0.476 | 0.0 |
| 2.422 | 3E | 84 | 7C | 00 | 0.516 | 0.484 | 0.0 |
| 2.461 | 3F | 82 | 7E | 00 | 0.508 | 0.492 | 0.0 |
| 2.500 | 40 | 80 | 80 | 00 | 0.5 | 0.5 | 0.0 |
| 2.539 | 41 | 7C | 84 | 00 | 0.484 | 0.516 | 0.0 |
| 2.578 | 42 | 78 | 88 | 00 | 0.469 | 0.531 | 0.0 |
| 2.617 | 43 | 74 | 8C | 00 | 0.453 | 0.547 | 0.0 |
| 2.656 | 44 | 70 | 90 | 00 | 0.437 | 0.563 | 0.0 |
| 2.695 | 45 | 6C | 94 | 00 | 0.422 | 0.578 | 0.0 |
| 2.734 | 46 | 68 | 98 | 00 | 0.406 | 0.594 | 0.0 |
| 2.773 | 47 | 64 | 9C | 00 | 0.391 | 0.609 | 0.0 |

TABLE 2-continued

| Input Voltage (Volts) | PROM Address (Hex) | DATA 'Red' PROM (Hex) | DATA 'Green' PROM (Hex) | DATA 'Blue' PROM (Hex) | PORTIONS red | PORTIONS green | PORTIONS blue |
|---|---|---|---|---|---|---|---|
| 2.812 | 48 | 60 | A0 | 00 | 0.375 | 0.625 | 0.0 |
| 2.852 | 49 | 5C | A4 | 00 | 0.359 | 0.641 | 0.0 |
| 2.891 | 4A | 58 | A8 | 00 | 0.344 | 0.656 | 0.0 |
| 2.930 | 4B | 54 | AC | 00 | 0.328 | 0.672 | 0.0 |
| 2.969 | 4C | 50 | B0 | 00 | 0.312 | 0.688 | 0.0 |
| 3.008 | 4D | 4C | B4 | 00 | 0.297 | 0.703 | 0.0 |
| 3.047 | 4E | 48 | B8 | 00 | 0.281 | 0.719 | 0.0 |
| 3.086 | 4F | 44 | BC | 00 | 0.266 | 0.734 | 0.0 |
| 3.125 | 50 | 40 | C0 | 00 | 0.25 | 0.75 | 0.0 |
| 3.164 | 51 | 3C | C4 | 00 | 0.234 | 0.766 | 0.0 |
| 3.203 | 52 | 38 | C8 | 00 | 0.219 | 0.781 | 0.0 |
| 3.242 | 53 | 34 | CC | 00 | 0.203 | 0.797 | 0.0 |
| 3.281 | 54 | 30 | D0 | 00 | 0.187 | 0.813 | 0.0 |
| 3.320 | 55 | 2C | D4 | 00 | 0.172 | 0.828 | 0.0 |
| 3.359 | 56 | 28 | D8 | 00 | 0.156 | 0.844 | 0.0 |
| 3.398 | 57 | 24 | DC | 00 | 0.141 | 0.859 | 0.0 |
| 3.437 | 58 | 20 | E0 | 00 | 0.125 | 0.875 | 0.0 |
| 3.477 | 59 | 1C | E4 | 00 | 0.109 | 0.891 | 0.0 |
| 3.516 | 5A | 18 | E8 | 00 | 0.094 | 0.906 | 0.0 |
| 3.555 | 5B | 14 | EC | 00 | 0.078 | 0.922 | 0.0 |
| 3.594 | 5C | 10 | F0 | 00 | 0.062 | 0.938 | 0.0 |
| 3.633 | 5D | 0C | F4 | 00 | 0.047 | 0.953 | 0.0 |
| 3.672 | 5E | 08 | F8 | 00 | 0.031 | 0.967 | 0.0 |
| 3.711 | 5F | 04 | FC | 00 | 0.016 | 0.984 | 0.0 |
| 3.750 | 60 | 00 | FF | 00 | 0.0 | 1.0 | 0.0 |
| 3.789 | 61 | 00 | F8 | 08 | 0.0 | 0.969 | 0.031 |
| 3.828 | 62 | 00 | F0 | 10 | 0.0 | 0.937 | 0.063 |
| 3.867 | 63 | 00 | E8 | 18 | 0.0 | 0.906 | 0.094 |
| 3.906 | 64 | 00 | E0 | 20 | 0.0 | 0.875 | 0.125 |
| 3.945 | 65 | 00 | D8 | 28 | 0.0 | 0.844 | 0.156 |
| 3.984 | 66 | 00 | D0 | 30 | 0.0 | 0.812 | 0.188 |
| 4.023 | 67 | 00 | C8 | 38 | 0.0 | 0.781 | 0.219 |
| 4.062 | 68 | 00 | C0 | 40 | 0.0 | 0.75 | 0.25 |
| 4.102 | 69 | 00 | B8 | 48 | 0.0 | 0.719 | 0.281 |
| 4.141 | 6A | 00 | B0 | 50 | 0.0 | 0.687 | 0.313 |
| 4.178 | 6B | 00 | A8 | 58 | 0.0 | 0.656 | 0.344 |
| 4.219 | 6C | 00 | A0 | 60 | 0.0 | 0.625 | 0.375 |
| 4.258 | 6D | 00 | 98 | 68 | 0.0 | 0.594 | 0.406 |
| 4.299 | 6E | 00 | 90 | 70 | 0.0 | 0.562 | 0.438 |
| 4.336 | 6F | 00 | 88 | 78 | 0.0 | 0.531 | 0.469 |
| 4.375 | 70 | 00 | 80 | 80 | 0.0 | 0.5 | 0.5 |
| 4.414 | 71 | 00 | 78 | 88 | 0.0 | 0.469 | 0.531 |
| 4.453 | 72 | 00 | 70 | 90 | 0.0 | 0.437 | 0.563 |
| 4.492 | 73 | 00 | 68 | 98 | 0.0 | 0.406 | 0.594 |
| 4.531 | 74 | 00 | 60 | A0 | 0.0 | 0.375 | 0.625 |
| 4.570 | 75 | 00 | 58 | A8 | 0.0 | 0.344 | 0.656 |
| 4.609 | 76 | 00 | 50 | B0 | 0.0 | 0.312 | 0.688 |
| 4.648 | 77 | 00 | 48 | B8 | 0.0 | 0.281 | 0.719 |
| 4.687 | 78 | 00 | 40 | C0 | 0.0 | 0.25 | 0.75 |
| 4.727 | 79 | 00 | 38 | C8 | 0.0 | 0.219 | 0.781 |
| 4.766 | 7A | 00 | 30 | D0 | 0.0 | 0.187 | 0.813 |
| 4.805 | 7B | 00 | 28 | D8 | 0.0 | 0.156 | 0.844 |
| 4.844 | 7C | 00 | 20 | E0 | 0.0 | 0.125 | 0.875 |
| 4.883 | 7D | 00 | 18 | E8 | 0.0 | 0.094 | 0.906 |
| 4.922 | 7E | 00 | 10 | F0 | 0.0 | 0.062 | 0.938 |
| 4.961 | 7F | 00 | 08 | F8 | 0.0 | 0.031 | 0.967 |
| 5.000 | 80 | 00 | 00 | FF | 0.0 | 0.0 | 1.0 |
| 5.039 | 81 | 04 | 00 | FC | 0.016 | 0.0 | 0.984 |
| 5.078 | 82 | 08 | 00 | F8 | 0.031 | 0.0 | 0.969 |
| 5.117 | 83 | 0C | 00 | F4 | 0.047 | 0.0 | 0.953 |
| 5.156 | 84 | 10 | 00 | F0 | 0.063 | 0.0 | 0.937 |
| 5.195 | 85 | 14 | 00 | EC | 0.078 | 0.0 | 0.922 |
| 5.234 | 86 | 18 | 00 | E8 | 0.094 | 0.0 | 0.906 |
| 5.273 | 87 | 1C | 00 | E4 | 0.109 | 0.0 | 0.891 |
| 5.312 | 88 | 20 | 00 | E0 | 0.125 | 0.0 | 0.875 |
| 5.352 | 89 | 24 | 00 | DC | 0.141 | 0.0 | 0.859 |
| 5.391 | 8A | 28 | 00 | D8 | 0.156 | 0.0 | 0.844 |
| 5.430 | 8B | 2C | 00 | D4 | 0.172 | 0.0 | 0.828 |
| 5.469 | 8C | 30 | 00 | D0 | 0.188 | 0.0 | 0.812 |
| 5.508 | 8D | 34 | 00 | CC | 0.2 | 0.0 | 0.8 |
| 5.547 | 8E | 38 | 00 | C8 | 0.219 | 0.0 | 0.781 |
| 5.586 | 8F | 3C | 00 | C4 | 0.234 | 0.0 | 0.766 |
| 5.625 | 90 | 40 | 00 | C0 | 0.25 | 0.0 | 0.75 |
| 5.664 | 91 | 44 | 00 | BC | 0.266 | 0.0 | 0.734 |
| 5.703 | 92 | 48 | 00 | B8 | 0.281 | 0.0 | 0.719 |
| 5.742 | 93 | 4C | 00 | B4 | 0.297 | 0.0 | 0.703 |
| 5.781 | 94 | 50 | 00 | B0 | 0.313 | 0.0 | 0.687 |

TABLE 2-continued

| Input Voltage (Volts) | PROM Address (Hex) | DATA 'Red' PROM (Hex) | 'Green' PROM (Hex) | 'Blue' PROM (Hex) | PORTIONS red | green | blue |
|---|---|---|---|---|---|---|---|
| 5.820 | 95 | 54 | 00 | AC | 0.328 | 0.0 | 0.672 |
| 5.859 | 96 | 58 | 00 | A8 | 0.344 | 0.0 | 0.656 |
| 5.898 | 97 | 5C | 00 | A4 | 0.359 | 0.0 | 0.641 |
| 5.937 | 98 | 60 | 00 | A0 | 0.375 | 0.0 | 0.625 |
| 5.977 | 99 | 64 | 00 | 9C | 0.391 | 0.0 | 0.609 |
| 6.016 | 9A | 68 | 00 | 98 | 0.406 | 0.0 | 0.594 |
| 6.055 | 9B | 6C | 00 | 94 | 0.422 | 0.0 | 0.578 |
| 6.094 | 9C | 70 | 00 | 90 | 0.438 | 0.0 | 0.562 |
| 6.133 | 9D | 74 | 00 | 8C | 0.453 | 0.0 | 0.547 |
| 6.172 | 9E | 78 | 00 | 88 | 0.469 | 0.0 | 0.531 |
| 6.211 | 9F | 7C | 00 | 84 | 0.484 | 0.0 | 0.516 |
| 6.250 | A0 | 80 | 00 | 80 | 0.5 | 0.0 | 0.5 |
| 6.289 | A1 | 84 | 00 | 7C | 0.516 | 0.0 | 0.484 |
| 6.328 | A2 | 88 | 00 | 78 | 0.531 | 0.0 | 0.469 |
| 6.367 | A3 | 8C | 00 | 74 | 0.547 | 0.0 | 0.453 |
| 6.406 | A4 | 90 | 00 | 70 | 0.563 | 0.0 | 0.437 |
| 6.445 | A5 | 94 | 00 | 6C | 0.578 | 0.0 | 0.422 |
| 6.484 | A6 | 98 | 00 | 68 | 0.594 | 0.0 | 0.406 |
| 6.524 | A7 | 9C | 00 | 64 | 0.609 | 0.0 | 0.391 |
| 6.562 | A8 | A0 | 00 | 60 | 0.625 | 0.0 | 0.375 |
| 6.602 | A9 | A4 | 00 | 5C | 0.641 | 0.0 | 0.359 |
| 6.641 | AA | A8 | 00 | 58 | 0.656 | 0.0 | 0.344 |
| 6.680 | AB | AC | 00 | 54 | 0.672 | 0.0 | 0.328 |
| 6.719 | AC | B0 | 00 | 50 | 0.688 | 0.0 | 0.312 |
| 6.758 | AD | B4 | 00 | 4C | 0.703 | 0.0 | 0.297 |
| 6.797 | AE | B8 | 00 | 48 | 0.719 | 0.0 | 0.281 |
| 6.836 | AF | BC | 00 | 44 | 0.734 | 0.0 | 0.266 |
| 6.875 | B0 | C0 | 00 | 40 | 0.75 | 0.0 | 0.25 |
| 6.914 | B1 | C4 | 00 | 3C | 0.766 | 0.0 | 0.234 |
| 6.953 | B2 | C8 | 00 | 38 | 0.781 | 0.0 | 0.219 |
| 6.992 | B3 | CC | 00 | 34 | 0.797 | 0.0 | 0.203 |
| 7.031 | B4 | D0 | 00 | 30 | 0.813 | 0.0 | 0.187 |
| 7.070 | B5 | D4 | 00 | 2C | 0.828 | 0.0 | 0.172 |
| 7.109 | B6 | D8 | 00 | 28 | 0.844 | 0.0 | 0.156 |
| 7.148 | B7 | DC | 00 | 24 | 0.859 | 0.0 | 0.141 |
| 7.187 | B8 | E0 | 00 | 20 | 0.875 | 0.0 | 0.125 |
| 7.227 | B9 | E4 | 00 | 1C | 0.891 | 0.0 | 0.109 |
| 7.266 | BA | E8 | 00 | 18 | 0.906 | 0.0 | 0.094 |
| 7.305 | BB | EC | 00 | 14 | 0.922 | 0.0 | 0.078 |
| 7.344 | BC | F0 | 00 | 10 | 0.938 | 0.0 | 0.062 |
| 7.383 | BD | F4 | 00 | 0C | 0.953 | 0.0 | 0.047 |
| 7.422 | BE | F8 | 00 | 08 | 0.967 | 0.0 | 0.031 |
| 7.461 | BF | FC | 00 | 04 | 0.984 | 0.0 | 0.016 |

CHART 1

| COUNT | TYPING SPEED (WPM) | COLOR |
|---|---|---|
| <64 | <20 | RED |
| 64 to 127 | 21 to 40 | YELLOW |
| 128 to 191 | 41 to 60 | GREEN |

CHART 2

| COUNT | TYPING SPEED (WPM) | COLOR |
|---|---|---|
| <64 | <20 | RED |
| 64 to 95 | 21 to 30 | WHITE |
| 96 to 127 | 31 to 40 | YELLOW |
| 128 to 159 | 41 to 50 | GREEN |
| 160 to 191 | 51 to 60 | BLUE-GREEN |
| 192 to 223 | 61 to 70 | PURPLE |
| >223 | >70 | BLUE |

CHART 3

| TIME FOR TYPING 10 CHARACTERS (SEC) | BINARY CODE | TYPING SPEED (WPM) | COLOR |
|---|---|---|---|
| >6 | 001 | <20 | RED |
| 6 to 3 | 010 | 20 to 40 | YELLOW |
| 3 to 2 | 100 | 40 to 60 | GREEN |

CHART 4

| TIME FOR TYPING 10 CHARACTERS (SEC) | BINARY CODE | TYPING SPEED (WPM) | COLOR |
|---|---|---|---|
| >6 | 0000001 | <20 | RED |
| 6 to 4 | 0000010 | 20 to 30 | WHITE |
| 4 to 3 | 0000100 | 30 to 40 | YELLOW |
| 3 to 2.4 | 0001000 | 40 to 50 | GREEN |
| 2.4 to 2 | 0010000 | 50 to 60 | BLUE-GREEN |
| 2 to 1.71 | 0100000 | 60 to 70 | PURPLE |
| <1.71 | 1000000 | >70 | BLUE |

What I claim is:

1. A method of simultaneously displaying a typed text and indicating a typing speed and a typing accuracy, on a variable color display means, by causing the typed text to be visually presented on said display means, by determining the typing speed, by verifying the typing accuracy, and by controlling the color of said display means in accordance with both typing speed and typing accuracy.

2. The method as defined in claim 1 wherein the color of said display means may be controlled substantially continuously such that the color changes of said display means are proportional to changes in the typing speed and the typing accuracy.

3. The method as defined in claim 1 wherein the color of said display means may be controlled in a plurality of steps.

4. An apparatus for indicating a typing speed and a typing accuracy comprising:

keyboard means for selectively typing characters at a selective typing speed;

variable color display means for visually presenting typed characters;

means for determining the typing speed;

means for verifying the typing accuracy; and color control means for controlling the color of said display means in accordance with both typing speed and typing accuracy.

5. The apparatus as defined in claim 4 wherein said color control means control the color of said display means substantially continuously such that the color changes of said display means are proportional to changes in the typing speed and the typing accuracy.

6. The apparatus as defined in claim 4 wherein said color control means control the color of said display means in a plurality of steps.

7. An apparatus for indicating a typing speed and a correct spelling of typed words comprising:

keyboard means for selectively typing words at a selective typing speed;

variable color display means for visually presenting typed words;

means for determining the typing speed;

means for verifying correct spelling of the typed words; and color control means for controlling the color of said display means in accordance with both typing speed and correct spelling of the typed words.

8. An apparatus for determining a typing speed and a typing accuracy comprising:

keyboard means for selectively typing characters at a selective typing speed;

variable color display means for visually presenting typed characters;

color memory means for storing a code, said memory means having a memory output indicative of the value of said code;

central processor means for measuring a typing speed and for accordingly storing in said color memory means a code representing a selected color, and for performing a verification of the typing accuracy and for accordingly modifying the code stored in said memory means and representing the selected color, when an incorrectly typed character is detected, to obtain a modified code representing a different color; and color control means responsive to said memory output for controlling the color of said display means in accordance with the code stored in said memory means, to thereby indicate both typing speed and typing accuracy.

9. An apparatus for indicating a typing speed and a correct spelling of typed words comprising:

keyboard means for selectively typing words at a selective typing speed;

variable color display means for visually presenting typed words;

color memory means for storing a code, said memory means having a memory output indicative of the value of said code;

central processor means for measuring a typing speed and for accordingly storing in said color memory means a code representing a selected color, for performing a verification of the typed words for correct spelling, and, in accordance with the result of such verification, when a misspelled typed word is discovered, for conveying a different code to said color memory means; and color control means responsive to said memory output for controlling the color of said display means in accordance with the code stored in said memory means, to thereby indicate both typing speed and correct spelling of typed words.

10. The apparatus as defined in claim 9 wherein, when a misspelled word is discovered, said central processor means convey a code to said color memory means for changing the color of said display means to effectively decrease the indicated typing speed.

* * * * *